US005747235A

United States Patent [19]

Farid et al.

[11] Patent Number: 5,747,235

[45] Date of Patent: May 5, 1998

[54] SILVER HALIDE LIGHT SENSITIVE EMULSION LAYER HAVING ENHANCED PHOTOGRAPHIC SENSITIVITY

[75] Inventors: Samir Y. Farid, Rochester; Jerome R. Lenhard, Fairport; Chin H. Chen, Mendon; Annabel A. Muenter, Rochester; Ian R. Gould, Pittsford; Stephen A. Godleski, Fairport; Paul A. Zielinski, Rochester, all of N.Y.

[73] Assignee: Eastman Kodak Company, Rochester, N.Y.

[21] Appl. No.: 739,921

[22] Filed: Oct. 30, 1996

Related U.S. Application Data

[63] Continuation-in-part of Ser. No. 592,826, Jan. 26, 1996, abandoned.

[51] Int. Cl.[6] ..... G03C 1/09

[52] U.S. Cl. ..... 430/583; 430/599; 430/600; 430/603; 430/607; 430/611; 430/613

[58] Field of Search ..... 430/598, 599, 430/600, 603, 607, 611, 613, 570, 572, 583

[56] References Cited

U.S. PATENT DOCUMENTS

| | | | |
|---|---|---|---|
| 2,419,975 | 5/1947 | Trivelli et al. | 95/6 |
| 2,875,058 | 2/1959 | Carroll et al. | 96/104 |
| 2,937,089 | 5/1960 | Jones et al. | 96/100 |
| 3,457,078 | 7/1969 | Riester | 96/104 |
| 3,458,318 | 7/1969 | Brooks | 96/104 |
| 3,615,632 | 10/1971 | Shiba et al. | 96/122 |
| 3,695,888 | 10/1972 | Hiller et al. | 96/123 |
| 3,706,567 | 12/1972 | Hiller | 96/126 |
| 3,809,561 | 5/1974 | Ulbing et al. | 96/84 |
| 4,297,441 | 10/1981 | Kaneko et al. | 430/543 |
| 4,367,279 | 1/1983 | Herz et al. | 430/234 |
| 4,607,006 | 8/1986 | Hirano et al. | 430/572 |
| 4,719,174 | 1/1988 | Hirano et al. | 430/598 |
| 4,897,343 | 1/1990 | Ikeda et al. | 430/570 |
| 4,917,997 | 4/1990 | Ikeda | 430/572 |
| 4,971,890 | 11/1990 | Okada et al. | 430/264 |
| 4,985,351 | 1/1991 | Matejec et al. | 430/598 |
| 5,059,516 | 10/1991 | Sato et al. | 430/599 |
| 5,190,855 | 3/1993 | Toya et al. | 430/599 |
| 5,192,654 | 3/1993 | Hioki et al. | 430/576 |
| 5,212,056 | 5/1993 | Beltramini | 430/572 |
| 5,213,952 | 5/1993 | Kuwashima et al. | 430/378 |
| 5,244,779 | 9/1993 | Asami et al. | 430/503 |
| 5,298,383 | 3/1994 | Mihayashi et al. | 430/557 |
| 5,306,612 | 4/1994 | Philip, Jr. et al. | 430/572 |

FOREIGN PATENT DOCUMENTS

| | | |
|---|---|---|
| 0 554 856 A1 | 8/1993 | European Pat. Off. . |
| 0 652 470 A1 | 5/1995 | European Pat. Off. . |
| 4343622 A1 | 6/1994 | Germany . |
| 1 064 193 | 4/1967 | United Kingdom . |
| 1 255 084 | 11/1971 | United Kingdom . |

OTHER PUBLICATIONS

Roberts, John D. and Caserio, Marjorie C. *Basic Principles of Organic Chemistry*, New York: W. A. Benjamin, Inc. 1965.

R. K. Ahrenkiel et a., "The Theory of the Photographic Process", 4th Edition, T. H. James Editor, pp. 265–266, Macmillan 1977.

Naoki Obi et al., "A New High Contrast System Using Pyridinium Salts", May 1994, pp. 322–325, IS&T's 47th Annual Conference/ICPS 1994.

Corwin Hansch et al., "A survey of Hammett Substituent Constants and Resonance and Field Parameters", American Chem. Society, 1991, pp. 165–196.

*Primary Examiner*—Janet C. Baxter
*Attorney, Agent, or Firm*—Edith A. Rice

[57] ABSTRACT

A photographic element comprising at least one silver halide emulsion layer in which the silver halide is sensitized with a compound of the formula:

$$A-(L-XY)_k$$
or
$$(A-L)_k-XY$$

wherein A is a silver halide adsorptive group that contains at least one atom of N, S, Se, or Te that promotes adsorption to silver halide, and L represents a linking group containing at least one C, N, S or O atom, k is 1 or 2, and XY is an fragmentable electron donor moiety in which X is an electron donor group and Y is a leaving group other than hydrogen, and wherein:

1) XY has an oxidation potential between 0 and about 1–4 V; and 2) the oxidized form of XY undergoes a bond cleavage reaction to give the radical $X^{\bullet}$ and the leaving fragment Y.

In a preferred embodiment of the invention, the radical $X^{\bullet}$ has an oxidation potential $\leqq -0.7V$.

48 Claims, No Drawings

SILVER HALIDE LIGHT SENSITIVE EMULSION LAYER HAVING ENHANCED PHOTOGRAPHIC SENSITIVITY

CROSS-REFERENCE TO RELATED APPLICATION

This is a continuation-in-part of application Ser. No. 08/592,826, filed Jan. 26, 1996, now abandoned, entitled "Silver Halide Light Sensitive Emulsion Having Enhanced Photographic Sensitivity" by Samir Farid et al., the entire disclosures of which are incorporated herein by reference.

FIELD OF THE INVENTION

This invention relates to a photographic element comprising at least one light sensitive silver halide emulsion layer which has enhanced photographic sensitivity.

BACKGROUND OF THE INVENTION

A variety of techniques have been used to improve the light-sensitivity of photographic silver halide materials.

Chemical sensitizing agents have been used to enhance the intrinsic sensitivity of silver halide. Conventional chemical sensitizing agents include various sulfur, gold, and group VIII metal compounds.

Spectral sensitizing agents, such as cyanine and other polymethine dyes, have been used alone, or in combination, to impart spectral sensitivity to emulsions in specific wavelength regions. These sensitizing dyes function by absorbing long wavelength light that is essentially unabsorbed by the silver halide emulsion and using the energy of that light to cause latent image formation in the silver halide.

Many attempts have been made to further increase the spectral sensitivity of silver halide materials. One method is to increase the amount of light captured by the spectral sensitizing agent by increasing the amount of spectral sensitizing agent added to the emulsion. However, a pronounced decrease in photographic sensitivity is obtained if more than an optimum amount of dye is added to the emulsion. This phenomenon is known as dye desensitization and involves sensitivity loss in both the spectral region wherein the sensitizing dye absorbs light, and in the light sensitive region intrinsic to silver halide. Dye desensitization has been described in The Theory of the Photographic Process, Fourth Edition, T. H. James, Editor, pages 265–266, (Macmillan, 1977).

It is also known that the spectral sensitivity found for certain sensitizing dyes can be dramatically enhanced by the combination with a second, usually colorless organic compound that itself displays no spectral sensitization effect. This is known as the supersensitizing effect.

Examples of compounds which are conventionally known to enhance spectral sensitivity include sulfonic acid derivatives described in U.S. Pat. Nos. 2,937,089 and 3,706,567, triazine compounds described in U.S. Pat. Nos. 2,875,058 and 3,695,888, mercapto compounds described in U.S. Pat. No. 3,457,078, thiourea compounds described in U.S. Pat. No. 3,458,318, pyrimidine derivatives described in U.S. Pat. No. 3,615,632, dihydropyridine compounds described in U.S. Pat. No. 5,192,654, aminothiatriazoles as described in U.S. Pat. No. 5,306,612 and hydrazines as described in U.S Pat. Nos. 2,419,975, 5,459,052 and 4,971,890 and European Patent Application No. 554,856 A1. The sensitivity increases obtained with these compounds generally are small, and many of these compounds have the disadvantage that they have the undesirable effect of deteriorating the stability of the emulsion or increasing fog.

Various electron donating compounds have also been used to improve spectral sensitivity of silver halide materials. U.S. Pat. No. 3,695,588 discloses that the electron donor ascorbic acid can be used in combination with a specific tricarbocyanine dye to enhance sensitivity in the infrared region. The use of ascorbic acid to give spectral sensitivity improvements when used in combination with specific cyanine and merocyanine dyes is also described in U.S. Pat. No. 3,809,561, British Patent No. 1,255,084, and British Patent No. 1,064,193. U.S. Pat. No. 4,897,343 discloses an improvement that decreases dye desensitization by the use of the combination of ascorbic acid, a metal sulfite compound, and a spectral sensitizing dye.

Electron-donating compounds that are convalently attached to a sensitizing dye or a silver-halide adsorptive group have also been used as supersensitizing agents. U.S. Pat. Nos. 5,436,121 and 5,478,719 disclose sensitivity improvements with the use of compounds containing electron-donating styryl bases attached to monomethine dyes. Spectral sensitivity improvements are also described in U.S. Pat. No. 4,607,006 for compounds containing an electron-donative group derived from a phenothiazine, phenoxazine, carbazole, dibenzophenothiazine, ferrocene, tris(2,2'-bipyridyl)ruthenium, or a triarylamine skeleton which are connected to a silver halide adsorptive group. However, most of these latter compounds have no silver halide sensitizing effect of their own and provide only minus-blue sensitivity improvements when used in combination with a sensitizing dye.

In our co-pending application filed concurrently herewith U.S. patent application Ser. No. 08/740,536 filed Oct. 30, 1996 which is a continuation in part of application Ser. No. 08/592, 106 filed Jan. 26, 1996, we have disclosed a class of organic fragmentable electron donating compounds that, when incorporated into a silver halide emulsion, provide a sensitizing effect alone or in combination with dyes. These compounds donate at least one electron and are fragmentable, i.e., they undergo a bond cleavage reaction other than deprotonation. In this application we describe the attachment of such electron donors to a group that promotes adsorption to the silver halide grain surface. It is desirable to include such an adsorbing moiety so that the beneficial sensitizing effects can be obtained with lower concentrations of the fragmentable-electron donating compounds.

Problem to be Solved by the Invention

There is a continuing need for materials which, when added to photographic emulsions, increase their sensitivity. Ideally such materials should be useable with a wide range of emulsion types, their activity should be controllable and they should not increase fog beyond acceptable limits. This invention provides such materials.

SUMMARY OF THE INVENTION

We have now discovered that attachment of fragmentable electron donors which improve sensitivity of photographic emulsions to a silver halide adsorptive group provides the added advantage of increased emulsion efficiency at relatively low concentrations.

In accordance with this invention, a silver halide emulsion layer of a photographic element is sensitized with a fragmentable electron donor moiety that upon donating an electron, undergoes a bond cleavage reaction other than deprotonation. The term "sensitization" is used in this patent application to mean an increase in the photographic response of the silver halide emulsion layer of a photographic element. The term "sensitizer" is used to mean a compound that provides sensitization when present in a silver halide emulsion layer.

One aspect of this invention comprises a photographic element comprising at least one silver halide emulsion layer in which the silver halide is sensitized with a compound of the formula:

$$A-(L-XY)_k$$
or
$$(A-L)_k-XY$$

wherein A is a silver halide adsorptive group that contains at least one atom of N, S, P, Se, or Te that promotes adsorption to silver halide, and L represents a linking group containing at least one C, N, S or 0 atom, k is 1 or 2, and XY is a fragmentable electron donor moiety in which X is an electron donor group and Y is a leaving group other than hydrogen, and wherein:

1) XY has an oxidation potential between 0 and about 1.4 V; and
2) the oxidized form of XY undergoes a bond cleavage reaction to give the radical $X^{500}$ and the leaving fragment Y.

Another aspect of this invention comprises a photographic element comprising at least one silver halide emulsion layer in which the silver halide is sensitized with a compound of the formula:

$$A-(L-XY)_k$$
or
$$(A-L)_k-XY$$

wherein A is a silver halide adsorptive group that contains at least one atom of N, S, P, Se, or Te that promotes adsorption to silver halide, and L represents a linking group containing at least one C, N, S or 0 atom, k is 1 or 2, and XY is a fragmentable electron donor moiety in which X is an electron donor group and Y is a leaving group other than hydrogen, and wherein:

1) XY has an oxidation potential between 0 and about 1.4 V;
2) the oxidized form of XY undergoes a bond cleavage reaction to give the radical $X^{\bullet}$ and the leaving fragment Y; and
3) the radical $X^{\bullet}$ has an oxidation potential $\leqq -0.7V$ (that is, equal to or more negative than about $-0.7V$).

Compounds which meet criteria (1) and (2) but not (3) are capable of donating one electron and are referred to herein as fragmentable one-electron donors. Compounds which meet all three criteria are capable of donating two electrons and are referred to herein as fragmentable two-electron donors.

In this patent application, oxidation potentials are reported as "V" which represents "volts versus a saturated calomel reference electrode".

Advantageous Effect of the Invention

This invention provides a silver halide photographic emulsion containing an organic electron donor capable of enhancing both the intrinsic sensitivity and, if a dye is present, the spectral sensitivity of the silver halide emulsion. The activity of these compounds can be easily varied with substituents to control their speed and fog effects in a manner appropriate to the particular silver halide emulsion in which they are used. An important feature of these compounds is that they contain a silver halide adsorptive group, so as to minimize the amount of additive needed to produce a beneficial effect in the emulsion.

DETAILED DESCRIPTION OF THE INVENTION

The photographic element of this invention comprises a silver halide emulsion layer which contains a fragmentable electron donating compound represented by the formula:

$$A-(L-XY)_k$$
or
$$(A-L)_k-XY$$

which when added to a silver halide emulsion alone or in combination with a spectral sensitizing dye, can increase photographic sensitivity of the silver halide emulsion. The molecule compounds:

$$A-(L-XY)_k$$
or
$$(A-L)_k-XY$$

are comprised of three parts.

The silver-halide adsorptive group, A, contains at least one N, S, P, Se, or Te atom. The group A may be a silver-ion ligand moiety or a cationic surfactant moiety. Silver-ion ligands include: i) sulfur acids and their Se and Te analogs, ii) nitrogen acids, iii) thioethers and their Se and Te analogs, iv) phosphines, v) thionamides, selenamides, and telluramides, and vi) carbon acids. The aforementioned acidic compounds should preferably have acid dissociation constants, pKa, greater than about 5 and smaller than about 14. More specifically, the silver-ion ligand moieties which may be used to promote adsorption to silver halide are the following:

i) Sulfur acids, more commonly referred to as mercaptans or thiols, which upon deprotonation can react with silver ion thereby forming a silver mercaptide or complex ion. Thiols with stable C-S bonds that are not sulfide ion precursors have found use as silver halide adsorptive materials as discussed in The Theory of the Photographic Process, fourth Edition, T. H. James, editor, pages 32–34, (Macmillan, 1977). Substituted or unsubstituted alkyl and aryl thiols with the general structure shown below, as well as their Se and Te analogs may be used:

$$R''-SH \text{ and } R'''-SH$$

The group R" is an aliphatic, aromatic, or heterocyclic group, and may be substituted with functional groups comprising halogen, oxygen, sulfur or nitrogen atoms, and R'" is an aliphatic, aromatic, or heterocyclic group substituted with a $SO_2$ functional group. When the group R'" is used the adsorbing group represents a thiosulfonic acid.

Heterocyclic thiols are the more preferred type in this category of adsorbing groups and these may contain O, S, Se, Te, or N as heteroatoms as given in the following general structures:

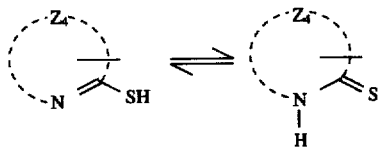

wherein:

$Z_4$ represents the remaining members for completing a preferably 5- or 6-membered ring which may contain one or more additional heteroatoms, such as nitrogen, oxygen, sulfur, selenium or tellurium atom, and is optionally benzo- or naphtho-condensed.

The presence of an —N= adjacent to, or in conjugation with the thiol group introduces a tautomeric equilibrium between the mercaptan [—N=C—SH] and the thionamide structure [—HN—C=S]. The triazolium thiolates of U.S. Pat. No. 4,378,424 represent related mesoionic compounds that cannot tautomerize but are active $Ag^+$ ligands. Preferred heterocyclic thiol silver ligands for use in this invention, which include those common to silver halide technology, are mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, phenylmercaptotetrazole, 1,4,5-trimethyl-1,2,4-triazolium 3-thiolate, and 1-methy-4,5-diphenyl-1,2,4-triazolium-3-thiolate.

ii) Nitrogen acids which upon deprotonation can serve as silver-ion ligands. A variety of nitrogen acids which are common to silver halide technology may be used, but most preferred are those derived from 5- or 6-membered heterocyclic ring compounds containing one or more of nitrogen, or sulfur, or selenium, or tellurium atoms and having the general formula:

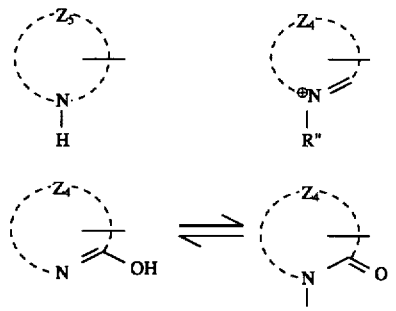

wherein:

$Z_4$ represents the remaining members for completing a preferably 5- or 6-membered ring which may contain one or more additional heteroatoms, such as a nitrogen, oxygen, sulfur, selenium or tellurium atom, and is optionally benzo- or naphtho-condensed, $Z_5$ represents the remaining members for completing a preferably 5- or 6-membered ring which contains at least one additional heteroatom such as nitrogen, oxygen, sulfur, selenium or tellurium and is optionally benzo or naptho-condensed, and $R^1$ is an aliphatic, aromatic, or heterocyclic group, and may be substituted with functional groups comprising a halogen, oxygen, sulfur or nitrogen atom.

Preferred are heterocyclic nitrogen acids including azoles, purines, hydroxy azaindenes, and imides, such as those described in U.S. Pat. No. 2,857,274, the disclosure of which is incorporated herein by reference. The most preferred nitrogen acid moieties are: uracil, tetrazole, benzotriazole, benzothiazole, benzoxazole, adenine, rhodanine, and substituted 1,3,3a,7-tetraazaindenes, such as 5-bromo-4-hydroxy-6-methyl-1,3,3a,7-tetraazaindene.

iii) Cyclic and acyclic thioethers and their Se and Te analog. Preferred members of this ligand category are disclosed in U.S. Pat. No. 5,246,827, the disclosure of which is incorporated herein by reference. Structures for preferred thioethers and analogs are given by the general formulae:

$$-(CH_2)_a-S-(CH_2)_b-CH_3$$

$$-(CH_2)_a-Se-(CH_2)_b-CH_3$$

$$-(CH_2)_a-Te-(CH_2)_b-CH_3$$

$$-(CH_2)_a-S-(CH_2)_b-S-(CH_2)_c-CH_3$$

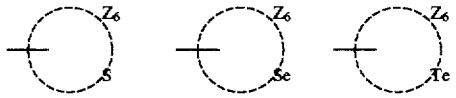

wherein:

a=1–30, b=1–30, c=1–30 with the proviso that a+b+c is ≦ to 30, and $Z_6$ represents the remaining members for completing a 5- to 18-membered ring, or more preferably a 5- to 8-membered ring. The cyclic structures incorporating $Z_6$ may contain more than one S, Se, or Te atom. R" is an aliphatic, aromatic, or heterocyclic group, and may be substituted with functional groups comprising a halogen, oxygen, sulfur or nitrogen atom. Specific examples of this class include: $—CH_2CH_2SCH_2CH_3$, 1,10-dithia-4,7,13,16-tetraoxacyclooctadecane, $—CH_2CH_2TeCH_2CH_3$, $—CH_2CH_2SeCH_2CH_3$, $—CH_2CH_2SCH_2CH_2SCH_2CH_3$, and thiomorpholine.

iv) Phosphines that are active silver halide ligands in silver halide materials may be used. Preferred phosphine compounds are of the formula:

$$(R'')_3—P$$

wherein each R" is independently an aliphatic, aromatic, or heterocyclic group, and may be substituted with functional groups comprising halogen, oxygen, sulfur or nitrogen atoms. Particularly preferred are $P(CH_2CH_2CN)_3$, and m-sulfophenyl-dimethylphosphine.

v) Thionamides, thiosemicarbazides, tellurourea, and selenoureas of the general formulae:

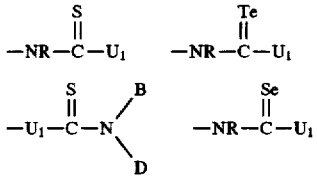

wherein:

$U_1$ represents $—NH_2$, —NHR", $—NR"_2$, —NH—NHR", —SR", OR";

B and D represent R" or, may be linked together, to form the remaining members of a 5- or 6-membered ring; and R" represents an aliphatic, aromatic or heterocyclic group, and R is hydrogen or alkyl or an aryl group.

Many such thionamide $Ag^+$ ligands are described in U.S. Pat. No. 3,598,598, the disclosure of which is incorporated herein by reference. Preferred examples of thionamides include N,N'-tetraalkylthiourea, N-hydroxyethyl benzthiazoline-2-one, and phenyldimethyldithiocarbamate, and N-substituted thiazoline-2-one.

vi) Carbon acids derived from active methylene compounds that have acid dissociation constants greater than about 5 and less than about 14, such as bromomalonitrile, 1-methyl-3-methyl-1,3,5-trithiane bromide, and acetylenes. Canadian Patent 1,080,532 and U.S. Pat. No. 4,374,279 (both of which are incorporated herein by reference) disclose silver-ion ligands of the carbon acid type for use in silver halide materials. Because the carbon acids have, in general, a lower affinity for silver halide than the other classes of adsorbing groups discussed herein, the carbon acids are less preferred as an adsorbing group. General structures for this class are:

$$R''-C\equiv C-H$$

or $$F''-\underset{|}{CH}-G''$$

wherein:

R" is an aliphatic, aromatic, or heterocyclic group, and may be substituted with functional groups based on halogen, oxygen, sulfur or nitrogen atoms and where F" and G" are independently selected from $-CO_2R''$, $-COR''$, CHO, CN, $SO_2R''$, SOR", $NO_2$, such that the pKa of the CH is between 5 and 14.

Cationic surfactant moieties that may serve as the silver halide adsorptive group include those containing a hydrocarbon chain of at least 4 or more carbon atoms, which may be substituted with functional groups based on halogen, oxygen, sulfur or nitrogen atoms, and which is attached to at least one positively charged ammonium, sulfonium, or phosphonium group. Such cationic surfactants are adsorbed to silver halide grains in emulsions containing an excess of halide ion, mostly by coulombic attraction as reported in J. Colloid Interface Sci., volume 22, 1966, pp. 391. Examples of useful cationic moieties are: dimethyldodecylsulfonium, tetradecyltrimethylammonium, N-dodecylnicotinic acid betaine, and decamethylenepyridinium ion.

Preferred examples of A include an alkyl mercaptan, a cyclic or acyclic thioether group, benzothiazole, tetraazaindene, benzotriazole, tetralkylthiourea, and mercapto-substituted hetero ring compounds especially mercaptotetrazole, mercaptotriazole, mercaptothiadiazole, mercaptoimidazole, mercaptooxadiazole, mercaptothiazole mercaptobenzimidazole, mercaptobenzothiazole, mercaptobenzoxazole, mercaptopyrimidine, mercaptotriazine, phenylmercaptotetrazole, 1,2,4-triazolium thiolate, and related structures.

Most preferred examples of A are: (specific structures for linked A-L-XY compounds are provided hereinafter):

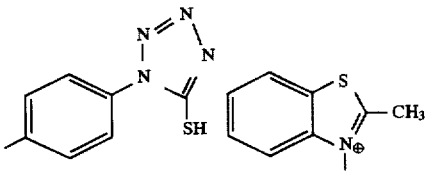

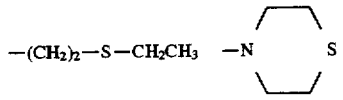

-continued

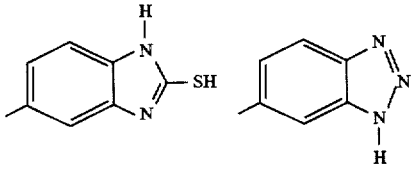

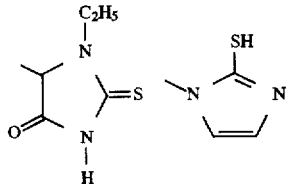

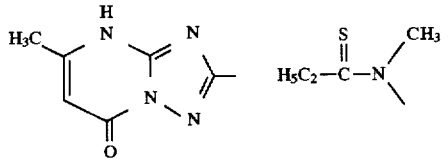

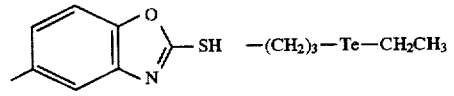

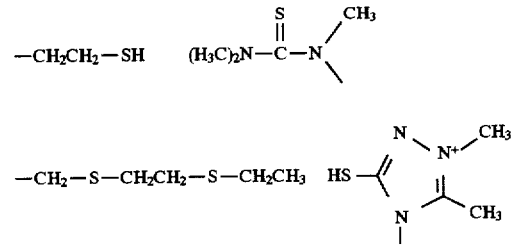

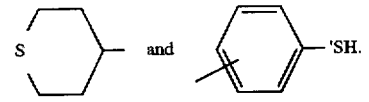

The point of attachment of the linking group L to the silver halide adsorptive group will vary depending on the structure of the adsorptive group, and may be at one (or more) of the heteroatoms, at one (or more) of the aromatic or heterocyclic rings.

The linkage group represented by L which connects the silver halide absorptive group to the fragmentable electron donator moiety XY by a covalent bond is preferably an organic linking group containing a least one C, N, S, or O atom. It is also desired that the linking group not be completely aromatic or unsaturated, so that a pi-conjugation system cannot exist between the A and XY moieties. Preferred examples of the linkage group include, an alkylene group, an arylene group, —O—, —S—, —C=O, $-SO_2-$, —NH—, —P=O, and —N=. Each of these linking components can be optionally substituted and can be used alone or in combination. Examples of preferred combinations of these groups are:

$$-\overset{O}{\overset{\|}{C}}-(CH_2)_c-,\ -\overset{O}{\overset{\|}{C}}-NH-,\ -SO_2NH-,\ -\overset{O}{\overset{\|}{C}}NH$$

-continued $$-NHSO_2NH-,\ -NH\overset{O}{\overset{\|}{C}}NH-,\ -(CH_2)_cC\overset{O}{\overset{\|}{N}}H-,\ -\overset{O}{\overset{\|}{C}}-O-$$

$$+arylene+NH\overset{O}{\overset{\|}{C}}NH-,\ +arylene+C\overset{O}{\overset{\|}{N}}H-,\ -(OCH_2CH_2)_d$$

where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

$$-(CH_2)_e-\overset{CH_3}{\overset{|}{N}}-(CH_2)_f-\qquad -(CH_2)_e-SO_2-NH-(CH_2)_f-$$

$$-(CH_2)_e-O-(CH_2)_f-\qquad -(CH_2)_e-CO-NH-(CH_2)_f-$$

$$-(CH_2)_e-\overset{O}{\overset{\|}{C}}-O-(CH_2)_f-\qquad -(CH_2)_e-$$

e and f=1–30, with the proviso that e+f≦30.

XY is a fragmentable electron donor moiety, wherein X is an electron donor group and Y is a leaving group. The preparation of compounds of the formula X-Y is disclosed in co-pending application Ser. No. filed concurrently herewith, the entire disclosure of which is incorporated herein by reference. The following represents the reactions believed to take place when the XY moiety undergoes oxidation and fragmentation to produce a radical $X^{\bullet}$, which in a preferred embodiment undergoes further oxidation.

$$X-Y \xrightarrow{-e^-} \overset{\bullet+}{X}-Y \xrightarrow{\text{cleavage}} \overset{X^{\bullet}}{(+Y^+)} \xrightarrow{-e^-} X^+$$

The structural features of the moiety XY are defined by the characteristics of the two parts, namely the fragment X and the fragment Y. The structural features of the fragment X determine the oxidation potential of the XY moiety ($E_1$) and that of the radical $X^{\bullet}$ ($E_2$), whereas both the X and Y fragments affect the fragmentation rate of the oxidized moiety $XY^{\bullet+}$.

Preferred X groups are of the general formula:

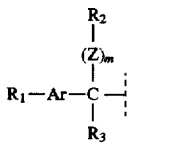

(I)

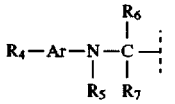

(II)

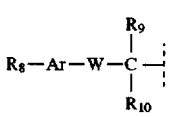

(III)

or

-continued

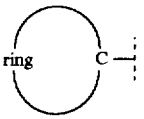

(IV)

The symbol "R" (that is R without a subscript) is used in all structural formulae in this patent application to represent a hydrogen atom or an unsubstituted or substituted alkyl group.

In structure (I):

m: 0, 1;

Z: O, S, Se, Te;

Ar: aryl group (e.g., phenyl, naphthyl, phenanthryl, anthryl); or heterocyclic group (e.g., pyridine, indole, benzimidazole, thiazole, benzothiazole, thiadiazole, etc.);

$R_1$: R, carboxyl, amide, sulfonamide, halogen, $NR_2$, $(OH)_n$, $(OR')_n$ or $(SR)_n$;

R': alkyl or substituted alkyl;

n: 1–3;

$R_2$: R, Ar';

$R_3$: R, Ar';

$R_2$ and $R_3$ together can form 5- to 8-membered ring;

$R_2$ and Ar: can be linked to form 5- to 8-membered ring;

$R_3$ and Ar: can be linked to form 5- to 8-membered ring;

Ar': aryl group such as phenyl, substituted phenyl, or heterocyclic group (e.g., pyridine, benzothiazole, etc.)

R: a hydrogen atom or an unsubstituted or substituted alkyl group.

In structure (II):

Ar: aryl group (e.g., phenyl, naphthyl, phenanthryl); or heterocyclic group (e.g., pyridine, benzothiazole, etc.);

$R_4$: a substituent having a Hammett sigma value of −1 to +1, preferably −0.7 to +0.7, e.g., R, OR, SR, halogen, CHO, C(O)R, COOR, $CONR_2$; $SO_3R$, $SO_2NR_2$, $SO_2R$, SOR, C(S)R, etc;

$R_5$: R, Ar'

$R_6$ and $R_7$: R, Ar'

$R_5$ and Ar: can be linked to form 5- to 8-membered ring;

$R_6$ and Ar: can be linked to form 5- to 8-membered ring (in which case, $R_6$ can be a hetero atom);

$R_5$ and $R_6$: can be linked to form 5- to 8-membered ring;

$R_6$ and $R_7$: can be linked to form 5- to 8-membered ring;

Ar': aryl group such as phenyl, substituted phenyl, or heterocyclic group;

R: hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar: aryl group (e.g., phenyl, naphthyl, phenanthryl, anthryl); or heterocyclic group (e.g., indole, benzimidazole, etc.)

$R_8$: R, carboxyl, $NR_2$, $(OR)_n$, or $(SR)_n$ (n=1–3);

$R_9$ and $R_{10}$: R, Ar';

$R_9$ and Ar: can be linked to form 5- to 8-membered ring;

Ar': aryl group such as phenyl, substituted phenyl, or-heterocyclic group;

R: a hydrogen atom or an unsubstituted or substituted alkyl group.

In structure (IV):

"ing" represents a substituted or unsubstituted 5-, 6- or 7-membered unsaturated ring, preferrably a heterocyclic ring.

Since X is an electron donor group, (i.e., an electron rich organic group), the substituents on the aromatic groups (Ar and/or Ar'), for any particular X group should be selected so that X remains electron rich. For example, if the aromatic group is highly electron rich, e.g. anthracene, electron withdrawing substituents can be used, providing the resulting XY moiety has an oxidation potential of 0 to about 1.4 V. Conversely, if the aromatic group is not electron rich, electron donating substituents should be selected.

When reference in this application is made to a substituent "group" this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 12 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 12 carbon atoms; substituted and unsubstituted aryl, particularly those having from 6 to 20 carbon atoms (for example, phenyl); and substituted or unsubstituted heteroaryl, particularly those having a 5- or 6-membered ring containing 1 to 3 heteroatoms selected from N, O, or S (for example, pyridyl, thienyl, furyl, pyrrolyl); and others known in the art. Alkyl substituents preferably contain 1 to 12 carbon atoms and specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

The linking group L is usually attached to the X group of the XY moiety, although in certain circumstances, may be attached to the Y group (see below). The L group may be attached to X at any of the substituents $R_1$–$R_{10}$, or to the aryl group of X in structures (I)–(III), or to the ring in structure (IV). Illustrative examples of preferred X groups are given below. For simplicity and because of the multiple possible sites, the attachment of the L group is not specifically indicated in the structures. Specific structures for linked A-(L-XY)$_k$ and (A-L)$_k$ —XY compounds are provided hereinafter. Preferred X groups of general structure I are:

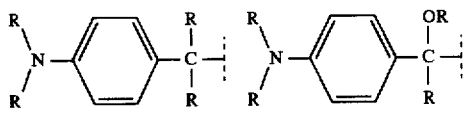

-continued

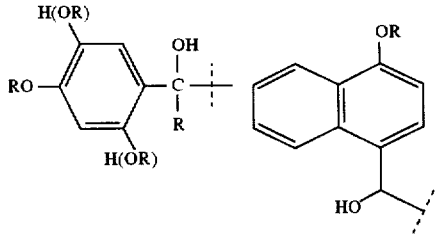

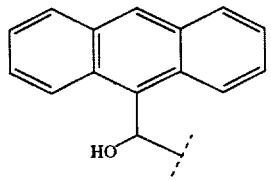

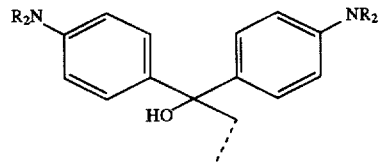

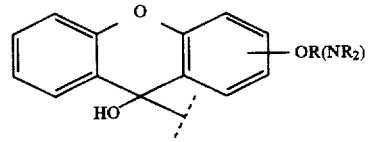

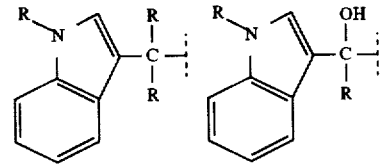

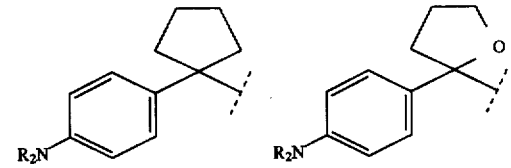

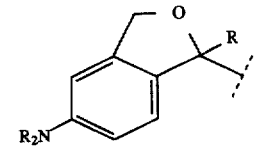

In the structures of this patent application a designation such as —OR(NR$_2$) indicates that either —OR or —NR$_2$ can be present.

The following are illustrative examples of the group X of general structure II:

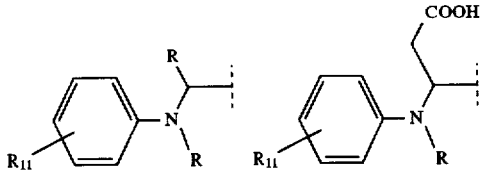

-continued

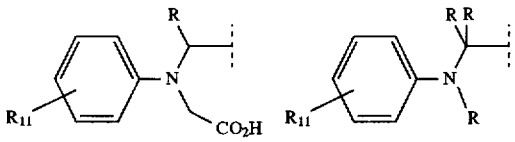

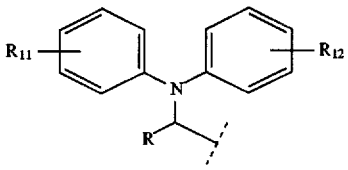

$R_{11}$ and $R_{12}$ =

| | |
|---|---|
| H | carboxyl |
| alkyl | amido |
| alkoxy | formyl |
| alkylthio | sulfonyl |
| halo | sulfonamido |
| carbamoyl | nitrile |

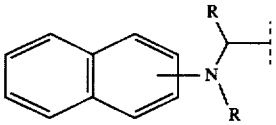

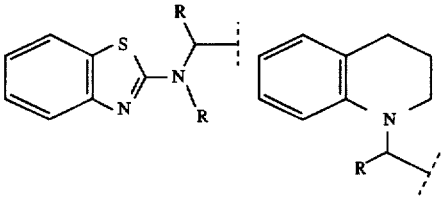

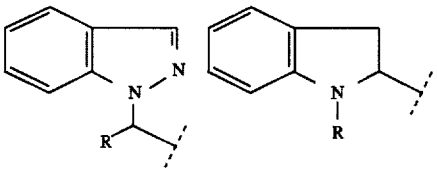

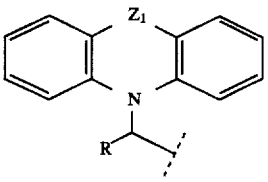

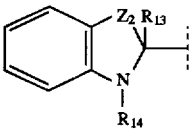

$Z_2$=S, O, Se, NR, $CR_2$, CR=CR, $R_{13}$=alkyl, substituted alkyl or aryl, and $R_{14}$=H, alkyl, substituted alkyl or aryl.

The following are illustrative examples of the group X of the general structure III:

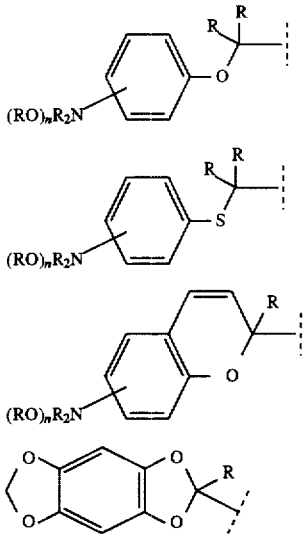

n=1–3.

The following are illustrative examples of the group X of the general structure IV:

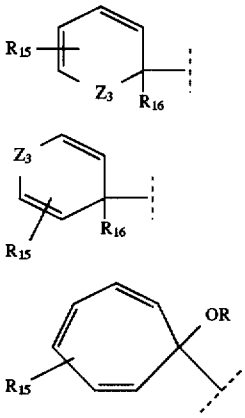

$Z_3$=O, S, Se, NR $R_{15}$=R, OR, $NR_2$ $R_{16}$=alkyl, substituted alkyl

Preferred Y groups are:

(1) X', where X' is an X group as defined in structures I–IV and may be the same as or different from the X group to which it is attached $$\text{—}COO^- \tag{2}$$

$$\text{—}M(R')_3 \tag{3}$$

where M=Si, Sn or Ge; and R'=alkyl or substituted alkyl $$\text{—}\bar{B}(Ar'')_3 \tag{4}$$

where Ar"=aryl or substituted aryl the linking group L may be attached to the Y group in the case of (3) and (4). For simplicity, the attachment of the L group is not specifically indicated in the generic formulae.

In preferred embodiments of this invention Y is —$COO^-$ or —$Si(R')_3$ or —X'. Particularly preferred Y groups are —$COO^-$ or —$Si(R')_3$.

Preferred XY moieties are derived from X-Y compounds of the formulae given below (for simplicity, and because of the multiple possible sites, the attachment of the L group is not specified):

| Cpd. No. | $R_{17}$ | $R_{18}$ | $R_{19}$ |
|---|---|---|---|
| | 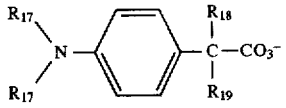 | | |
| 1 | $CH_3$ | H | H |
| 2 | $C_2H_5$ | OH | H |
| 3 | $CH_3$ | OH | H |
| 4 | $C_2H_5$ | OH | $CH_3$ |
| 5 | $CH_3$ | OH | $CH_3$ |
| 6 | $C_2H_5$ | $OCH_3$ | $CH_3$ |
| 7 | $CH_3$ | $OCH_3$ | $CH_3$ |
| 8 | $C_2H_5$ | $OCH_3$ | H |

| Cpd. No. | $R_{20}$ | $R_{21}$ | $R_{22}$ | $R_{23}$ |
|---|---|---|---|---|
| | 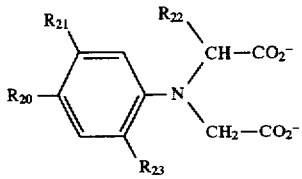 | | | |
| 9 | $OCH_2CO_2^-$ | H | H | H |
| 10 | $OCH_3$ | H | H | H |
| 11 | $CH_3$ | H | H | H |
| 12 | Cl | H | H | H |
| 13 | H | H | H | H |
| 14 | H | H | $CH_3$ | H |
| 15 | $OCH_3$ | H | $CH_3$ | H |
| 16 | $CH(CH_3)C_2H_5$ | H | $CH_3$ | H |
| 17 | CHO | H | $CH_3$ | H |
| 18 | $SO_3^-$ | H | $CH_3$ | H |
| 19 | $SO_2N(C_2H_5)_2$ | H | $CH_3$ | H |
| 20 | $CH_3$ | H | $CH_3$ | H |
| 21 | $OCH_3$ | $OCH_3$ | H | H |
| 22 | H | H | H | $OCH_2CO_2^-$ |

| Cpd. No. | $R_{20}$ | $R_{22}$ | $R_{24}$ | $R_{21}$ |
|---|---|---|---|---|
| | 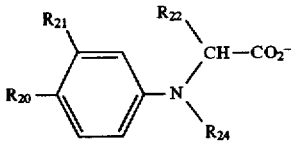 | | | |
| 23 | $OCH_3$ | $CH_3$ | H | H |
| 24 | H | $CH_3$ | H | H |
| 25 | $CO_2^-$ | $CH_3$ | H | H |
| 26 | Cl | $CH_3$ | H | H |
| 27 | $CONH_2$ | $CH_3$ | H | H |
| 28 | $CO_2C_2H_5$ | $CH_3$ | H | H |
| 29 | $CH_3$ | $CH_2CO_2^-$ | H | H |
| 30 | H | $CH_2CO_2^-$ | H | H |
| 31 | $CO_2^-$ | $CH_2CO_2^-$ | H | H |
| 32 | H | $CH_3$ | H | $CONH_2$ |
| 33 | $CO_2^-$ | $CH_3$ | $CH_3$ | H |
| 34 | H | $CH_3$ | $C_2H_5$ | $CONH_2$ |
| 35 | $CH_3$ | $CH_3$ | $(CH_2)_3CH_3$ | H |
| 36 | $OCH_3$ | $CH_3$ | $(CH_2)_3CH_3$ | H |
| 37 | H | $CH_3$ | $(CH_2)_3CH_3$ | H |
| 38 | $CO_2^-$ | $CH_3$ | $(CH_2)_3CH_3$ | H |
| 39 | Cl | $CH_3$ | $(CH_2)_3CH_3$ | H |
| 40 | $CH_3$ | $CH_2CO_2^-$ | $(CH_2)_3CH_3$ | H |
| 41 | H | $CH_2CO_2^-$ | $(CH_2)_3CH_3$ | H |

-continued

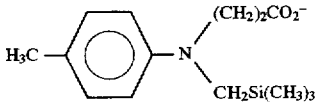

Cpd. 42

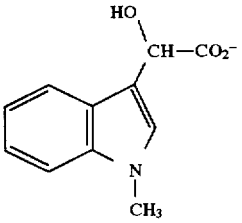

Cpd. 43

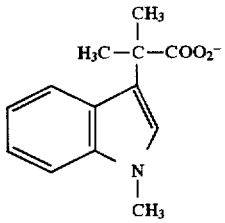

Cpd. 44

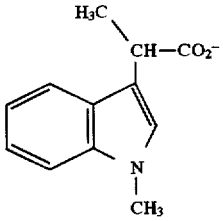

Cpd. 45

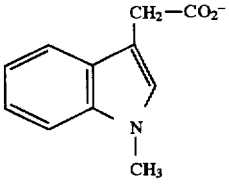

Cpd. 46

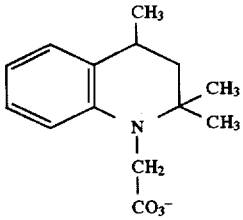

Cpd. 47

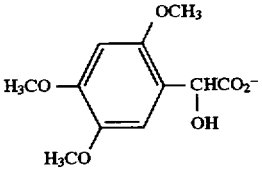

-continued

Cpd. 48

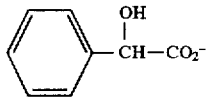

Cpd. 49

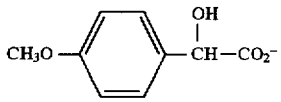

Cpd. 50

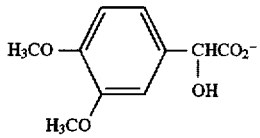

Cpd. 51

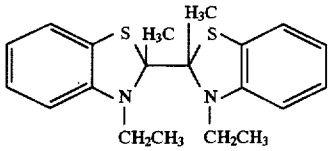

Cpd. 52

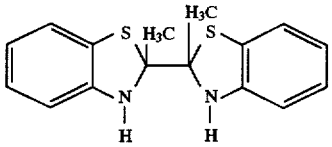

Cpd. 53

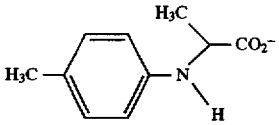

Cpd. 54

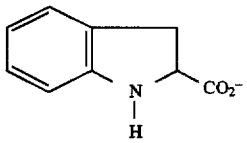

Cpd. 55

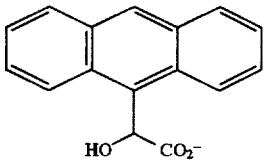

Cpd. 56

-continued

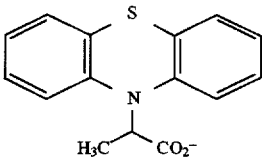

Cpd. 57

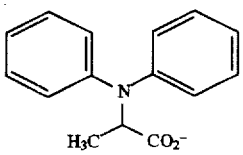

Cpd. 58

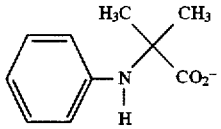

Cpd. 59

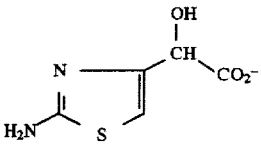

Cpd. 60

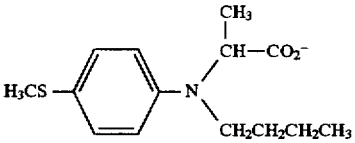

Cpd. 61

In the above formulae, counterior(s) required to balance the charge of the XY moiety are not shown as any counterion can be utilized. Common counterions are sodium, potassium, triethylammonium ($TEA^+$), tetramethylguanidinium ($TMG^+$), diisopropylammonium ($DIPA^+$), and tetrabutylammonium ($TBA^+$).

Fragmentable electron donor moieties XY are derived from electron donors X-Y which can be fragmentable one electron donors which meet the first two criteria set forth below or fragmentable two electron donors which meet all three criteria set forth below. The first criterion relates to the oxidation potential of X-Y ($E_1$). $E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably of from about 0.3 V to about 1.0 V.

Oxidation potentials are well known and can be found, for example, in "Encyclopedia of Electrochemistry of the Elements", Organic Section, Volumes XI–XV, A. Bard and H. Lund (Editors) Marcel Dekker Inc., NY. (1984). $E_1$ can be measured by the technique of cyclic voltammetry. In this technique, the electron donating compound is dissolved in a solution of 80%/20% by volume acetonitrile to water containing 0.1M lithium perchlorate. Oxygen is removed from the solution by passing nitrogen gas through the solution for 10 minutes prior to measurement. A glassy carbon disk is used for the working electrode, a platinum wire is used for the counter electrode, and a saturated calomel electrode (SCE) is used for the reference electrode. Measurement is conducted at 25° C. using a potential sweep rate of 0.1 V/sec. The oxidation potential vs. SCE is taken as the peak potential of the cyclic voltammetric wave. $E_1$ values for typical X-Y compounds useful in preparing the compounds of this invention are given in Table A.

TABLE A

Oxidation Potential of X—Y

| Compound | $E_1$ (V vs SCE) | Compound | $E_1$ (V vs SCE) |
|---|---|---|---|
| 1 | 0.53 | 30 | 0.60 |
| 2 | 0.50 | 26 | 0.51 |
| 5 | 0.51 | 27 | 0.62 |
| 4 | 0.49 | 38 | 0.48 |
| 7 | 0.52 | 39 | 0.40 |
| 6 | 0.51 | 41 | 0.48 |
| 8 | 0.49 | 34 | 0.52 |
| 48 | 0.70 | 28 | 0.61 |
| 51 | 0.91 | 17 | 0.74 |
| 49 | ~1.2 | 18 | 0.70 |
| 50 | ~1.05 | 19 | 0.68 |
| 43 | 0.61 | 31 | 0.61 |
| 44 | 0.64 | 22 | 0.65 |
| 45 | 0.64 | 59 | 0.53 |
| 46 | 0.68 | 56 | 0.65 |
| 42 | 0.30 | 57 | 0.49 |
| 9 | 0.38 | 58 | 0.49 |
| 10 | 0.38 | 52 | 0.07 |
| 11 | 0.46 | 54 | 0.44 |
| 23 | 0.37 | | |
| 20 | 0.46 | | |
| 14 | 0.50 | | |
| 15 | 0.36 | | |
| 16 | 0.47 | | |
| 36 | 0.22 | | |
| 29 | 0.52 | | |
| 40 | 0.38 | | |
| 35 | 0.34 | | |
| 25 | 0.62 | | |
| 33 | 0.54 | | |
| 13 | 0.54 | | |
| 12 | 0.58 | | |
| 21 | 0.36 | | |
| 24 | 0.52 | | |
| 37 | 0.43 | | |
| 32 | 0.58 | | |
| 60 | 0.80 | | |

The second criterion defining the fragmentable XY groups is the requirement that the oxidized form of X-Y, that is the radical cation $X\text{-}Y^{+\bullet}$, undergoes a bond cleavage reaction to give the radical $X^{\bullet}$ and the fragment $Y^{+}$ (or in the case of an anionic compound the radical $X^{\bullet}$ and the fragment Y). This bond cleavage reaction is also referred to herein as "fragmentation". It is widely known that radical species, and in particular radical cations, formed by a one-electron oxidation reaction may undergo a multitude of reactions, some of which are dependent upon their concentration and on the specific environment wherein they are produced. As described in "Kinetics and Mechanisms of Reactions of Organic Cation Radicals in Solution", Advances in Physical Organic Chemistry, vol 20, 1984, pp 55–180, and "Formation, Properties and Reactions of Cation Radicals in Solution", Advances in Physical Organic Chemistry, vol 13, 1976, pp 156–264, V. Gold Editor, 1984, published by Academic Press, NY., the range of reactions available to such radical species includes: dimerization, deprotonation, hydrolysis, nucleophilic substitution, disproportionation, and bond cleavage. With compounds useful in accordance with our invention, the radical formed on oxidation of X-Y undergoes a bond cleavage reaction.

The kinetics of the bond cleavage or fragmentation reaction can be measured by conventional laser flash photolysis. The general technique of laser flash photolysis as a method to study properties of transient species is well known (see, for example, "Absorption Spectroscopy of Transient Species" . Herkstroeter and I. R. Gould in Physical Methods of Chemistry Series, second Edition, Volume 8, page 225, edited by B. Rossiter and R. Baetzold, John Wiley & Sons, New York, 1993). The specific experimental apparatus we used to measure fragmentation rate constants and radical oxidation potentials is described in detail below. The rate constant of fragmentation in compounds useful in accordance with this invention is preferably faster than about 0.1 per second (i.e., 0.1 $s^{-1}$ or faster, or, in other words, the lifetime of the radical cation $X\text{-}Y^{+\bullet}$ should be 10 sec or less). The fragmentation rate constants can be considerably higher than this, namely in the $10^2$ to $10^{13}$ $s^{-1}$ range. The fragmentation rate constant is preferably about 0.1 $sec^{-1}$ to about $10^{13}$ $s^{-1}$, more preferably about $10^2$ to about $10^9$ $s^{-1}$. Fragmentation rate constants $k_{fr}$ ($s^{-1}$) for typical compounds useful in accordance with our invention are given in Table B.

TABLE B

Rate Constants for Decarboxylation of Radical Cations in $CH_3CN/H_2O$ (4:1)

| COMP'D | $R_{26}$ | $R_{27}$ | $R_{28}$ | $R_{29}$ | $k_{fr}(s^{-1})$ |
|---|---|---|---|---|---|
| 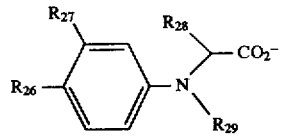 | | | | | |
| 14 | H | H | Me | $CH_2CO_2^-$ | $>2.0 \times 10^7$ |
| 13 | H | H | H | $CH_2CO_2^-$ | $1.7 \times 10^7$ |
| 20 | Me | H | Me | $CH_2CO_2^-$ | $8.1 \times 10^6$ |
| 11 | Me | H | H | $CH_2CO_2^-$ | $1.6 \times 10^6$ |
| 15 | OMe | H | Me | $CH_2CO_2^-$ | $9.0 \times 10^4$ |
| 10 | OMe | H | H | $CH_2CO_2^-$ | $9.3 \times 10^3$ |
| 21 | OMe | OMe | H | $CH_2CO_2^-$ | $1 \times 10^3$ |
| 36 | OMe | H | Me | n-Bu | $1.1 \times 10^6$ |
| 40 | Me | H | $CH_2CO_2^-$ | n-Bu | $1.3 \times 10^7$ |
| 29 | Me | H | $CH_2CO_2^-$ | H | $5.4 \times 10^6$ |
| 54 | Me | H | Me | H | $1.4 \times 10^7$ |

| COMPOUND | $R_{30}$ | $R_{31}$ | $k_{fr}(s^{-1})$ |
|---|---|---|---|
| 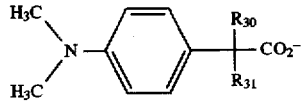 | | | |
| 3 | OH | Me | $5.5 \times 10^5$ |
| 1 | H | H | $\sim 3.0 \times 10^5$ |

| COMPOUND | $k_{fr}(s^{-1})$ |
|---|---|
| 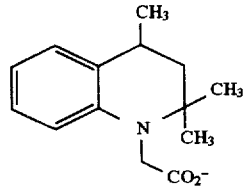 | |
| 47 | $>10^7$ |

TABLE B-continued

Rate Constants for Decarboxylation of Radical Cations in $CH_3CN/H_2O$ (4:1)

| COMPOUND | $R_{32}$ | $k_{fr}(s^{-1})$ |
|---|---|---|
| 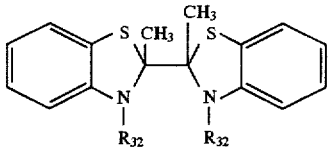 | | |
| 52 | H | >$10^9$ |
| 53 | Et | >$10^9$ |

| COMPOUND | $k_{fr}(s^{-1})$ |
|---|---|
| 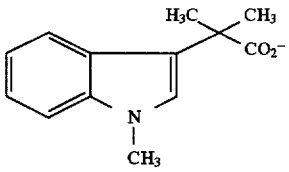 | |
| 44 | $5.3 \times 10^5$ |
| 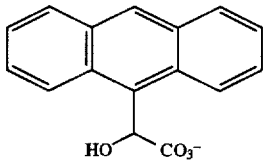 | |
| 56 | $1.2 \times 10^5$ |
| 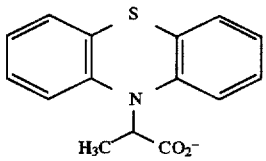 | |
| 57 | ca. $1 \times 10^5$ |

In a preferred embodiment of the invention, the XY moiety is a fragmentable two-electron donor moiety and meets a third criterion, that the radical $X^{\bullet}$ resulting from the bond cleavage reaction has an oxidation potential equal to or more negative than −0.7 V, preferably more negative than about −0.9 V. This oxidation potential is preferably in the range of from about −0.7 to about −2 V, more preferably from about −0.8 to about −2 V and most preferably from about −0.9 to about −1.6 V.

The oxidation potential of many radicals have been measured by transient electrochemical and pulse radiolysis techniques as reported by Wayner, D. D.; McPhee, D. J.; Griller, D. in *J. Am. Chem. Soc.* 1988, 110, 132; Rao, P. S.; Hayon, E. *J. Am. Chem. Soc.* 1974, 96, 1287 and Rao, P. S.; Hayon, E. *J. Am. Chem. Soc.* 1974, 96, 1295. The data demonstrate that the oxidation potentials of tertiary radicals are less positive (i.e., the radicals are stronger reducing agents) than those of the corresponding secondary radicals, which in turn are more negative than those of the corresponding primary radicals. For example, the oxidation potential of benzyl radical decreases from 0.73V to 0.37V to 0.16V upon replacement of one or both hydrogen atoms by methyl groups.

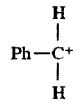

$E^{ox}(V) + 0.73$

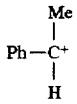

+0.37

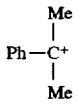

+0.16

A considerable decrease in the oxidation potential of the radicals is achieved by α hydroxy or alkoxy substituents. For example the oxidation potential of the benzyl radical (+0.73V) decreases to −0.44 when one of the a hydrogen atoms is replaced by a methoxy group.

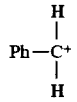

$E^{ox}(V) + 0.73$

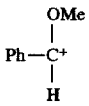

−0.44

An α-amino substituent decreases the oxidation potential of the radical to values of about −1 V.

In accordance with our invention we have discovered that compounds which provide a radical $X^{\bullet}$ having an oxidation potential more negative than −0.7 are particularly advantageous for use in sensitizing silver halide emulsions. As set forth in the above-noted articles, the substitution at the α carbon atom influences the oxidation potential of the radical. We have found that substitution of the phenyl moiety with at least one-electron donating substituent or replacement of the phenyl with an electron donating aryl or heterocyclic group also influences the oxidation potential of $X^{\bullet}$. Illustrative examples of $X^{\bullet}$ having an oxidation potential more negative than −0.7 are given below in Table C. The oxidation potential of the transient species $X^{\bullet}$, can be determined using a laser flash photolysis technique as described in greater detail below.

In this technique, the compound X-Y is oxidized by an electron transfer reaction initiated by a short laser pulse. The oxidized form of X-Y then undergoes the bond cleavage reaction to give the radical $X^{\bullet}$. $X^{\bullet}$ is then allowed to interact with various electron acceptor compounds of known reduction potential. The ability of $X^{\bullet}$ to reduce a given electron acceptor compound indicates that the oxidation potential of $X^{\bullet}$ is nearly equal to or more negative than the reduction potential of that electron acceptor compound. The experimental details are set forth more fully below. The oxidation potentials ($E_2$) for radicals $X^{\bullet}$ for typical compounds useful in accordance with our invention are given in Table C.

Where only limits on potentials could be determined, the following notation is used: <–0.90 V should be read as "more negative than –0.90 V" and >–0.40 V should be read as "less negative than –0.40 V".

Illustrative $X^{\bullet}$ radicals useful in accordance with the third criterion of our invention are those given below having an oxidation potential $E_2$ more negative than –0.7 V. Some comparative examples with $E_2$ less negative than –0.7 V are also included.

TABLE C

Oxidation Potentials of Radicals (X*), $E_2$

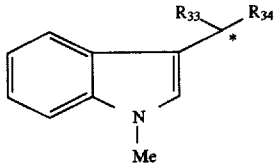

| Parent X–Y compound | $R_{33}$ | $R_{34}$ | $E_2$ |
|---|---|---|---|
| 46 | H | H | –0.34 |
| 45 | Me | H | –0.56 |
| 44 | Me | Me | –0.81 |
| 43 | OH | H | –0.89 |

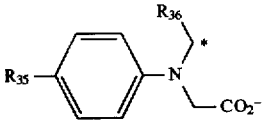

| Parent X–Y compound | $R_{35}$ | $R_{36}$ | $E_2$ |
|---|---|---|---|
| 13 | H | H | –0.85 |
| 14 | H | Me | <–0.9 |
| 11 | Me | H | –0.9 |
| 16 | i-Bu | H | –0.9 |
| 20 | Me | Me | <–0.9 |
| 10 | OMe | H | <–0.9 |
| 15 | OMe | Me | <–0.9 |

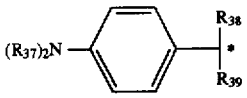

| Parent X–Y compound | $R_{37}$ | $R_{38}$ | $R_{39}$ | $E_2$ |
|---|---|---|---|---|
| 8 | Et | H | OMe | –0.85 |
| 2 | Et | H | OH | <–0.9 |
| 7 | Me | Me | OMe | <–0.9 |
| 5 | Me | Me | OH | <–0.9 |
| 1 | Me | H | H | >–0.5 |

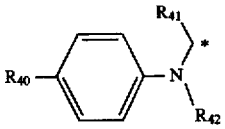

| Parent X–Y compound | $R_{40}$ | $R_{41}$ | $R_{42}$ | $E_2$ |
|---|---|---|---|---|
| 36 | OMe | Me | n-Bu | <–0.9 |
| 33 | $CO_2^-$ | Me | Me | <–0.9 |

TABLE C-continued

Oxidation Potentials of Radicals (X*), $E_2$

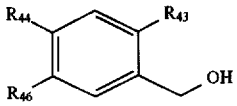

| Parent X–Y compound | $R_{44}$ | $R_{43}$ | $R_{46}$ | $E_2$ |
|---|---|---|---|---|
| 48 | OMe | OMe | OMe | <–0.9 |
| 51 | OMe | H | OMe | <–0.9 |
| 49 | H | H | H | –0.75 |
| 50 | OMe | H | H | <–0.9 |

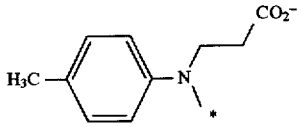

| Parent X–Y compound | $E_2$ |
|---|---|
| 42 | –0.9 |

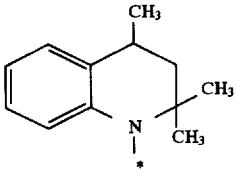

| Parent X–Y compound | $E_2$ |
|---|---|
| 47 | –0.9 |

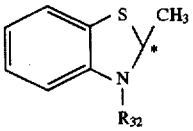

| Parent X–Y compound | $R_{32}$ | $E_2$ |
|---|---|---|
| 52 | H | <–0.9 |
| 53 | Et | <–0.9 |

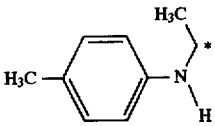

| Parent X–Y compound | $E_2$ |
|---|---|
| 54 | <–0.9 |

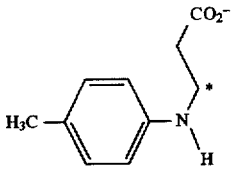

TABLE C-continued

| Oxidation Potentials of Radicals (X*), $E_2$ | |
|---|---|
| Parent X—Y compound | $E_2$ |
| 29 | <-0.9 |

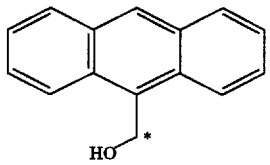

| Parent X—Y compound | $E_2$ |
|---|---|
| 56 | <-0.9 |

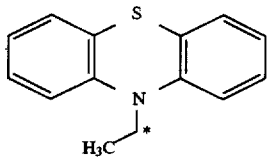

| Parent X—Y compound | $E_2$ |
|---|---|
| 57 | <-0.9 |

Preferred A-(L-XY)$_k$ and (A-L)$_k$ —XY compounds are given in Tables D, E and F below. One class of preferred compounds has the general formula

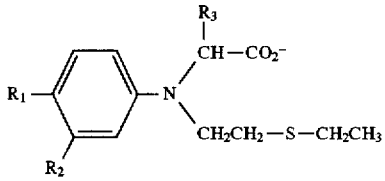

where $R_1$ and $R_2$ are each independently H, alkyl, alkoxy, alkylthio, halo, carbamoyl, carboxyl, amide, formyl, sulfonyl, sulfonamide or nitrile; $R_3$ is H, alkyl or $CH_2CO_2^-$.

Illustrative A-(L-XY)$_k$ and (A-L)$_k$ —XY compounds:

A—(L—XY)$_k$
or
(A—L)$_k$—XY are listed below, but the present invention should not be construed as being limited thereto.

TABLE D

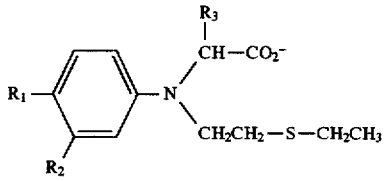

| Compound | $R_1$ | $R_2$ | $R_3$ |
|---|---|---|---|
| S-1 | $OCH_3$ | H | $CH_3$ |
| S-3 | $CH_3$ | H | $CH_3$ |
| S-5 | $OCH_3$ | H | H |
| S-6 | $CH_3$ | H | H |
| S-8 | $CH_3$ | H | $CH_2CO_2^-$ |
| S-9 | H | H | $CH_3$ |
| S-11 | $CO_2^-$ | H | $CH_3$ |
| S-12 | Cl | H | $CH_3$ |
| S-13 | H | $CONH_2$ | $CH_3$ |
| S-14 | H | H | $CH_2CO_2^-$ |
| S-15 | $CO_2C_2H_5$ | H | $CH_3$ |

TABLE E

| Compound | Structure |
|---|---|
| PMT-1 | 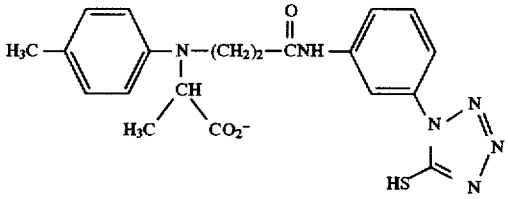 |
| PMT-2 | 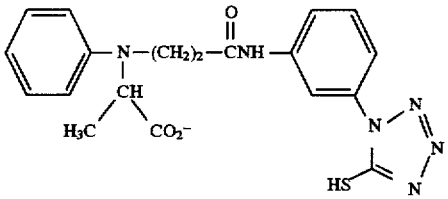 |

TABLE E-continued
| Compound | Structure |
|---|---|
| PMT-3 | 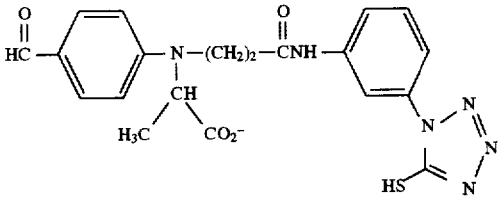 |
| PMT-4 | 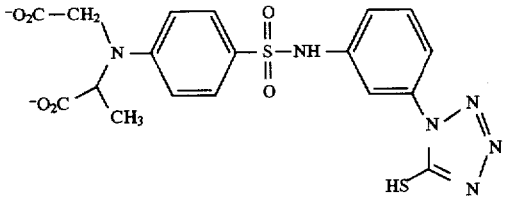 |
| TU-2 | 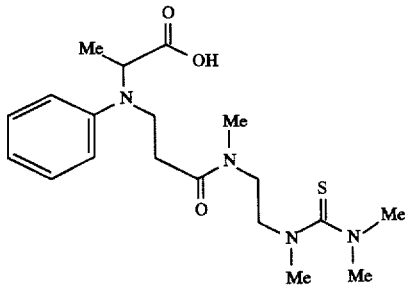 |
| TU-3 | 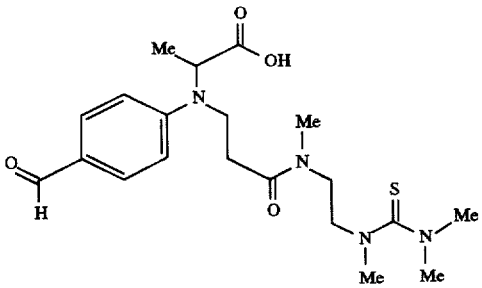 |
| TU-4 | 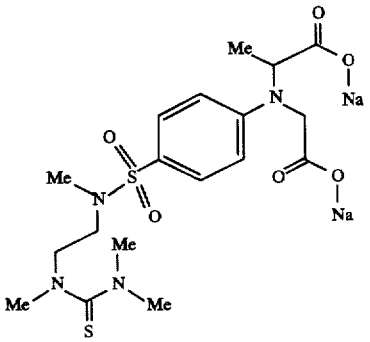 |
| S-16 | 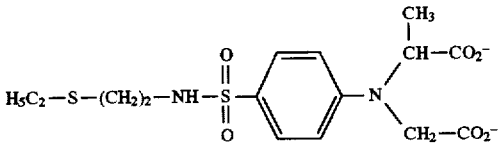 |

TABLE E-continued
| Compound | Structure |
|---|---|
| S-19 | 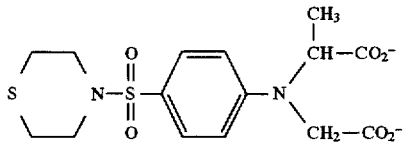 |
TABLE F
| | |
|---|---|
| S-17 | 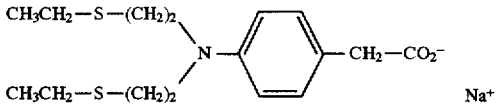 |
| S-18 | 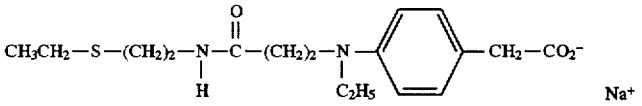 |
| S-20 | 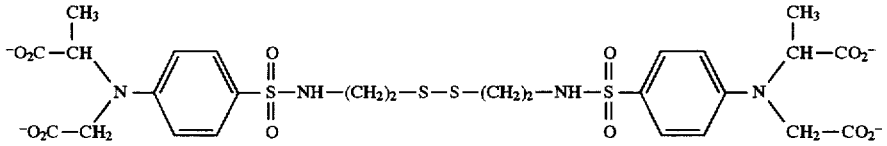 |
| S-21 | 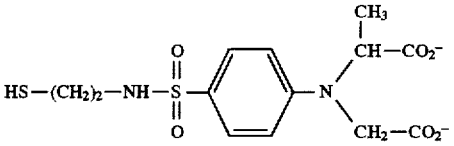 |
| S-22 | 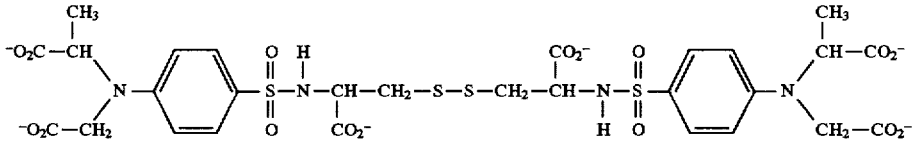 |
| S-23 | 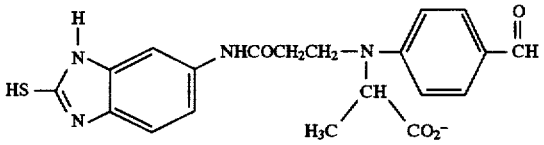 |
| S-24 | 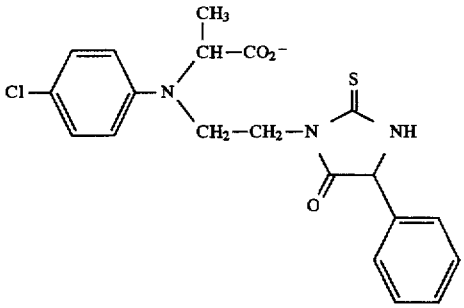 |

TABLE F-continued
S-25
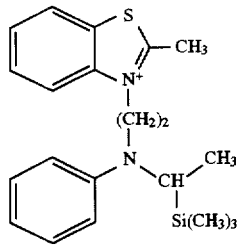
S-26
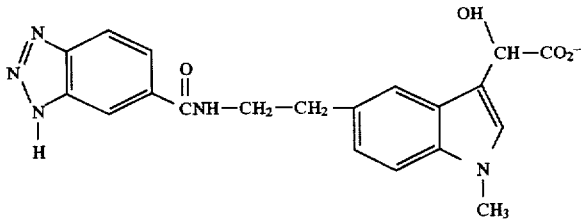
S-27
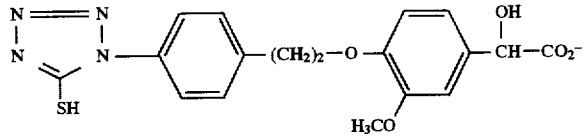
S-28
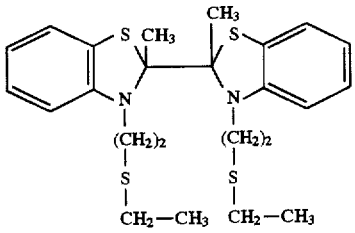
S-29
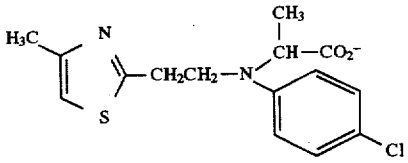
S-30
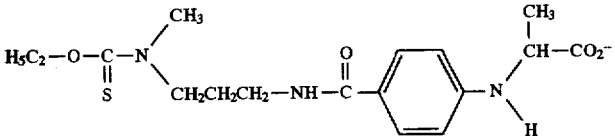
S-31
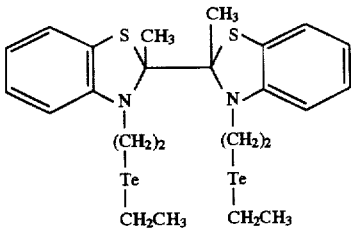
S-32
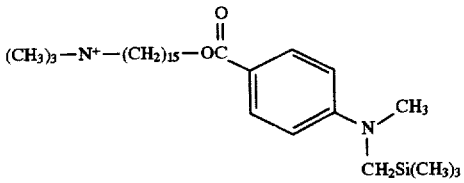

TABLE F-continued

| | |
|---|---|
| S-33 | 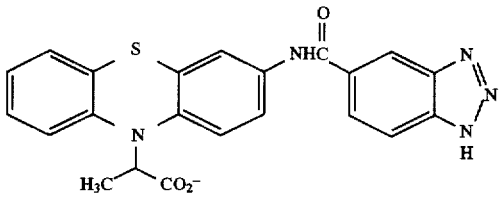 |
| S-34 | 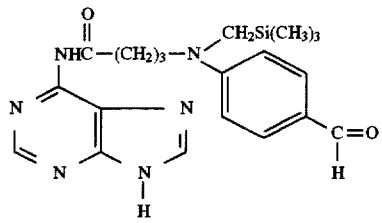 |
| S-35 | 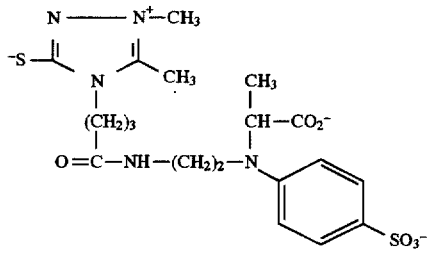 |
| S-36 | 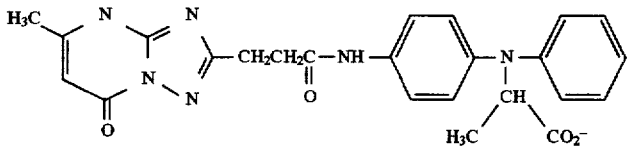 |
| S-37 | 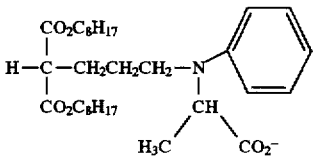 |

TABLE G

"Non-adsorbing" comparative fragmentable electron donor compounds

TABLE G

"Non-adsorbing" comparative fragmentable electron donor compounds

| Compound | |
|---|---|
| Comp-1 | 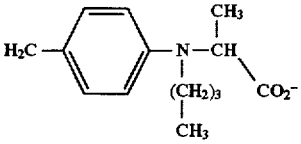 |
| Comp-2 | 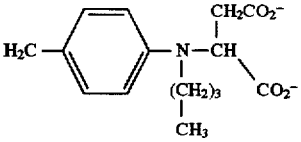 |

TABLE G-continued

"Non-adsorbing" comparative fragmentable electron donor compounds

| Compound | |
|---|---|
| Comp-8 | 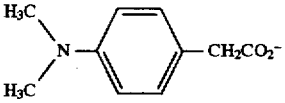 |

In the above formulae, counterion(s) are not shown as any counterion can be utilized. Common counterions that can be used include sodium, potassium, triethylammonium ($TEA^+$), tetramethylguanidinium ($TMG^+$), duisopropylammonium ($DIPA^+$), and tetrabutylammonium ($TBA^+$).

Table H combines electrochemical and laser flash photolysis data for the XY moiety contained in selected fragmentable electron donating sensitizers according to the formula A-L-XY. Specifically, this Table contains data for $E_1$, the oxidation potential of the parent fragmentable electron donating moiety XY; $k_f$, the fragmentation rate of the oxidized XY (including X-Y•+); and $E_2$, the oxidation potential of the radical X•. In Table H, these characteristic properties of the moiety XY are reported for the model compound where the silver halide adsorptive group A and the linking group L have been replaced by an unsubstituted alkyl group. In the actual compounds A-L-XY, these characteristic properties may vary slightly from the values for the model compounds but will not be greatly perturbed. The data in Table H illustrate A-L-XY compounds useful in this invention that are fragmentable two-electron donating sensitizers and meet all the three criteria set forth above as well as fragmentable one-electron donating sensitizers useful in this invention that meet the first two criteria, but produce a radical $X^{\bullet}$ having an oxidation potential $E_2$ less negative than −0.7V.

TABLE H

| Compound | $E_1$(V) for XY moiety | $k_{fr}(s^{-1})$ for XY moiety | $E_2$(V) for XY moiety |
|---|---|---|---|
| S-1 | 0.22 | $1.1 \times 10^6$ | <−0.9 |
| S-3 | 0.34 | $6 \times 10^7$ | <−0.9 |
| S-8 | 0.38 | $1.3 \times 10^7$ | <−0.9 |
| S-12 | 0.40 | $>2 \times 10^7$ | <−0.9 |
| S-9 | 0.43 | $>2 \times 10^7$ | <−0.9 |
| S-14 | 0.48 | $>2 \times 10^7$ | <−0.9 |
| S-13 | 0.52 | $>2 \times 10^7$ | <−0.9 |
| S-11 | 0.54 | $>2 \times 10^7$ | <−0.9 |
| PMT-1 | 0.34 | $>2 \times 10^7$ | <−0.9 |
| PMT-2 | 0.43 | $>2 \times 10^7$ | <−0.9 |
| S-17 | 0.57 | $\approx 3 \times 10^5$ | <−0.5 |
| S-18 | 0.57 | $\approx 3 \times 10^5$ | <−0.5 |

The following Table J sets forth several comparative compounds which are similar in structure to the inventive compounds listed above, but which do not fragment.

ruthenium, or a triarylamine, are well known for forming extremely stable, i.e., non-fragmentable, radical cations as noted in the following references J. Heterocyclic Chem., vol. 12, 1975, pp 397–399, J. Org. Chem., vol 42, 1977, pp 983–988, "The Encyclopedia of Electrochemistry of the Elements", Vol XIII, pp 25–33, A. J. Bard Editor, published by Marcel Dekker Inc., Advances in Physical Organic Chemistry, vol 20, pp 55–180, V. Gold Editor, 1984, published by Academic Press, NY. Also, the electron donating adsorptive compounds of U.S. Pat. No. 4,607,006 donate only one electron per molecule upon oxidation. In a preferred embodiment of the present invention, the fragmentable electron donors are capable of donating two electrons.

These fragmentable electron donors of the present invention also differ from other known photographically active compounds such as R-typing agents, nucleators, and stabilizers. Known R-typing agents, such as Sn complexes, thiourea dioxide, borohydride, ascorbic acid, and amine boranes are very strong reducing agents. These agents typically undergo multi-electron oxidations but have oxidation potentials more negative than 0 V vs SCE. For example the oxidation potential for SnCl2 is reported in CRC Handbook of Chemistry and Physics, 55th edition, CRC Press Inc., Cleveland Ohio 1975, pp D122 to be −0.10 V and that for borohydride is reported in J. Electrochem. Soc., 1992, vol. 139, pp 2212–2217 to be −0.48 V vs SCE. These redox characteristics allow for an uncontrolled reduction of silver halide when added to silver halide emulsions, and thus the obtained sensitivity improvements are very often accompanied by undesirable levels of fog. Conventional nucleator compounds such as hydrazines and hydrazides differ from the fragmentable electron donors described herein in that nucleators are usually added to photographic emulsions in an inactive form. Nucleators are transformed into photographically active compounds only when activated in a strongly basic solution, such as a developer solution, wherein the nucleator compound undergoes a deprotonation or hydrolysis reaction to afford a strong reducing agent. In further contrast to the fragmentable electron donors, the oxidation of traditional R-typing agents and nucleator com-

TABLE J

Non-fragmenting comparative compounds

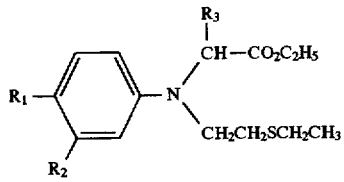

| Compound | $R_1$ | $R_2$ | $R_3$ |
|---|---|---|---|
| Comp-3 | $CH_3$ | H | H |
| Comp-4 | $CH_3$ | H | $CH_3$ |
| Comp-5 | $CH_3O$ | H | $CH_3$ |
| Comp-6 | 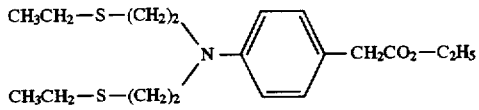 | | |
| Comp-7 | 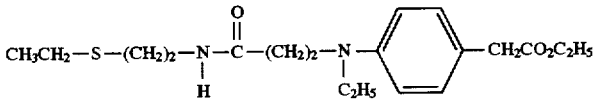 | | |

The fragmentable electron donors useful in this invention are vastly different from the silver halide adsorptive (one)-electron donors described in U.S. Pat. No. 4,607,006. The electron donating moieties described therein, for example phenothiazine, phenoxazine, carbazole, dibenzophenothiazine, ferrocene, tris(2,2'-bipyridyl)

pounds is generally accompanied by a deprotonation reaction or a hydroylsis reaction, as opposed to a bond cleavage reaction.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in Research Disclosure, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140;.U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409, 323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element.

Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-37methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. No. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972, Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The fragmentable electron donating sensitizer compounds of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye.

The amount of fragmentable electron donating compound which is employed in this invention may range from as little as $1\times10^{-8}$ mole to as much as about 0.01 mole per mole of silver in an emulsion layer, preferably from as little as $5\times10^{-7}$ mole to as much as about 0.001 mole per mole of silver in an emulsion layer. Where the oxidation potential $E_1$ for the XY moiety of the two-electron donating sensitizer is a relatively low potential, it is more active, and relatively less agent need be employed. Conversely, where the oxidation potential for the XY moiety of the two-electron donating sensitizer is relatively high, a larger amount thereof, per mole of silver, is employed. For fragmentable one-electron donors relatively larger amounts per mole of silver are also employed.

Conventional spectral sensitizing dyes can be used in combination with the fragmentable electron donating sensitizing agent of the present invention. Preferred sensitizing dyes that can be used are cyanine, merocyanine, styryl, hemicyanine, or complex cyanine dyes.

Illustrative sensitizing dyes that can be used are dyes of the following general structures (VIII) through (XII):

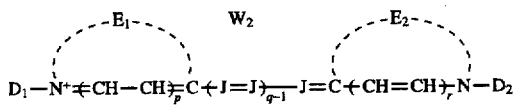

(VIII)

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $d_1$ and $D_2$ each independently represents substituted or unsubstituted alkyl or unsubstituted aryl, and $W_2$ is a counterion as necessary to balance the charge;

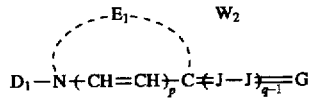

(IX)

wherein $E_1$, $D_1$, J, p, q and $W_2$ are as defined above for formula (VIII) and G represents

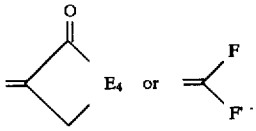

wherein $E_4$ represents the atoms necessary to complete a substituted or unsubstituted heterocyclic nucleus, and F and F' each independently represents a cyano radical, an ester radical, an acyl radical, a carbamoyl radical or an alkylsulfonyl radical;

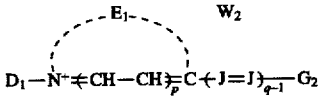

(X)

wherein $D_1$, $E_1$, J, p, q and $W_2$ are as defined above for formula (VIII), and $G_2$ represents a substituted or unsubstituted amino radical or a substituted or unsubstituted aryl radical;

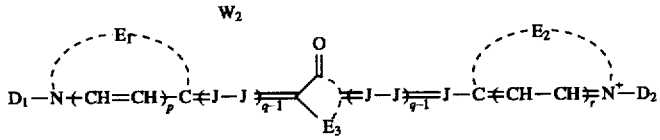

(XI)

wherein $D_1$, $E_1$, $D_2$, $E_1$, J, p, q, r and $W_2$ are as defined for formula (VIII) above, and $E_3$ is defined the same as $E_4$ for formula (IX) above;

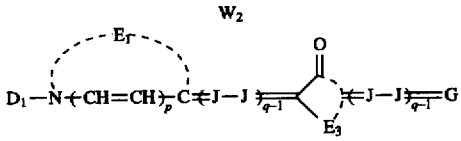

(XII)

wherein $D_1$, $E_1$, J, G, p, q, r and $W_2$ are as defined above for formula (VIII) above and $E_3$ is as defined for formula (XI) above.

In the above formulas, $E_1$ and $E_2$ each independently represents the atoms necessary to complete a substituted or unsubstituted 5- or 6-membered heterocyclic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art.

In one embodiment of the invention, when dyes according to formula (VIII) are used $E_1$ and $E_2$ each independently represent the atoms necessary to complete a substituted or unsubstituted thiazole nucleus, a substituted or unsubstituted selenazole nucleus, a substituted or unsubstituted imidazole nucleus, or a substituted or unsubstituted oxazole nucleus.

Examples of useful nuclei for $E_1$ and $E_2$ include: a thiazole nucleus, e.g., thiazole, 4-methylthiazole, 4-phenylthiazole, 5-methylthiazole, 5-phenylthiazole,-4,5-dimethyl-thiazole, 4,5-diphenylthiazole, 4-(2-thienyl) thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-ethoxy-5-hydroxybenzothiazole, naphtho[2,1-d]thiazole, 5-ethoxynaphtho[2,3-d]thiazole, 8-methoxynaphtho[2,3-d] thiazole, 7-methoxynaphtho[2,3-d]thiazole, 4'-methoxythianaphtheno-7', 6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6-hydroxybenzoxazole,, naphtho[2,1-d]oxazole, naphtho[1, 2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1,2-d] benzotellurazole, 5,6-dimethoxybenzotellurazole, 5-methoxybenzotellurazole, 5-methylbenzotellurazole; a thiazoline nucleus, e.g.,thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5-trimethylindole; or a diazole nucleus, e.g., 5-phenyl-1,3,4-oxadiazole, 5-methyl-1,3,4-thiadiazole.

F and F' are each a cyano radical, an ester radical such as ethoxy carbonyl, methoxycarbonyl, etc., an acyl radical, a carbamoyl radical, or an alkylsulfonyl radical such as ethylsulfonyl, methylsulfonyl, etc. Examples of useful nuclei for $E_4$ include a 2-thio-2,4-oxazolidinedione nucleus (i.e., those of the 2-thio-2,4-(3H,5H)-oxaazolidinone series) (e.g., 3-ethyl-2-thio-2,4 oxazolidinedione, 3-(2-sulfoethyl)-2-thio-2,4 oxazolidinedione, 3-(4-sulfobutyl)-2-thio-2,4 oxazolidinedione, 3-(3-carboxypropyl)-2-thio-2,4 oxazolidinedione, etc.; a thianaphthenone nucleus (e.g., 2-(2H)-thianaphthenone, etc.), a 2-thio-2,5-thiazolidinedione nucleus (i.e., the 2-thio-2,5-(3H,4H)-thiazoledeione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-α-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-(-naphthyl-4-thiazolidinone, etc.); a 2-thiazolin-4-one series (e.g., 2-ethylmercapto-2-thiazolin-4-one, 2-alkylphenyamino-2-thiazolin-4-one, 2-diphenylamino-2-thiazolin-4-one, etc.) a 2-imino-4-oxazolidinone (i.e., pseudohydantoin) series (e.g., 2,4-imidazolidinedione (hydantoin) series (e.g., 2,4-imidazolidinedione, 3-ethyl-2,4-imidazolidinedione, 3-phenyl-2,4-imidazolidinedione, 3-(-naphthyl-2,4-imidazolidinedione, 1,3-diethyl-2,4-imidazolidinedione, 1-ethyl-3-phenyl-2,4-imidazolidinedione, 1-ethyl-2-α (naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(2-carboxyethyl)-2-thio-2,4-imidazolidinedione, 3-phenyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-naphthyl-2-thio-2,4-imidazolidinedione, 1,3-diphenyl-2-thio-2,4-imidazolidinedione, etc.); a 2-imidazolin-5-one nucleus.

$G_2$ represents a substituted or unsubstituted amino radical (e.g., primary amino, anilino), or a substituted or unsubstituted aryl radical (e.g., phenyl, naphthyl, dialkylaminophenyl, tolyl, chlorophenyl, nitrophenyl).

According to the formulas (VIII)–(XII), each J represents a substituted or unsubstituted methine group. Examples of substituents for the methine groups include alkyl (preferably of from 1 to 6 carbon atoms, e.g., methyl, ethyl, etc.) and aryl (e.g., phenyl). Additionally, substituents on the methine groups may form bridged linkages.

$W_2$ represents a counterion as necessary to balance the charge of the dye molecule. Such counterions include cations and anions, for example sodium, potassium, triethylammonium, tetramethylguanidinium, diisopropylammonium, tetrabutylammonium, chloride, bromide, iodide, paratoluene sulfonate and the like.

$D_1$ and $D_2$ are each independently substituted or unsubstituted aryl (preferably of 6.to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., 2-hydroxyethyl, 4-hydroxybutyl, etc., a carboxyalkyl group, e.g., 2-carboxyethyl, 4-carboxybutyl, etc., a sulfoalkyl group, e.g., 2-sulfoethyl, 3-sulfobutyl, 4-sulfobutyl, etc., a sulfatoalkyl group, etc., an acyloxyalkyl group, e.g., 2-acetoxyethyl, 3-acetoxypropyl, 4-butyroxybutyl, etc., an alkoxycarbonlyalkyl group, e.g., 2-methoxycarbonlyethyl, 4-ethoxycarbonylbutyl, etc., or an aralkyl group, e.g., benzyl, phenethyl, etc. The alkyl or aryl group may be substituted by one or more of the substituents on the above-described substituted alkyl groups.

Particularly preferred dyes are:

Dye 1

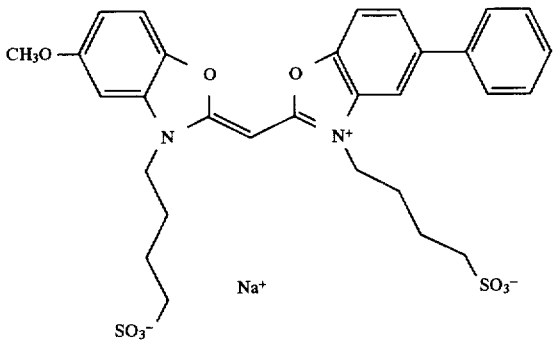

Dye 2

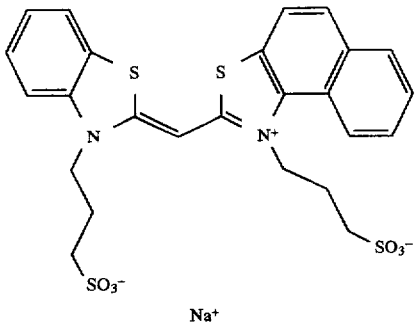

Dye 3

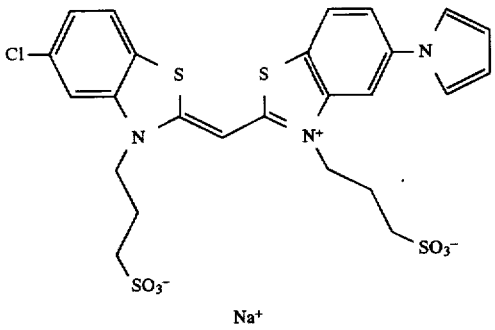

Dye 4

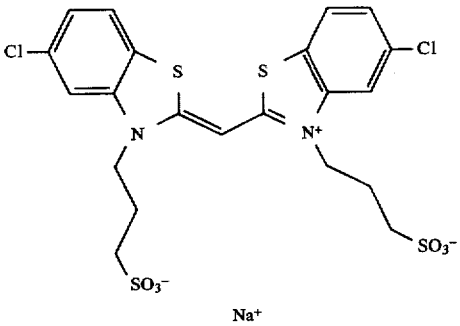

-continued
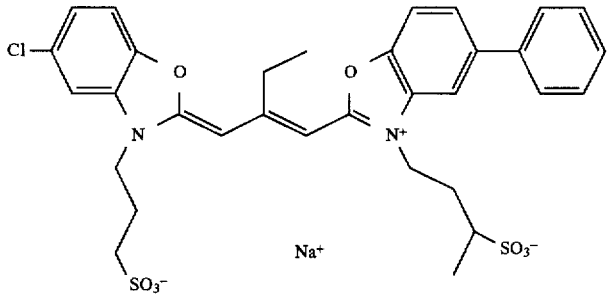
Dye 5
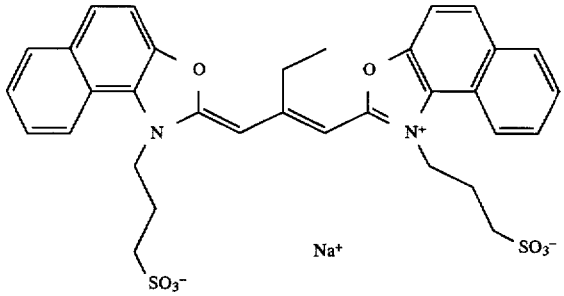
Dye 6
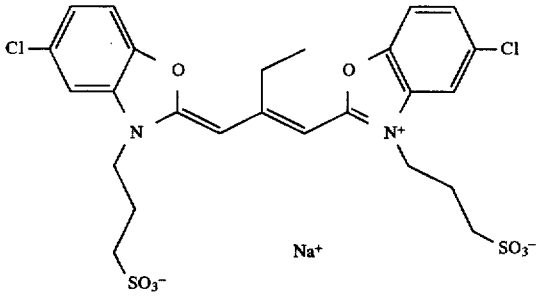
Dye 7
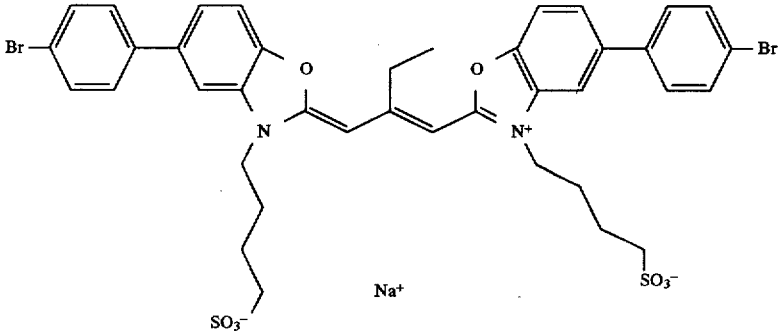
Dye 8
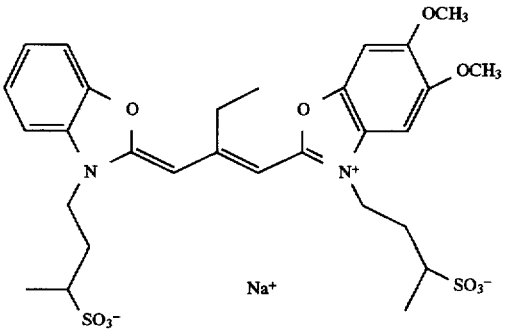
Dye 9

-continued
Dye 10
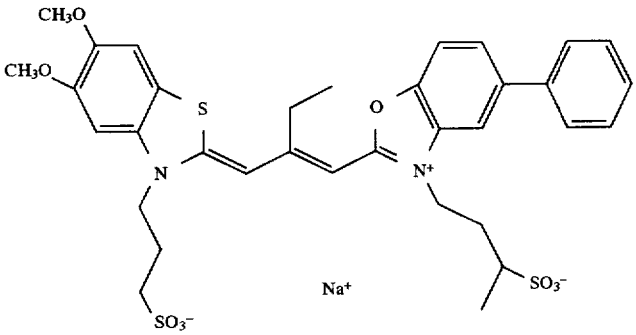
Dye 11
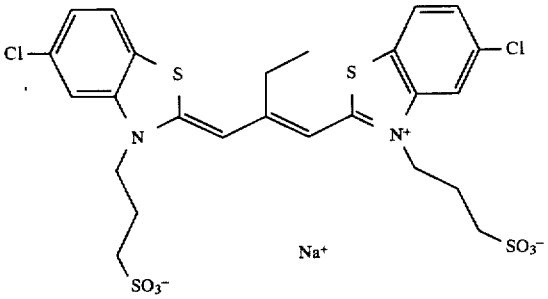
Dye 12
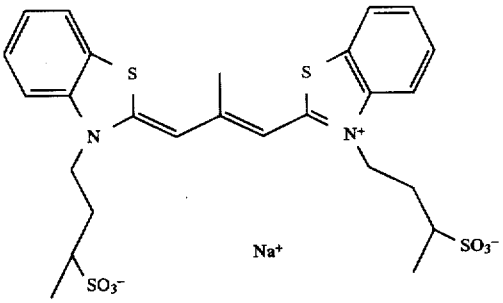
Dye 13
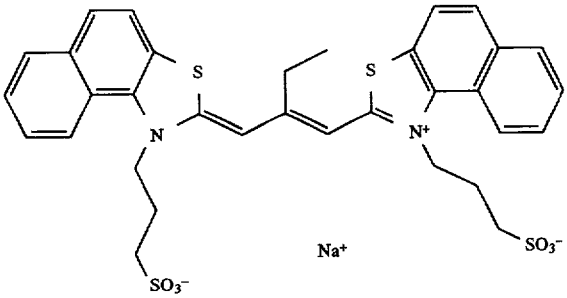
Dye 14
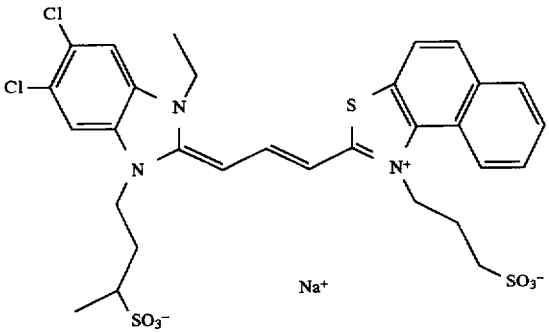

-continued

Dye 15

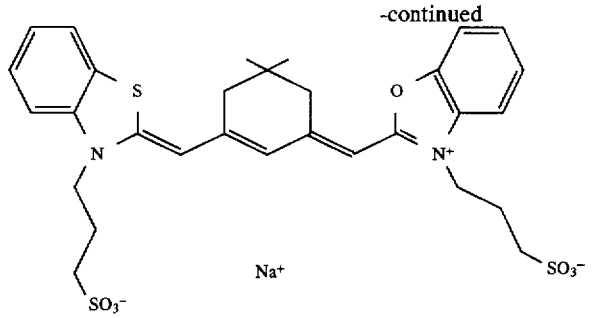

Dye 16

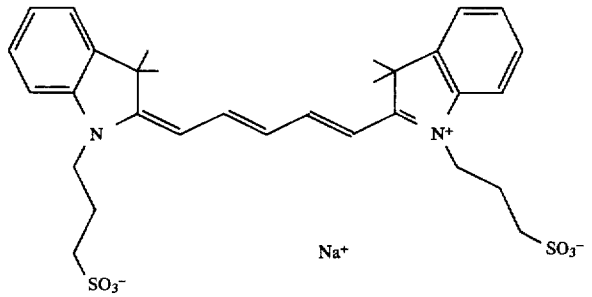

Dye 17

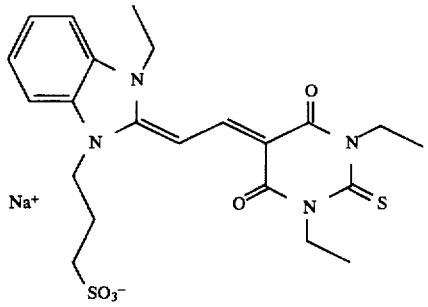

Dye 18

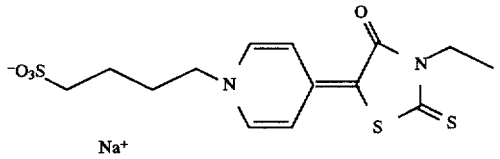

and

Dye 19

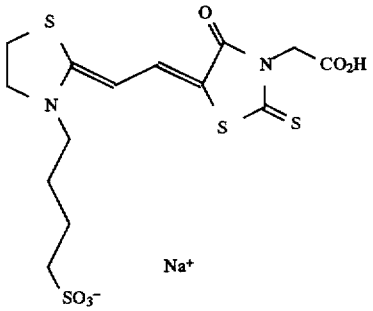

Various compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitivity. Examples of hydroxybenzene compounds are:

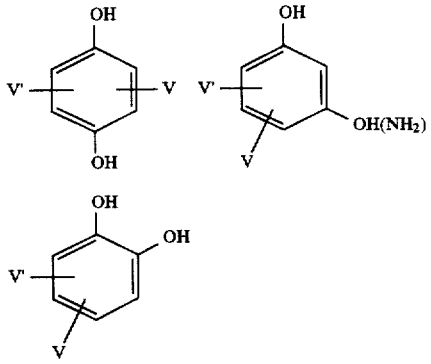

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, $—CH_2CH_2COOH$, $—CH_3$, $—CH_2CH_3$, $—C(CH_3)_3$, $—OCH_3$, —CHO, $—SO_3K$, $—SO_3Na$, $—SO_3H$, $—SCH_3$, or -phenyl.

Especially preferred hydroxybenzene compounds follow:

HB1

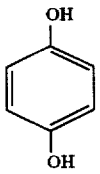

HB2

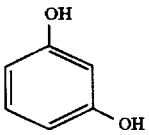

HB3

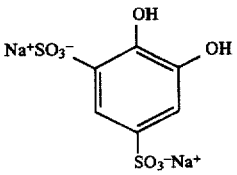

HB4

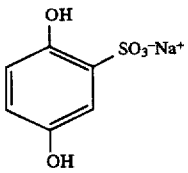

HB5

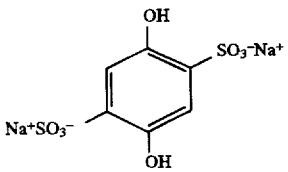

-continued

HB6

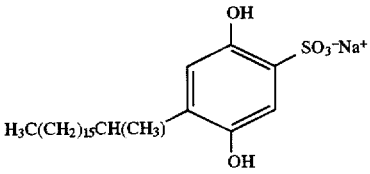

HB7

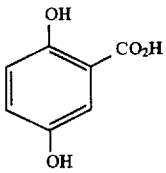

HB8

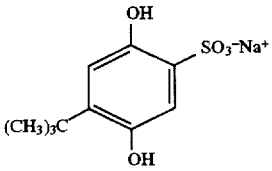

HB9

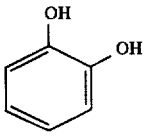

HB10

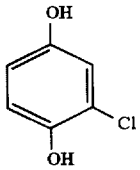

HB11

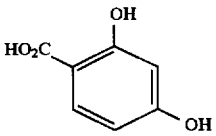

HB12

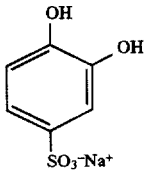

HB13

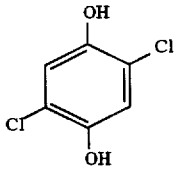

HB14

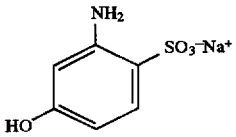

-continued

HB15

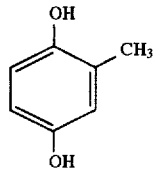

Hydroxybenzene compounds may be added to the emulsion layers or any other layers constituting the photographic material of the present invention. The preferred amount added is from $1\times10^{-3}$ to $1\times10^{-1}$ mol. and more preferred is $1\times10^{-3}$ to $2\times10^{-2}$ mol. per mol of silver halide.

Laser Flash Photolysis Method (a) Oxidation Potential of Radical X•

The laser flash photolysis measurements were performed using a nanosecond pulsed excimer (Questek model 2620, 308 nm, ca. 20 ns, ca. 100 mJ) pumped dye laser (Lambda Physik model FL 3002). The laser dye was DPS (commercially available from Exciton Co.) in p-dioxane (410 nm, ca. 20 ns, ca. 10 mJ). The analyzing light source was a pulsed 150W xenon arc lamp (Osram XBO 150/W). The arc lamp power supply was a PRA model 302 and the pulser was a PRA model M-306. The pulser increased the light output by ca. 100 fold, for a time period of ca. 2–3 ms. The analyzing light was focussed through a small aperture (ca. 1.5 mm) in a cell holder designed to hold 1 $cm^2$ cuvettes. The laser and analyzing beams irradiated the cell from opposite directions and crossed at a narrow angle (ca. 15°). After leaving the cell, the analyzing light was collimated and focussed onto the slit (1 mm, 4 nm bandpass) of an ISA H-20 monochromator. The light was detected using 5 dynodes of a Hamamatsu model R446 photomultiplier. The output of the photomultiplier tube was terminated into 50 ohm, and captured using a Tektronix DSA-602 digital oscilloscope. The entire experiment is controlled from a personal computer.

The experiments were performed either in acetonitrile, or a mixture of 80% acetonitrile and 20% water. The first singlet excited state of a cyanoanthracene (A), which acted as the electron acceptor, was produced using the nanosecond laser pulse at 410 nm. Quenching of this excited state by electron transfer from the relatively high oxidation potential donor biphenyl (B), resulted in efficient formation of separated, "free", radical ions in solution, $A\bullet^-$ +$B^{\bullet+}$. Secondary electron transfer then occurred between $B^{\bullet+}$ and the lower oxidation potential electron donor X-Y, to generate $X\text{-}Y^{\bullet+}$ in high yield. For the investigations of the oxidation potentials of the radicals $X^\bullet$, typically the cyanoanthrancene concentration was ca. $2\times10^{-5}$M to $10^{-4}$M the biphenyl concentration was ca. 0.1M. The concentration of the X-Y donor was ca. $10^{-3}$M. The rates of the electron transfer reactions are determined by the concentrations of the substrates. The concentrations used ensured that the $A^{\bullet-}$ and the $X\text{-}Y^{\bullet+}$ were generated within 100 ns of the laser pulse. The radical ions could be observed directly by means of their visible absorption spectra. The kinetics of the photogenerated radical ions were monitored by observation of the changes in optical density at the appropriate wavelengths.

The reduction potential ($E_{red}$) of 9,10-dicyanoanthracene (DCA) is −0.91 V. In a typical experiment, DCA is excited and the initial photo-induced electron transfer from the biphenyl (B) to the DCA forms a $DCA^{\bullet-}$, which is observed at its characteristic absorption maximum ($\lambda_{obs}$=705 nm), within ca. 20 ns of the laser pulse. Rapid secondary electron transfer occurs from X-Y to $B^{\bullet+}$ to generate $X\text{-}Y^{\bullet+}$, which fragments to give $X^\bullet$. A growth in absorption is then observed at 705 nm with a time constant of ca. 1 microsecond, due to reduction of a second DCA by the $X^\bullet$. The absorption signal with the microsecond growth time is equal to the size of the absorption signal formed within 20 ns. If reduction of two DCA was observed in such an experiment, this indicates that the oxidation potential of the $X^\bullet$ is more negative than −0.9 V.

If the oxidation potential of $X^\bullet$ is not sufficiently negative to reduce DCA, an estimate of its oxidation potential was obtained by using other cyanoanthracenes as acceptors. Experiments were performed in an identical manner to that described above except that 2,9,10-tricyanoanthracene (TriCA, $E_{red}$ −0.67 V, $\lambda_{obs}$=710 nm) or tetracyanoanthracene (TCA, $E_{red}$−0.44 V, $\lambda_{obs}$=715 nm) were used as the electron acceptors. The oxidation potential of the $X^\bullet$ was taken to be more negative than −0.7 if reduction of two TriCA was observed, and more negative than −0.5 V if reduction of two TCA was observed. Occasionally the size of the signal from the second reduced acceptor was smaller than that of the first. This was taken to indicate that electron transfer from the $X^\bullet$ to the acceptor was barely exothermic, i.e. the oxidation potential of the radical was essentially the same as the reduction potential of the acceptor.

To estimate the oxidation potentials of $X^\bullet$ with values less negative than −0.5 V, i.e. not low enough to reduce even tetracyanoanthracene, a slightly different approach was used. In the presence of low concentrations of an additional acceptor, Q, that has a less negative reduction potential than the primary acceptor, A (DCA, for example), secondary electron transfer from $A^{\bullet-}$ to Q will take place. If the reduction potential of Q is also less negative than the oxidation potential of the $X^\bullet$, then Q will also be reduced by the radical, and the magnitude of the $Q^{\bullet-}$ absorption signal will be doubled. In this case, both the first and the second electron transfer reactions are diffusion controlled and occur at the same rate. Consequently, the second reduction cannot be time resolved from the first. Therefore, to determine whether two electron reduction actually takes place, the $Q^{\bullet-}$ signal size must be compared with an analogous system for which it is known that reduction of only a single Q occurs. For example, a reactive $X\text{-}Y^{\bullet+}$ which might give a reducing $X^\bullet$ can be compared with a nonreactive $X\text{-}Y^{\bullet+}$. Useful secondary electron acceptors (Q) that have been used are chlorobenzoquinone ($E_{red}$−0.34 V, $\lambda_{obs}$=450 nm), 2,5-dichlorobenzoquinone ($E_{red}$−0.18 V, $\lambda_{obs}$=455 nm) and 2,3,5,6-tetrachlorobenzoquinone ($E_{red}$ 0.00 V, $\lambda_{obs}$=460 nm).

(b) Fragmentation Rate Constant Determination

The laser flash photolysis technique was also used to determine fragmentation rate constants for examples of the oxidized donors X-Y. The radical cations of the X-Y donors absorb in the visible region of the spectrum. Spectra of related compounds can be found in "Electron Absorption Spectra of Radical Ions" by T. Shida, Elsevier, N.Y., 1988. These absorptions were used to determine the kinetics of the fragmentation reactions of the radical cations of the X-Y. Excitation of 9,10-dicyanoanthracene (DCA) in the presence of biphenyl and the X-Y donor, as described above, results in the formation of the $DCA^{\bullet-}$ and the $X\text{-}Y^{\bullet+}$. By using a concentration of X-Y of ca. $10^{-2}$M, the $X\text{-}Y^{\bullet+}$ can be formed within ca. 20 ns of the laser pulse. With the monitoring wavelength set within an absorption band of the $X\text{-}Y^{\bullet+}$, a decay in absorbance as a function of time is observed due to the fragmentation reaction. The monitoring wavelengths used were somewhat different for the different donors, but were mostly around 470–530 nm. In general the $DCA^{\bullet-}$ also absorbed at the monitoring wavelengths, however, the signal due to the radical anion was generally much weaker than that due to the radical cation, and on the timescale of the experiment the $A^{\bullet-}$ did not decay, and so did not contribute to the observed kinetics. As the $X\text{-}Y^{500\ +}$ decayed, the radical $X^{\bullet}$ was formed, which in most cases reacted with the cyanoanthracene to form a second $A^{\bullet-}$. To make sure that this "grow-in" of absorbance due to $A^{\bullet-}$ did not interfere with the time-resolved decay measurements, the concentration of the cyanoanthracene was maintained below ca. $2\times10^{-5}$M. At this concentration the second reduction reaction occurred on a much slower timescale than the $X\text{-}Y^{\bullet+}$ decay. Alternatively, when the decay rate of the $X\text{-}Y^{\bullet+}$ was less than $10^6$ $s^{-1}$, the solutions were purged with oxygen. Under these conditions the $DCA^{\bullet-}$ reacted with the oxygen to form $O_2^{\bullet-}$ within 100 ns, so that its absorbance did not interfere with that of the $X\text{-}Y^{\bullet+}$ on the timescale of its decay.

The experiments measuring the fragmentation rate constants were performed in acetonitrile with the addition of 20% water, so that all of the salts could be easily solubilized. Most experiments were performed at room temperature. In some cases the fragmentation rate was either too fast or too slow to be easily determined at room temperature. When this happened, the fragmentation rate constants were measured as a function of temperature, and the rate constant at room temperature determined by extrapolation.

Typical examples of synthesis of compounds A-L-XY follow. Other compounds can also be synthesized by analogy using appropriate selected known starting materials.

The following compounds were synthesized via reaction schemes I and II:

SCHEME I

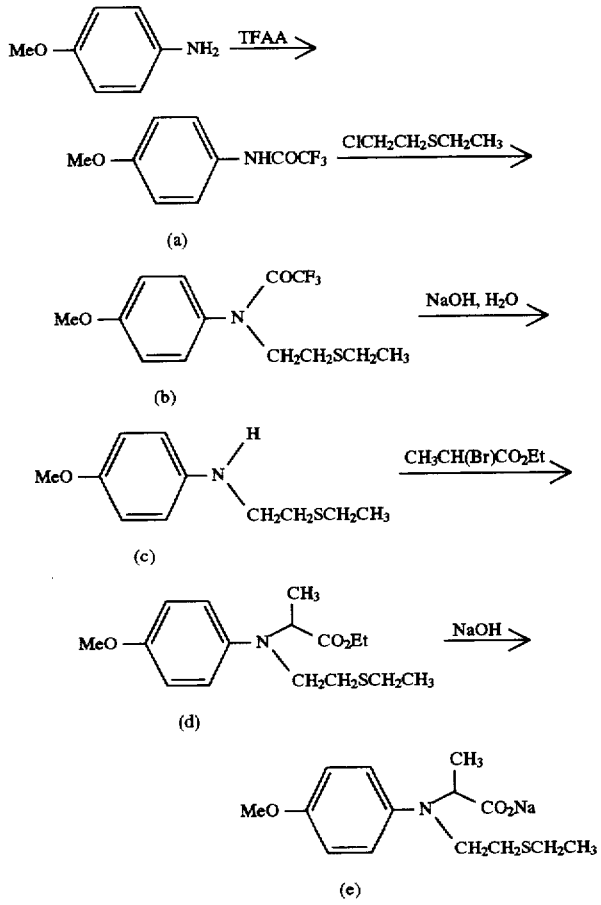

SCHEME II

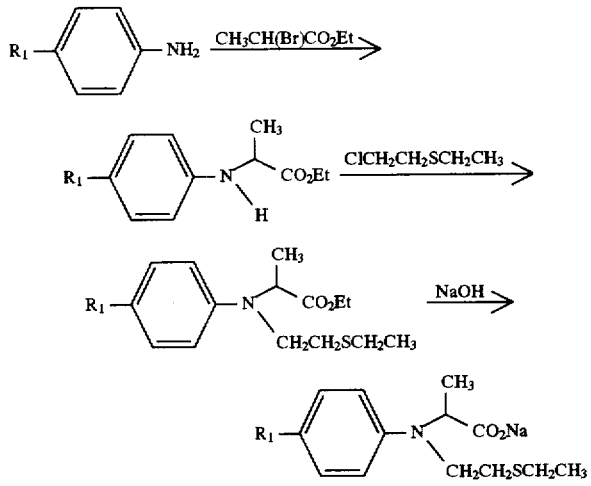

Preparation of p-Anisidine trifluoroacetamide, intermediate (a)(Scheme I)

p-Anisidine (61.5 g, 0.5 mol) and triethylamine (50.5 g, 0.5 mol) were dissolved in 100 mL of tetrahydrofuran (THF) and cooled to 0° C. under a nitrogen atmosphere. Trifluoroacetic anhydride (TFAA, 105 g, 0.5 mol) was then added dropwise. After the addition was complete, the solution was allowed to warm to room temperature. An additional 5 mL of TFAA was added to drive the reaction to completion. The solution was then concentrated at reduced pressure to one-half of its original volume, and partitioned between 500 mL ethyl acetate and 250 mL chilled brine. The organic phase was separated, washed with 100 mL chilled brine two times, dried over anhydrous sodium sulfate, and concentrated at reduced pressure to yield a yellow-brown solid. The crude solid was recrystallized from heptane to give the desired trifluoroacetamide as white needles (80 g, 79%).

$^1$H NMR ($CDCl_3$): δ 8.2(br s, 1H); 7.45(d, 2H); 6.85(d, 2H); 3.8(s, 3H).

Preparation of N-(4-Methoxyphenyl)-N-(2-thioethylethyl)-trifluoroacetamide, intermediate (b)(Scheme I)

The p-anisidine trifluoroacetamide (2.0 g, 0.01 mol), 2-chloroethyl ethyl sulfide (1.2 g, 0.01 mol), and potassium carbonate ( 1.4 g, 0.01 mol) were added to 20 mL acetonitrile. The reaction mixture was heated at 700° C. for 12 h, then cooled and partitioned between ethyl acetate and brine. The organic layer was separated, dried over anhyd. sodium sulfate, and concentrated at reduced pressure. The resulting oil was charged onto a silica gel column and eluted with heptane:THF (7:1). The desired thioether was isolated as a colorless oil (1.9 g, 63%).

$^1$H NMR($CDCl_3$): δ 7.15(d, 2H); 6.9(d, 2H); 3.85(t, 2H); 3.8(t, 3H); 2.7(m, 2H); 2.55(q, 2H); 1.2(t, 3H). Mass spectra m/e=307

Preparation of N-(2-Thioethyl-ethyl)-4-anisidine, intermediate (c) (Scheme I)

The trifluoroacetamido-anisidine thioether, intermediate (b) (1.9 g, 6.2 mmol) was dissolved in 20 ML of methanol. Water (5 mL) was then added, followed by 1 mL of 50% aq. NaOH. The reaction mixture was stirred 18 h at room temperature, and then partitioned between ethyl acetate and brine. The organic layer was separated, dried over anhyd. sodium sulfate, and concentrated at reduced pressure to yield the desired anisidine thio-ether as a yellow oil (1.3 g, 100%). This material was used without purification.

$^1$H NMR($CDCl_3$): δ 6.8(d, 2H); 6.6(d, 2H); 3.7(s, 3H); 3.25(t, 2H); 2.75(t, 2H); 2.55(t, 2H); 1.2(t, 3H).

Preparation of N-(4-Methoxyphenyl)-N-(2-thioethylethyl)-alanine ethyl ester, intermediate (d) (Scheme I)

N-(2-Thioethyl-ethyl)-p-anisidine (2.1 g, 0.01 mol), ethyl 2-bromoproprionate (2.7 g, 0.015 mol) and potassium carbonate (5.0 g, 0.036 mol) were added to 50 mL acetonitrile and heated at reflux for 24 h under a nitrogen atmosphere. The reaction mixture was cooled and then partitioned between 200 mL ethyl acetate and 100 mL brine. The organic layer was separated, dried over anhyd. sodium sulfate and concentrated at reduced pressure. The resulting oil was charged onto a silica gel column and eluted with heptane:THF (7:1). The desired alanine was isolated as a colorless oil (2.2 g, 71%).

$^1$H NMR ($CDCl_3$): δ 6.8(s, 4H); 4.25(q, 1H); 4.15(q, 2H); 3.75(s, 3H); 3.4(t, 2H); 2.6(m, 4H); 1.45(d, 3H); 1.25(2t, 6H). Mass spectra m/e=311

Preparation of S-1, N-(4-Methoxyphenyl)-N-(2-thioethyl)-alanine, sodium salt (e) (Scheme I)

N-(4-Methoxyphenyl)-N-(2-ethylthio-ethyl)alanine ethyl ester (0.45 g, 1.45 mmol) was dissolved in methanol. Water was added until the mixture became turbid. Sodium hydroxide (0.06 g, 1.45 mmol) was dissolved in a minimum amount of water and added to the aqueous methanol solution. The solution was stirred at room temperture 18 h and the solvent was removed at reduced pressure. The resulting solid was triturated with THF and filtered. The filtrate was concentrated to give the carboxylate salt as a white solid (0.91 g, 91%).

$^1$H NMR($D_2O$): δ6.9(s, 4H); 3.95(q, 1H); 3.7(s, 3H); 3.4(m, 2H); 2.5(m, 4H); 1.3(d, 3H); 1.1(t, 3H).

Mass spectra: negative ion m/e=282 ($M^-$); positive ion m/e=306 ($M^-$ $H^+Na^+$); 328 ($M^-$ $2Na^+$)

Preparation of N-(4-Methoxyphenyl)-N-(2-thioethylethyl)glycine ethyl ester (In the manner of Scheme I)

N-(2-Thioethyl-ethyl)-p-anisidine (2.1 g, 0.01 mol), ethyl bromoacetate (2.5 g, 0.015 mol), and potassium carbonate were added to 50 mL of acetonitrile and the mixture was heated at reflux for 18 h under a nitrogen atmosphere. The reaction mixture was cooled, and then partitioned between 100 mL ethyl acetate and 50 mL brine. The organic layer was separated, dried over anhyd. sodium sulfate, and concentrated at reduced pressure. The resulting oil was charged onto a silica gel column and eluted with heptane: THF 4:1. The desired ester was isolated as a light yellow oil (1.67 g) (57%).

$^1$H NMR($CDCl_3$): δ6.8(d, 2H); 6.6(d, 2H); 4.2(q, 2H); 4.0(s, 2H); 3.7(s, 3H); 3.55(t, 2H); 2.8(t, 2H); 2.6(dd, 2H); 1.25(t, 3H). Mass spectra m/e=297.

Preparation of S-5, N-(4-Methoxyphenyl)-N-(2-ethylthio-ethyl)glycine, sodium salt (In the manner of Scheme I)

N-(4-Methoxyphenyl)-N-(2-thioethyl-ethyl)-glycine ethyl ester (1.67 g, 5.6 mmol) was dissolved in methanol: THF (10:1) and 5 mL of water was added. Sodium hydroxide (0.22 g 5.6 mmol) was dissolved in a minimum amount of water and added to the aqueous-MeOH-THF solution. The reaction mixture was stirred at room temperature 24 h, and then the solvent was removed at reduced pressure. The resulting solid was triturated with water, filtered, and the filtrate was concentrated at reduced pressure. The solid that was obtained was triturated with THF, filtered and the solvent was removed from the filtrate at reduced pressure, yielding the desired sodium carboxylate as a white solid (1.5 g, 90%).

$^1$H NMR($D_2O$): δ6.9(d, 2H); 6.65(d, 2H); 3.8(s, 2H); 3.7(s, 3H); 3.5(t, 2H); 2.7(t, 2H); 2.55(dd, 2H) 1.2(t, 3H).

Mass spectra: positive ions m/e=292 ($M^-$ $H^+Na^+$); 314 ($M^-$ $2Na^+$); negative ion m/e=268 ($M^-$)

Preparation of p-Toluidine trifluoracetamide (In the manner of Scheme I)

p-Toluidine was dissolved in THF and cooled to 0° C. under a nitrogen atmosphere. Trifluoroacetic anhydride (1 equiv.) was then added dropwise. The solution was allowed to warm to room temperature and was stirred for 18 h. The reaction mixture was then partitioned between ethyl acetate and brine. The organic layer was separated, dried over anhyd. sodium sulfate, and the solvent was removed at reduced pressure. The resulting yellow solid was recrystallized from heptane.

$^1$H NMR($CDCl_3$): δ8.0(br s, 1H); 7.4(d, 2H); 7.2(d, 2H); 2.3 (d, 3H)

Preparation of N-(2-Thioethyl-ethyl)-p-toluidine trifluoroacetamide p-Toluidine trifluoroacetamide (5.3 g, 0.028 mol), 2-chloroethyl ethyl sulfide (3.5 g, 0.028 mol) and potassium carbonate (5.8 g, 0.042 mol) were added to 30 mL of acetonitrile. The mixture was heated at reflux for 18 h under a nitrogen atmosphere. The reaction mixture was then cooled and partitioned between 100 mL ethyl acetate and 50 mL brine. The organic layer was separated, dried over anhydrous sodium sulfate, and concentrated at reduced pressure. The resulting oil was charged onto a silica gel column, and eluted with heptane: THF (5:1). The desired thioether was isolated as a colorless oil (0.9 g, 11%).

$^1$H NMR($CDCl_3$): δ7.25(d, 2H); 7.15(d, 2H); 3.9(t, 2H); 2.7(t, 2H); 2.55(dd, 2H); 2.35(s, 3H); 1.25(t, 3H).

Preparation of N-(2-Thioethyl-ethyl)-p-toluidine

N-(2-Thioethyl-ethyl)-p-toluidine trifluoroacetamide (0.9 g, 3.1 mmol) was dissolved in 20 mL of methanol. Sodium hydroxide (0.12 g, 3.1 mmol) was dissolved in 2 mL of water and added to the methanol solution. The mixture was stirred for 4 h at room temperature, and the solvent was removed at reduced pressure. The desired aniline-thioether was isolated as a yellow oil and was used without purification.

$^1$H NMR($CDCl_3$): δ7.0(d, 2H); 6.6(d, 2H); 3.95(br s, 1H); 3.35(t, 2H); 2.8(t, 2H); 2.55(dd, 2H); 2.25(s, 3H); 1.25(t, 3H).

Preparation of N-(4-Methylphenyl)-N-(2-ethylthio-ethyl)alanine ethyl ester

The crude N-(2-thioethyl-ethyl)-p-toluidine (0.6 g, 3.1 mmol), ethyl 2-bromoproprionate (0.56 g, 3.1 mmol) and potassium carbonate (0.42 g, 3.1 mmol) were added to 20 mL of acetonitrile and heated at reflux 36 h under a nitrogen atmosphere. The reaction mixture was then cooled, and partitioned between ethyl acetate and brine. The organic layer was separated, dried over anhyd. sodium sulfate, and concentrated at reduced pressure. The resulting oil was charged onto a silica gel column and methylene chloride was used as the eluant. The desired ester was isolated as a colorless oil (0.3 g, 33%).

$^1$H NMR($CDCl_3$): δ7.05(d, 2H); 6.85(d, 2H); 4.35(q, 1H); 4.1( q, 2H); 3.45(t, 2H); 2.7(m, 2H); 2.6(dd, 2H); 2.2(s, 3H); 1.5(d, 3H); 1.25(2t, 6H).

Mass spectra m/e=295.

Preparation of S-3, N-(4-Methylphenyl)-N-(2-ethylthio-ethyl)alanine sodium salt

N-(4-Methylphenyl)-N-(2-ethylthio-ethyl)alanine ethyl ester (1.3 g, 4.7 mol) was dissolved in 20 mL of methanol. Water (2 mL) was then added, followed by sodium hydroxide (0.19 g, 4.7 mol) dissolved in a minimum amount of water. The solution was stirred 18 h at room temperature, and then the solvent was removed at reduced pressure. The resulting white solid was dissolved in a minimum amount of water and filtered. Solvent was removed from the filtrate at reduced pressure, yielding the desired carboxylate as a white solid (1.1 g, 87%).

$^1$H NMR($D_2O$): δ7.1(d, 2H); 6.7(d, 2H); 4.05(q, 1H); 3.4(m, 2H); 3.6(m, 4H); 2.2(s, 3H); 1.4(d, 3H); 1.1(t, 3H).

Mass spectra: negative ion m/e=266($M^-$); positive ions m/e 290 ($M^-$ H+$Na^+$); 312 ($M^-$ 2$Na^+$)

Preparation of N-(4-Methylphenyl)-N-(2-ethylthio-ethyl)glycine ethyl ester

N-(2-Thioethyl-ethyl)-p-toluidine (1.9 g, 0.01 mol), ethyl bromoacetate (1.7 g, 0.01 mol), and potassium carbonate (1.4 g, 0.01 mol) were added to 50 mL of acetonitrile and heated at reflux for 18 h under a nitrogen atmosphere. The reaction mixture was then cooled, and partitioned between 500 mL ethyl acetate and 200 mL brine. The organic layer was separated, washed with 200 mL brine, dried over anhyd. sodium sulfate, and concentrated at reduced pressure. The resulting oil was charged onto a silica gel column and eluted with heptane: THF 3:1. The desired ester was isolated as a yellow oil (1.5 g, 55%).

$^1$H NMR($CDCl_3$): δ7.00(d, 2H); 6.55(d, 2H); 4.2(q, 2H); 4.05(s, 2H); 3.6(t, 2H); 2.8(t, 2H); 2.6(dd, 2H); 2.25(s, 3H); 1.2(2t, 6H).

Preparation of S-6, N-(4-Methylphenyl)-N-(2-ethylthio-ethyl)glycine sodium salt

N-4-Methylphenyl)-N-(2-ethylthio-ethyl)-glycine ethyl ester (1.5 g, 5.3 mmol) was dissolved in 20 mL of methanol and water was added until the mixture became turbid. Sodium hydroxide (0.21 g, 5.3 mmol) was dissolved in a minimum amount of water and added to the aqueous methanol solution. The mixture was stirred 24 h at room temperature, and then the solvent was removed at reduced pressure. The resulting solid was triturated with water, filtered, and the solvent was removed from the filtrate to give the desired carboxylate as a white solid (1.0 g, 68%).

$^1$H NMR($D_2O$): δ7.15(d, 2H); 6.6(d, 2H); 3.8(s, 2H); 3.55(t, 2H); 2.7(t, 2H); 2.55(dd, 2H); 2.15(s, 3H); 1.2(t, 3H).

Mass spectra: negative ion m/e=252($M^-$); positive ion m/e=276 ($M^-$ $H^+Na^+$); m/e 298($M^-$ 2$Na^+$)

Preparation of N-(Phenyl)-N-(2-thioethyl-ethyl) alanine ethyl ester (Scheme II)

N-(Phenyl)alanine ethyl ester (3.8 g, 20 mmol), 2-chloroethyl ethyl sulfide (2.4 g, 20 mmol) and potassium carbonate (2.8 g, 20 mmol) were added to 50 mL acetonitrile and sonicated for 1 h. The mixture was then heated at reflux for 18 h under a nitrogen atmosphere. The reaction mixture was cooled, and then partitioned between 200 mL ethyl acetate and 200 mL brine. The organic layer was separated, washed with 200 mL brine, dried over anhyd. sodium sulfate, and concentrated at reduced pressure. The resulting oil was charged onto a silica gel column, and eluted with heptane:THF 5:1. The desired ester was isolated as a light yellow oil (2.0 g, 36%).

$^1$H NMR($CDCl_3$): δ7.2(t, 2H); 6.75(d, 3H); 4.2(q, 1H); 4.15(q, 2H); 3.55(t, 2H); 2.8(m, 2H); 2.65(dd, 2H); 1.5(d, 2H); 1.25(2t, 6H).

Preparation of N-(Phenyl)-N-(2-thioethyl-ethyl) alanine sodium salt, S-9

N-(Phenyl)-N-2-thioethyl-ethyl)alanine ethyl ester (2.0 g, 7.1 mmol) was dissolved in 50 mL of methanol, and water was added dropwise until the mixture became turbid. Sodium hydroxide (0.28 g, 7.1 mmol) was dissolved in a minimum amount of water and added to the aqueous-methanol solution. The reaction mixture was stirred 18 h at rt, and then the solvent was removed at reduced pressure. The resulting white solid (1.9 g, 100%) was used without further purification.

Preparation of N-(4-Carboxyethylphenyl)-N-(2-thioethyl-ethyl)alanine ethyl ester (Scheme II)

N-(4-Carboxyethylphenyl)alanine ethyl ester (1.3 g, 5.0 mmol), 2-chloroethyl ethyl sulfide (0.6 g, 5.0 mmol) and 2,6-lutidine (0.7 g, 6.5 mmol) were heated in a sealed tube at 150° C. for 36 h. The contents of the tube were then partitioned between 200 mL ethyl acetate and 150 mL brine. The organic layer was separated, dried over anhyd. sodium sulfate, and concentrated at reduced pressure. The resulting oil was charged onto a silica gel column and eluted with heptane:THF 4:1. The desired thioether was isolated as a light yellow oil (0.68 g, 39%).

$^1$H NMR($CDCl_3$): δ7.9(d, 2H); 6.65(d, 2H); 4.25(q, 1H); 4.3(q, 2H); 4.15(q, 2H); 3.6(t, 2H); 2.75(m, 2H); 2.6(dd, 2H); 1.55(d, 3H); 1.4–1.2(3t, 9H).

Preparation of S-15 N-(4-Carboxyethylphenyl)-N-(2-thioethyl-ethyl)alanine sodium salt N-(4-Carboxyethylphenyl)-N-(2-thioethyl-ethyl)alanine ethyl ester (0.68 g, 0.019 mol) was dissolved in 50 mL methanol and 5 mL of water was added. Sodium hydroxide (0.16 g, 0.038 mol) was dissolved in a minimum amount of water and added to the aqueous methanol solution. The mixture was stirred 24 h at room temperature, and then the solvent was removed at reduced pressure. The resulting white solid (0.65 g, 100%) was used without purification.

$^1$H NMR($D_2O$): δ7.7(d, 2H); 6.65(d, 2H); 4.2(q, 1H); 3.5(t, 2H); 2.7(m, 2H); 2.6(dd, 2H); 1.4(d, 3H); 1.2(t, 3H).

MS:—ion m/e 318($M^{2-}Na^+$)

Preparation of N-(4-Chlorophenyl)-N-(2-thioethyl-ethyl)alanine ethyl ester (Scheme II)

N-(4-Chlorophenyl)alanine ethyl ester (2.3 g, 0.01 mol), 2-chloroethyl ethyl sulfide (1.2 g, 0.01 mol) and 2,6-lutidine (1.5 g, 0.014 mol) were heated in a sealed tube at 110° C. for 48 h. The tube contents were then partitioned between 200 mL ethyl acetate and 150 mL brine. The organic layer was separated, dried over anhyd. sodium sulfate, and concentrated at reduced pressure. The resulting oil was charged onto a silica gel column and eluted with heptane:THF (7:1). The desired thioether was isolated as a light yellow oil (0.9 g, 28%).

Preparation of S-12, N-(4-Chlorophenyl)-N-(2-thioethyl-ethyl)alanine sodium salt N-(4-Chlorophenyl)-N-(2-thioethyl-ethyl)alanine ethyl ester (0.9 g, 2.8 mmol) was dissolved in 100 mL methanol and 10 mL of water was added. Sodium hydroxide (0.11 g, 2.8 mmol) was dissolved in a minimum amount of water, and added to the aqueous methanol solution. The mixture was stirred 18 h at room temperature, and then the solvent was removed at reduced pressure. The resulting white solid (0.8 g, 100%) was used without purification.

$^1$H NMR($D_2O$) δ7.15(d, 2H); 6.65(d, 2H); 4.1(q, 1H) 3.4(t, 2H); 2.65(m, 2H); 2.55(dd, 2H); 1.35(d, 3H); 1.15(t, 3H).

Mass spectra: negative ion m/e=286 ($M^-$); positive ion m/e=310 ($M^-$ $Na^+H^+$) and 332 ($M^-$ $2Na^+$).

Preparation of N-(4-Methylthiophenyl)-N-(n-butyl) alanine ethyl ester

N-(4-Methylthiophenyl)alanine ethyl ester (10.0 g, 42.0 mmol), n-butyl iodide (7.9 g, 42 mmol) and potassium carbonate were added to 150 mL of acetonitrile and the mixture was heated at reflux for 48 h under a nitrogen atmosphere. The reaction mixture was cooled and then partitioned between 300 mL ethyl acetate and 200 mL brine. The organic layer was separated, washed with 100 mL brine, dried over anhyd. sodium sulfate, and concentrated at reduced pressure. The resulting oil was charged onto a silica gel column and eluted with heptane:THF (5:1). The desired ester was isolated as a yellow oil (3.0 g, 24%).

$^1$H NMR($CDCl_3$): δ7.25(d, 2H); 6.7(d, 2H); 4.45(q, 1H); 4.1(q, 2H); 2.85(s, 3H); 2.75(t, 2H); 1.55–1.3(m, 4H); 1.45(d, 3H); 1.2(t, 3H); 0.9(t, 3H).

Preparation of S-10, N-(4-Methylthiophenyl)-N-(n-butyl)alanine sodium salt

N-(4-Methylthiophenyl)-N-(n-butyl)alanine ethyl ester (3.0 g, 10.1 mmol) was dissolved in 50 mL methanol and 5 mL of water was added. Sodium hydroxide (0.41 g, 10.1 mmol) was dissolved in a minimum amount of water, and added to the aqueous methanol solution. The mixture was stirred 18 h at room temperature, and then the solvent was removed at reduced pressure. The resulting white solid was used without purification.

$^1$H NMR($D_2O$): δ7.2(d, 2H); 6.7(d, 2H); 4.2(q, 1H); 2.7(s, 3H); 2.65(t, 2H); 1.4–1.2(m, 4H); 1.25(d, 3H); 0.7(t, 3H).

The compounds PMT-1 and PMT-2 were synthesized by the reaction sequence in scheme III.

SCHEME III

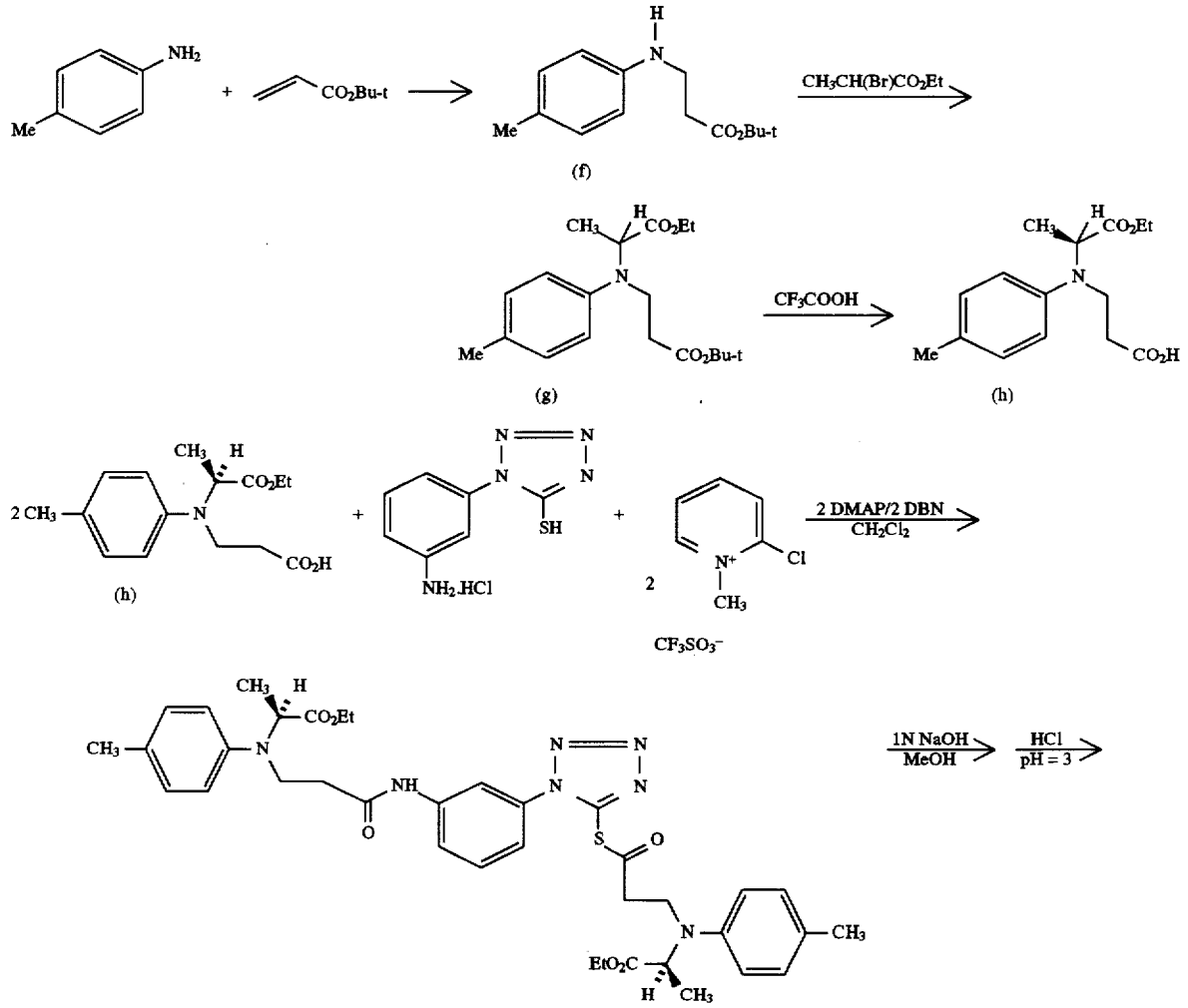

-continued

SCHEME III

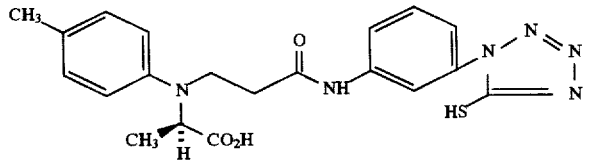

Preparation Intermediate (h)

To 21 g of p-toluidine in 25 ml of toluene was added 1 equiv of t-butyl acrylate. The mixture was allowed to react at reflux for 40 hr and the monoalkylated product was isolated by vacuum distillation to give 33 g (70%) of (f), b.p. 120°–150° C./1–2.5 mm. To 116 g of (f) in 600 ml of butyronitrile was added 2 equiv. of $K_2CO_3$ and 2 equiv of ethyl-2-bromoproprionate and the mixture was heated to reflux and held for 16 h., from which 116 g (60%) of compound (g) was isolated by distillation, b.p. 145°–170° C./0.5–0.7 mm. To 5.36 g of the t-butyl ester compound (g) was added 6 ml of trifluoroacetic acid (TFA) and the brown solution was kept over night at room temperature. Excess TFA was removed on a rotoevaporater and the residue was pumped down further to remove TFA under high vacuum to give 5 g of compound (h) as the residue. $^1$H NMR, and field desorption mass-spectrometric (FDMS) measurements were consistent with the proposed structure. Analysis Results: FDMS; m/e 279 ($M^+$) for $C_{15}H_2$:$NO_4$; $^1$H-NMR ($CDCl_3$): δ1.22 (t, 3H), 1.49 (d, 3H), 2.36 (s, 3H), 2.55 (m, 2H), 3.86 (t, 2H), 4.19 (q, 2H), 4.40 (q, 1H), 7.28 (m, 4H), 9.29 (s, 1H).

Compounds analogous to intermediate (h) can be synthesized by using appropriate p-substituted anilines as a starting material.

Preparation of PMT-1

A mixture of 404 mg (1.75 mmol) of m-aminophenyl-1H-tetrazole-5-thiol hydrochloride, 980 mg (2 eq) of intermediate (h), 536 mg (2.5 eq) of dimethylaminopyridine (DMAP) and 546 mg (2.5 eq) of DBN was dissolved in 25 mL of methylene chloride. To this solution was added 1 g (2.5 eq) of 2-chloro-N-methylpyridinium triflate and the reaction mixture was allowed to stir overnight at room temperature. The solvent was rotavaporated and the residue was saponified with 5 mL of methanol and 12 mL of 1N sodium hydroxide. After 4 h of stirring, the light brown alkaline solution was washed with methylene chloride to remove any neutral impurities and acidified by dropwise addition of concentrated HCl until the pH of the aqueous solution dropped to around 3. The precipitated gum was separated from the clear supernatant by decantation and washed with water. The crude gummy solid was dissolved in acetonitrile and flashed through a silica gel (32–63 micron) column which was packed in acetonitrile. Eluting with acetonitrile in 30–40 mL aliquots produced pure fractions which were combined and rotavaporated to give 210 mg of pure product as a colorless solid: FAB mass spectra: m/e 427 ($MH^+$ for $C_{20}H_{22}N_6O_3S+H^+$); $^1$H-NMR $CD_3CN$: δ1.35 (d J=7.1 Hz,3H) ,2.19 (s, 3H,) , 2.58 (m J=6.4 Hz, 2H,), 3.58 (m J=6.2 Hz, 2H), 4.27 (q J=7.1 Hz, 1H), 6.1 (br. s), 6.76 (d J=8.5 Hz, 2H), 7.02 (d J=8.5 Hz, 2H), 7.46 (pseudo t J=8 Hz, 1H), 7.57 (pseudo d J=8 Hz, 2H), 8.19 (s, 1H), 8.97 (s, 1H).

Compound S-18 was synthesized by the reaction sequence in Scheme IV.

SCHEME IV

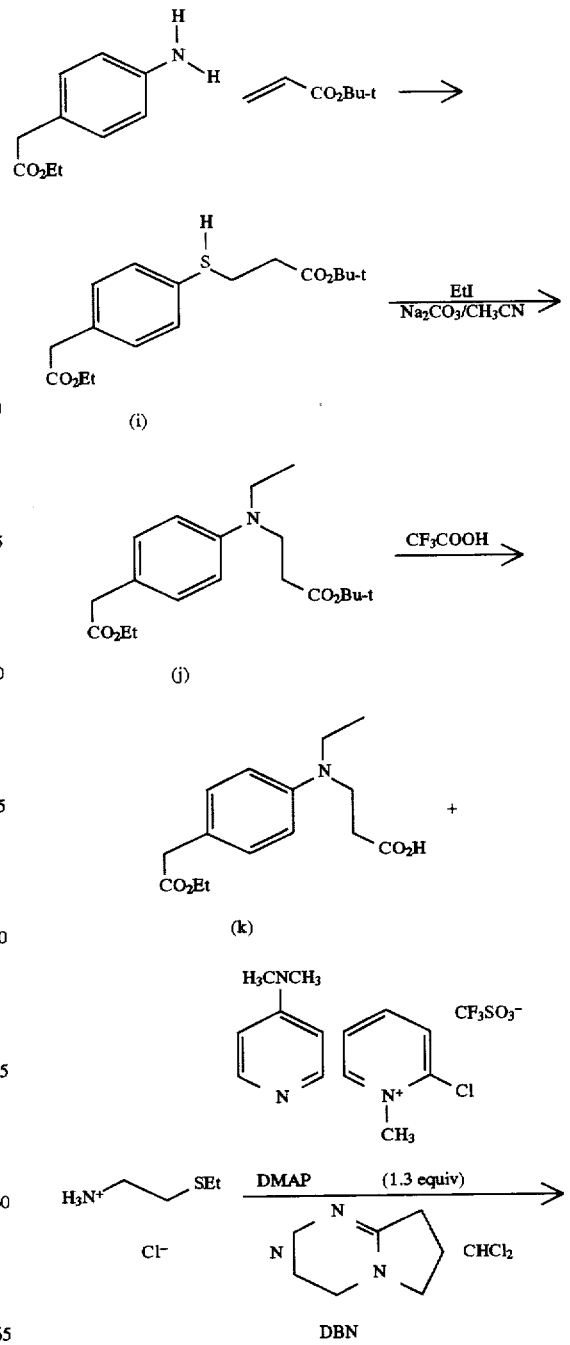

-continued

SCHEME IV

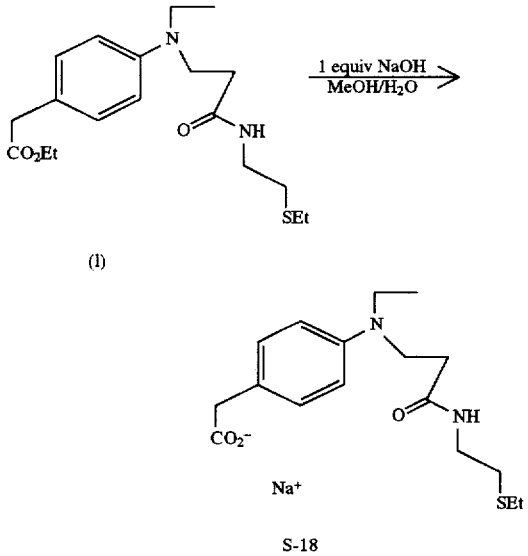

Preparation Intermediate (i)

A solution of 5 g (27.9 mmol) of ethyl p-aminophenylacetate in 20 mL of acetic acid was added 4.9 mL of t-butyl acrylate. The mixture was heated in an oil bath of 110°–115° C. for 3–4 h. It was poured into water, extracted with ether, dried ($MgSO_4$) and rotavaporated to give 7.5 g of crude product. F. D. Mass: m/e 307 ($M^+$) for $C_{17}H_{25}NO_4$. $^1H$ NMR ($CDCl_3$): δ1.22 (t, 3H), 1.42 (s, 9H) 2.50 (t, 2H), 3.36 (t, 2H), 3.47 (s, 2H), 4.10 (q, 2H), 6.59 (d, 2H), 7.07 (d, 2H); TLC showed this material was contaminated with acetic acid and some starting material which could be removed in the later stage of purification.

Preparation Intermediate (j)

A mixture of 3.8 g of (i), 3 mL of ethyl iodide and 2.5 g of anhydrous $K_2CO_3$ in 50 mL of acetonitrile was refluxed for 15 h. It was then poured into water, extracted with ether. The organic phase was separated, dried ($MgSO_4$) and rotovaporated to give 2.4 g of a dark oil. Purification was accomplished by dissolving in methylene chloride and passing through a 1'×3' column of silica gel (32–63 micron) to give after rotavaporation 1.5 g of pure product as a colorless oil: $^1H$ NMR ($CDCl_3$): δ1.12 (t, 3H), 1.24 (s, 9H) 2.47 (t, 2H), 3.34 (q, 2H), 3.48 (s, 2H), 3.53 (t, 2H), 4.12 (q, 2H), 6.62 (d, 2H), 7.12 (d, 2H);

Preparation Intermediate (k)

The t-butyl ester (j) was added 5 mL of trifluoroacetic acid. The solution was kept at r.t. overnight. Excess TFA was rotavaporated and the residue was pumped under high vacumm (0.1 mm) to give 2.7 g of essentially pure acid: $^1H$ NMR ($CDCl_3$): δ1.09 (t, 3H), 1.23 (t, 3H) 2.55 (t, 2H), 3.59 (q, 2H), 3.65 (s, 2H), 3.79 (t, 2H), 4.13 (q, 2H), 7.45 (q, 4H), 10.7 (br. s, 1H). This sample which contained a small amount of TFA was used directly for the subsequent reaction.

Preparation of Comparative Compound Comp-7 (Table J)

A mixture of 500 mg (3.6 mmol) of ethylthioethyl amine hydrochloride, 480 mg of 4-dimethylaminopyridine (DMAP), 9355 mg of 1,5-diazabicyclo[4.3.0] non-5-ene (DBN), and 1 g of (k) in 50 mL of methylene chloride (dried in 3A mol. sieve prior to use) was stirred until a solution was obtained. To this was added 1.13 g (1.3 equiv.) of 2-chloro-N-methylpyridinium triflate and the reaction mixture was allowed to stir for 2 days at room temperature. The water was added to the mixture and it was extracted with methylene chloride. The organic phase was separated, dried ($MgSO_4$) and rotavaporated. The residue was purified by flash chromatography over a 11/4"×5" silica gel (32–63 micron) column packed in methylene chloride. Elution consecutively with methlene chloride, ethyl acetate, acetonitrile and methanol produced about 500 mg of the desired pure Comp-7 as an oil: F. D. Mass: m/e 366 ($M^+$ for $C_{19}H_{30}N_2O_3S$; characteristic peaks of $^1H$ NMR ($CDCl_3$): δ1.08 (t, 3H), 1.22 (m, 6H) 2.37 (t, 2H), 2.48 (q, 2H), 2.58 (t, 2H), 3.34 (m, 4H), 3.46 (s, 2H), 3.55 (t, 2H), 4.07 (q, 2H) 6.35 (broad t, 1H), 6.63 (d, 2H), 7.08 (d, 2H);

Preparation of S-18

The Compound (1) (500 mg) was saponified with 1.385 mL of 0.986N NaOH (1 equiv.) in 3 mL of methanol at room temperature for 3 days. The reaction mixture was rotavaped and the residue was recrystallized from 50 mL of ethyl acetate to give 320 mg S-18 as a hygroscopic solid which was filtered and immediately dried under vacumm: F. D. Mass: m/e 337 ($M^-$ for $C_{17}H_{25}N_2O_3S^-$); characteristic peaks of $^1H$ NMR ($CDCl_3$): δ1.06 (t, 3H), 1.19 (t, 3H), 2.49 (t, 2H), 2.56 (m, 4H), 3.28 (t, 2H), 3.3 (buried broad t, 1H), 3.31 (s, 2H), 3.52 (t, 2H) 6.65 (d, 2H), 7.11 (d, 2H).;

Preparation of Comparative Compound Comp-6 (Table J)

A mixture of 2-chloroethyl ethyl sulfide (7.48 g, 0.06 mol), ethyl 4-aminophenylacetate (5.30 g, 0.03 mol), 2,6-lutidine (6.43 g, 0.06 mol) and butyronitrile (25 mL) were stirred at reflux for 16 h. Additional 2-chloroethyl ethyl sulfide (3.74 g, 0.03 mol) and 2,6-lutidine (3.21 g, 0.03 mol) were added and the mixture stirred at reflux for an additional 3 h. Lutidine hydrochloride was removed by filtration and the filtrate concentrated in vacuo at 90° C. to give an oil (9 g). The oil was chromatographed through silica gel (80 ligroin/20 ethyl acetate) to give a fraction rich in the desired ethyl 2-(4-N,N-bis(ethylthioethyl)aminophenyl)acetate and the monoalkylated product, ethyl 2-(4-N-ethylthioethylaminophenyl)acetate. A second chromatography through silica gel (50 heptane/50 ethyl acetate) gave the desired, pure Comp-6.

Preparation of S-17, Sodium 2-(4-N,N-bis (ethylthioethyl)aminophenyl)acetate

A mixture of Comp-6 ethyl 2-(4-N,N-bis(ethylthioethyl) aminophenyl)acetate (0.5 g, 1.4 mmol), sodium hydroxide (0.1 g, 2.5 mmol), methanol (20 mL) and water (20 mL) were stirred at reflux to 16 h. The mixture was concentrated in vacuo at 60° C. The material was dissolved in water (20 mL) and the resulting solution extracted with diethyl ether (20 mL) and the ether extract discarded. The aqueous layer was treated with silica gel and filtered. The filtrate was concentrated in vacuo at 50° C. to give a solid. The solid was sonicated with acetonitrile (3×30 mL) and the desired sodium salt of S-17 was collected and dried in vacuo at 50° C. Proton and carbon NMR, as well as mass spectrometry, were consistent with the desired structure of S-17.

Compound TU-2 was synthesized by the reaction sequence in Scheme V

SCHEME V

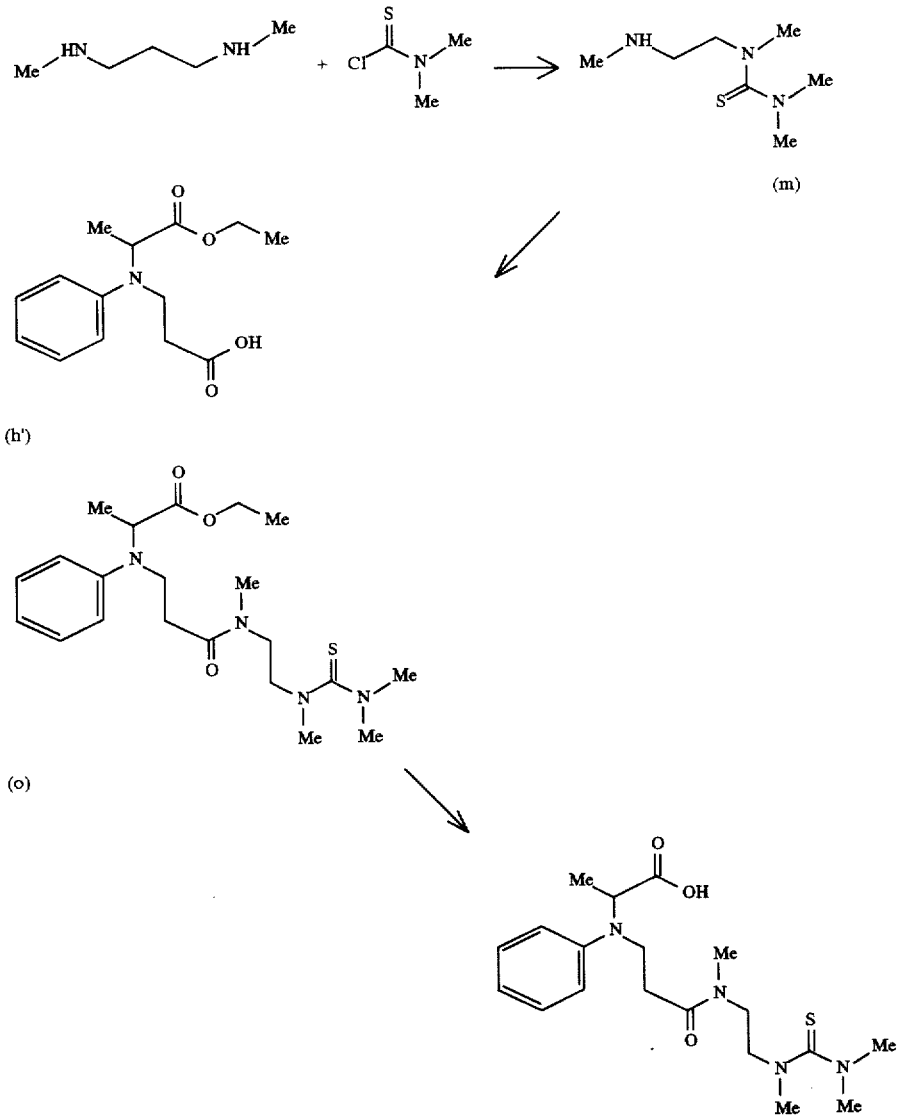

Preparation of TU-2

A solution of dimethylcarbamoyl chloride (24.72 g, 0.2 mol) and tetrahydrofuran THF (100 mL) was added over 4 h to N,N'-dimethylethylenediamine (52.9 g, 0.6 mol). The reaction temperature was maintained between (−2° C.) and (+2° C.) by external cooling. The reaction mixture was then stirred at 25° C. for 16 h. The reaction mixture was then concentrated in vacuo at 70° C. to give an oil (55 g). Dichloromethane (400 mL) was added to the oil to precipitate a salt (16 g) which was discarded. The filtrate was concentrated in vacuo at 80° C. to give an oil (37 g). Flash chromatography (95 dichloromethane/5 methanol) through silica gel gave first the symmetrical dithiourea. Further elution (90 dichloromethane/10 methanol) gave the pure, desired monothiourea (10 g, 28% yield), intermediate (m).

$^1$H NMR (300 MHz, $CDCl_3$) δ: 2.16 (s, 1H), 2.44 (s, 3H), 2.87 (t, 2H), 3.06 (s, 3H), 3.09 (s, 6H), 3.71 (t, 2H).

To a mixture of 2-chloro-N-methylpyridinium iodide (3.38 g, 13.2 mmol) and dichloromethane (20 mL) was added a solution of intermediate (h') (3.33 g, 12.6 mmol) and dichloromethane (10 mL), followed by tributylamine (2.44 g, 13.2 mmol). The mixture was stirred at reflux for 1 h and then cooled to 25° C. Additional tributylamine (2.44 g, 13.2 mmol) was added followed by a solution of intermediate (m) (2.20 g, 12.6 mmol) and dichloromethane (20 mL). The mixture was stirred at reflux for 1 h and then filtered to remove a small amount of salt. The dichloromethane filtrate was washed with water (2×50 mL), then with 5% HCl (2×50 mL). The dichloromethane solution was dried with magnesium sulfate and concentrated in vacuo to give an oil (9 g). Flash chromatography (silica gel: dichloromethane 95/methanol 5) gave a mixture (4 g) determined by NMR (300 MHz $CDCl_3$) to be the desired ester intermediate (o) (35 mole %) and tributylamine (65 mole %). The constituents of this mixture were confirmed by $^{13}$C NMR (75 MHz, $CDCl_3$) and mass spectrometry.

A mixture of intermediate (o)/butylamine (1 g), sodium hydroxide (0.1 g, 2.5 mmol), methanol (10 mL) and water (10 mL) were stirred at reflux for 16 h. The pH fell from ca. 12 to 9. The mixture was concentrated to an oil, dissolved in water (20 mL) and washed with diethyl ether (3×20 mL). The ether extracts were discarded. The aqueous fraction was concentrated and the free acid (390 mg) TU-2 was obtained by flash chromatography (silica gel: dichloromethane/methanol, 90:10 to 50:50).

$^1$H NMR (300 MHz, $CDCl_3$) $^{13}$C NMR (75 MHz, $CDCl_3$), mass spectrometry and HPLC supported the structure.

Preparation of TU-4

Compound TU-4 was synthesized by the reaction sequence in Scheme VI. Intermediate (m) was prepared as described in the synthesis of TU-2. Intermediate (p) was prepared by adding 50 g of ethyl-2-bromoproprionate to a stirred suspension of 21.4 g of aniline and 4.6 g of potassium carbonate in 300 mL of acetonitrile under a nitrogen atmosphere. The reaction mixture was refluxed under nitrogen for 2 days, the solution was cooled, and the salt was filtered out. The filtrate was poured into dichloromethane and washed with aqueous sodium bicarbonate solution, then washed with water. Anhydrous sodium sulfate was added and then the dichloromethane solution was filtered. The filtrate was distilled under vacuum to give a colorless oil. 37.2 g of this oil was added to 200 mL of acetonitrile together with 4.72 g of potassium carbonate and heated to reflux under nitrogen for 0.5 h. 41. 7 g of ethyl bromoacetate was then added and the mixture was refluxed for 6 days. The mixture was then cooled, and the salt was filtered. The product was taken up in dichloromethane, washed with aqueous sodium bicarbonate solution, washed again with water, dried over anhydrous sodium sulfate, and filtered. The filtrate was concentrated and distilled to give 20.8 g of the desired aniline diester. The diester (5.6 g, 0.02 mol) was added to a solution of chlorosulfonic acid (11.6 g, 0.1 mol) in dichloromethane (50 mL) and stirred at 25° C. of 8 h, and then at reflux for 4 h. Thionyl chloride (11.8 g, 0.1 mol) was added and the mixture heated at reflux for another 4 h. The mixture was carefully added to ice water. The aqueous layer was discarded and the dichloromethane layer concentrated at reduced pressure to give an oil. This oil was extracted into diethyl ether (50 mL) and the organic layer washed five times with 30% aqueous sodium chloride. A trace of sodium bicarbonate added to the ether layer, and this solution simultaneously treated with magnesium sulfate and silica gel (ICN 04530). The ether was removed at reduced pressure to give the sulfonyl chloride (82% yield, 6.2 g) intermediate (p).

Intermediate (q) was prepared by mixing a solution of the sulfonyl chloride (3.78 g, 10 mmol), dichloromethane (15 mL) and THF (15 mL) with a solution of intermediate (m) (1.75 g, 10 mmol), tributylamine (1.85 g, 10 mmol), dichloromethane (20 mL) and THF (20 mL). The mixture was stirred at reflux for 1 h. Since the reaction pH was ca. 6.5, additional tributylamine (0.2 g, 1 mmol) was added and the reaction mixture stirred for 16 h at 25° C. The reaction mixture was concentrated in vacuo to an oil. The oil was dissolved in diethyl ether (100 mL) and washed with water (100 mL), then with dilute HCl (100 mL, 0.4%) and finally with 30% brine (100 mL, containing 0.4% HCl). The ether layer was dried with magnesium sulfate and concentrated to an amber oil (5 g). Flash chromatography (silica gel: ligroin/ethyl acetate 50/50 to 40/60) gave the pure intermediate (q) (2.9 g, 56% yield).

$^1$H NMR (300 MHz, $CDCl_3$ ), mass spectrometry and HPLC supported the structure.

$^{13}$C NMR (75 MHz, $CDCl_3$) δ14.2, 15.9, 35.4, 41.6, 43.3, 47.8, 49.3, 52.4, 56.2, 61.4, 112.4, 125.5, 129.1, 151.6, 170.6, 172.4, 193.8.

Intermediate (q) (2.2 g, 4 mmol), sodium hydroxide (0.55 g, 13.4 mmol), methanol (20 mL) and water (20 mL) were stirred at reflux for 32 h. The mixture was concentrated in vacuo to an oily solid. The oily solid was dissolved in water (15 mL) and washed with diethyl ether (20 mL). The ether layer was discarded. A few drops of 37% HCl were added to the aqueous layer to lower the pH from ca. 11 to 7. The aqueous layer was filtered through silica gel and concentrated in vacuo at 90° C. to a solid (1.5 g). The solid was slurried in acetonitrile, collected and dried in vacuo at 60° C. to give the white solid (1.4 g, 69% yield), compound TU-4.

$^1$H NMR (300 MHz, $D_2O$), δ: 1.35 (bd, 3H), 2.55 (bs, 3H), 2.92 (bs, 3H), 2.96 (bs, 6H), 3.11 (bt, 2H), 3.72 (bt, 2H), 3.78 (bd, 1H), 4.00 (bd, 1H), 4.15 (bq, 1H), 4.55 (s, HOD), 6.55 (bd, 2H), 7.50 (bd, 2H).

SCHEME VI

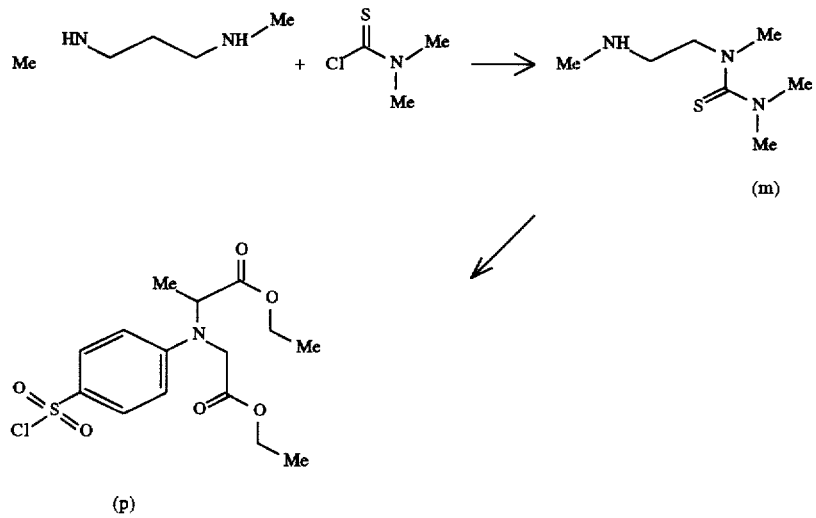

-continued

SCHEME VI

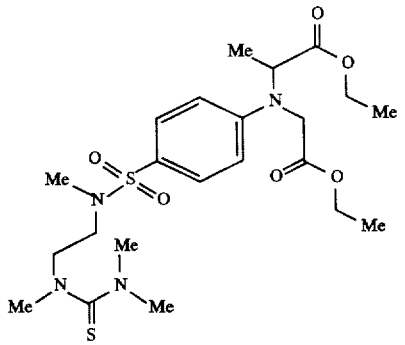

(q)

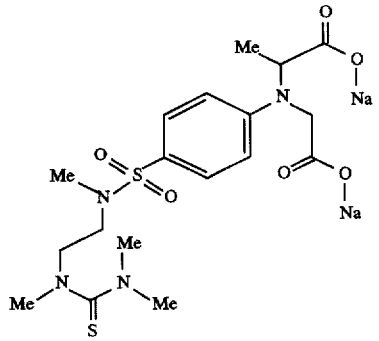

TU-4

Examples illustrating the beneficial use of these fragmentable electron donors in silver halide emulsions are given in the following:

EXAMPLE 1

An AgBrI tabular silver halide emulsion (Emulsion T-1) was prepared containing 4.05% total I distributed such that the central portion of the emulsion grains contained 1.5% I and the perimeter area contained substantially higher I, as described by Chang et al, U.S. Pat. No. 5,314,793. The emulsion grains had an average thickness of 0.123 μm and average circular diameter of 1.23 μm. The emulsion was sulfur sensitized by adding $1.2\times10^{-5}$ mole /Ag mole of (1,3-dicarboxymethyl-1,3-dimethyl-2-thiourea) at 40° C., the temperature was then raised to 60° C. at a rate of 5° C./3 min and the emulsion held for 20 min before cooling to 40° C. This chemically sensitized emulsion was then used to prepare the experimental coating variations indicated in Table I. All of the experimental coating variations in Table I contained the hydroxybenzene 2,4-disulfocatechol (HB3) at a concentration of 13 mmole/mole Ag, added to the melt before the addition of any further addenda. The fragmentable electron donor compounds as indicated in Table I were added from an aqueous potassium bromide solution, or from a methanol solution, before additional water, gelatin, and surfactant were added to the emulsion melts. At the time of donor addition, the emulsion melts had a VAg of 85–90 mV and a pH of 6.0. After 5 min at 40° C., an additional volume of 4.3% gelatin was then added to give a final emulsion melt that contained 216 grams of gel per mole of silver. These emulsion melts were coated onto an acetate film base at 1.61 g/m$^2$ of Ag with gelatin at 3.23 g/m$^2$. The coatings were prepared with a protective overcoat which contained gelatin at 1.08 g/m2, coating surfactants, and a bisvinyl methyl ether as a gelatin hardening agent.

For photographic evaluation, each of the coating strips was exposed for 0.1 sec to a 365 nm emission line of a Hg lamp filtered through a Kodak Wratten filter number 18A and a step wedge ranging in density from 0 to 4 density units in 0.2 density steps. The exposed film strips were developed for 6 min in Kodak Rapid X-ray Developer (KRX). $S_{365}$, relative sensitivity at 365 nm, was evaluated at a density of 0.2 units above fog.

The data in Table I compare the results for fragmentable electron donor compounds that contain a silver halide adsorbing group to compounds that do not contain an adsorbing functional group. The inventive compounds S-3 and S-8 contain a thioether group as a silver halide adsorbing moiety, whereas the comparison compounds Comp-1 and Comp-2 contain a simple alkyl group in place of the adsorbing functional group. Each of the compounds S-3 and S-8, Comp-1 and Comp-2 contains a fragmentable electron donor moiety XY. The data of Table I shows that all of these compounds give a speed gain on this emulsion, and this speed gain ranges from a factor of about 1.2 to about 1.4. The optimum concentration at which these speed gains are achieved, however, differs greatly among the compounds and is significantly lower for the compounds that contain the silver halide adsorbing moiety as compared to comparison compounds with no adsorbing group. For the inventive compounds S-3 and S-8 the concentration required to achieve a 1.2 to 1.4 speed gain is only about 2.5% to about 16% of that amount required to achieve the same speed gain for the comparison compounds Comp-1 and Comp-2.

TABLE I

Speed and Fog Results for Compounds on Emulsion T-1

| Comp'd | Compound Type | Amount of Compound ($10^{-3}$ mole/ mole Ag) | $S_{365}$ | Fog | Remarks |
|---|---|---|---|---|---|
| None | — | 0 | 100 | 0.06 | Control |
| S-3 | adsorbable group | 0.011 | 118 | 0.05 | Invention |
| S-3 | adsorbable group | 0.022 | 132 | 0.08 | Invention |
| S-3 | adsorbable group | 0.044 | 129 | 0.22 | Invention |
| Comp-1 | no adsorbable group | 0.44 | 126 | 0.34 | Comparison |
| S-8 | adsorbable group | 0.022 | 126 | 0.08 | Invention |
| S-8 | adsorbable group | 0.07 | 135 | 0.13 | Invention |
| Comp-2 | no adsorbable group | 0.44 | 138 | 0.07 | Comparison |

EXAMPLE 2

The chemically sensitized emulsion T-1 as described in Example 1 was used to prepare coatings containing the fragmentable two-electron donor compound S-1 and S-3 and the comparative compounds Comp-5 and Comp-4, as described in Table II. Compounds S-1 and S-3, the fragmentable two-electron donor compounds, are carboxylic acids which fragment after oxidation. The comparison compounds Comp-5 and Comp-4 are the corresponding esters related to S-1 and S-3 and do not fragment after oxidation. The coatings described in Table II all contain the hydroxybenzene, 2,4-disulfocatechol (HB3) at a concentration of 13 mmole/mole Ag, added to the melt before any further addenda. The fragmentable two-electron donor compounds and comparative compounds were then added to the emulsion and coatings prepared and tested as described in Example 1.

The data in Table II illustrate that the fragmentable two-electron donor compounds S-1 and S-3 gave both speed and fog increases in the undyed T-1 emulsion. At the optimum concentrations of these compounds, speed gains can be obtained at reasonable fog levels. In contrast, the corresponding esters, S-2 and S-4, gave only minimal speed increases and very little fog increase, illustrating the relative inactivity of these compounds.

TABLE II

Speed and Fog Results for Thioether Substituted Electron Donating Compounds in an AgBrI T-grain Emulsion with comparison to corresponding Esters

| Comp'd | Type | $E_1$ (V) | Reactivity of $XY^{+\cdot}$ | Conc. of Comp'd ($10^{-3}$ mole/ mole Ag) | Undyed $S_{365}$ | Undyed Fog |
|---|---|---|---|---|---|---|
| None | | | | | 100 | 0.05 |
| S-1 | invention "acid" | 0.35 | fragments | 0.00220 | — | 0.82 |
| | | | | 0.00070 | 89 | 0.28 |
| | | | | 0.00022 | 107 | 0.06 |
| Comp-5 | comparison "ester" | 0.73 | does not fragment | 0.22000 | 102 | 0.06 |
| | | | | 0.02200 | 102 | 0.07 |

TABLE II-continued

Speed and Fog Results for Thioether Substituted Electron Donating Compounds in an AgBrI T-grain Emulsion with comparison to corresponding Esters

| Comp'd | Type | $E_1$ (V) | Reactivity of $XY^{+\cdot}$ | Conc. of Comp'd ($10^{-3}$ mole/ mole Ag) | Undyed $S_{365}$ | Undyed Fog |
|---|---|---|---|---|---|---|
| | | | | 0.00220 | 102 | 0.06 |
| S-3 | invention "acid" | 0.47 | fragments | 0.22000 | — | 1.24 |
| | | | | 0.07000 | — | 0.57 |
| | | | | 0.02200 | 141 | 0.11 |
| | | | | 0.00700 | 120 | 0.06 |
| | | | | 0.00220 | 110 | 0.07 |
| Comp-4 | comparison "ester" | 0.89 | does not fragment | 0.22000 | 105 | 0.07 |
| | | | | 0.02200 | 102 | 0.06 |
| | | | | 0.00220 | 102 | 0.06 |

EXAMPLE 3

An AgBrI tabular silver halide emulsion (Emulsion T-2) was prepared containing 4.05% total I distributed such that the central portion of the emulsion grains contained 1.5% I and the perimeter area contained substantially higher I, as described by Chang et. al., U.S. Pat. No. 5,314,793. The emulsion grains had an average thickness of 0.116 μm and average circular diameter of 1.21 μm. This emulsion was precipitated using deionized gelatin. The emulsion was sulfur sensitized by adding $8.5\times10^{-6}$ mole 1,3-dicarboxymethyl-1,3-dimethyl-2-thiourea /mole Ag at 40° C.; the temperature was then raised to 60° C. at a rate of 5° C./3 min and the emulsions held for 20 min before cooling to 40° C. The chemically sensitized emulsion was then used to prepare coatings containing the fragmentable two-electron donor compounds. All of the experimental coating variations in Table III contained the hydroxybenzene 2,4-disulfocatechol (HB3) at a concentration of 13 mmole/ mole Ag, added to the melt before the addition of any further addenda. Where present, the blue sensitizing dye D-I or the red sensitizing dye D-II were added from methanol solution to the emulsion at 40° C. after the chemical sensitization and disulfocatechol addition. The fragmentable two-electron donor compounds were added to the emulsion at 40° C. and the coatings were prepared and tested as described in Example 1, except that the additional gelatin used to prepare the coatings described in Table III was deionized gelatin.

Additional testing was carried out to determine the response of the coatings described in Table III to a spectral exposure. Each of the coating strips was exposed for 0.1 sec on a wedge spectrographic instrument that covers the wavelength range from 400 to 750 nm. The instrument contains a tungsten light source and a step tablet ranging in density from 0 to 3 density units in 0.3 density steps. After developing exposed strips for 6 min in Kodak Rapid X-ray Developer (KRX), speed was read at 10 nm wavelength intervals at a density of 0.3 above fog. Correction for the instrument's variation in spectral irradiance with wavelength was done with a computer and a plot of log sensitivity vs. wavelength was generated. The relative sensitivity $S_\lambda$ at the wavelength of maximum spectral sensitivity is reported in Table III. For this exposure, for each dye used, the relative sensitivity was set equal to 100 for the control coating with no fragmentable two-electron donor compound added.

The data in Table III show that the fragmentable two-electron donor compounds S-3, S-8, and S-9 gave increases in speed for the undyed emulsion and for the emulsion containing the blue D-I or red D-II spectral sensitizing dye. For the undyed emulsion and for the blue sensitized emulsion sensitivity increases of up to a factor of 1.6 are obtained for the 365 nm exposure relative to the control. These sensitivity increases occur with a slight increase in fog. When the emulsion was dyed with the red sensitizing dye D-II, some loss of sensitivity for a 365 nm exposure was observed, indicating dye desensitization. Addition of the fragmentable two-electron donor compounds S-3, S-8, and S-9 to the red dyed emulsion significantly improved the 365 nm speed to better than or equal to the undyed speed, indicating that the fragmentable two-electron donor compounds are effective in ameliorating dye desensitization. The data in Table III for $S_\lambda$, the sensitivity at the wavelength of maximum spectral sensitivity, also indicate that the sensitivity increases obtained at 365 nm by use of the fragmentable two-electron donating compounds were paralleled by increases in spectral sensitivity. When the compounds were added at optimum concentration, these sensitivity enhancements for the dyed emulsions were obtained with minimal increases in fog.

TABLE III

Dye I

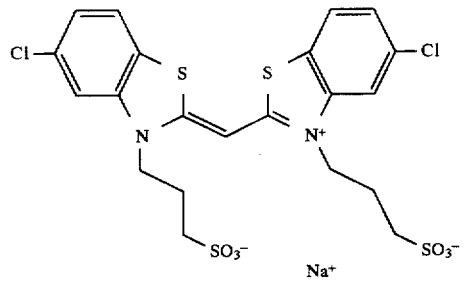

Dye II

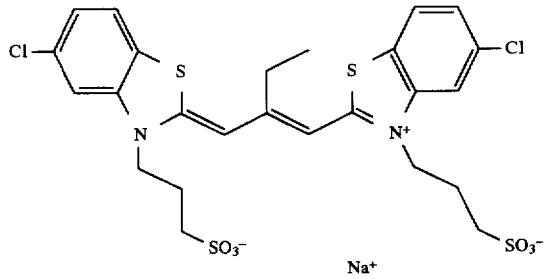

Speed and Fog Results for Compounds on Emulsion T-1:

| Type of Comp'd | $E_1$ (V) | Amount of Compound ($10^{-3}$ mole/mole Ag) | Type of Sensitizing Dye | Amount of Sensitizing Dye ($10^{-3}$ mole/mole Ag) | $S_{365}$ | $S_\lambda$ | Fog |
|---|---|---|---|---|---|---|---|
| None, "Control" | | 0 | none | 0 | 100 | — | 0.05 |
| S-3 | 0.38 | 0.022 | none | 0 | 151 | — | 0.13 |
| S-9 | 0.43 | 0.07 | none | 0 | 166 | — | 0.13 |
| S-8 | 0.45 | 0.07 | none | 0 | 162 | — | 0.13 |
| None | | 0 | I | 0.91 | 105 | 100 | 0.05 |
| S-3 | 0.38 | 0.022 | I | " | 132 | 120 | 0.16 |
| S-9 | 0.43 | 0.022 | I | " | 159 | 126 | 0.08 |
| S-9 | " | 0.07 | I | " | 162 | 138 | 0.13 |
| S-8 | 0.45 | 0.022 | I | " | 118 | 112 | 0.07 |
| S-8 | " | 0.07 | I | " | 120 | 112 | 0.12 |
| None | | 0 | II | 0.86 | 68 | 100 | 0.10 |
| S-3 | 0.38 | 0.0022 | II | " | 120 | 166 | 0.28 |
| S-3 | " | 0.007 | II | " | — | — | 0.75 |
| S-9 | 0.43 | 0.0022 | II | " | 115 | 162 | 0.24 |
| S-9 | " | 0.007 | II | " | 107 | 141 | 0.44 |
| S-8 | 0.45 | 0.0022 | II | " | 97 | 141 | 0.11 |
| S-8 | " | 0.007 | II | " | 112 | 166 | 0.15 |

EXAMPLE 4

The chemically sensitized AgBrI tabular emulsion T-2 as described in Example 3 was used to prepare the experimental coating variations listed in Table IV, comparing various structurally related fragmentable two-electron donating compounds varying in first oxidation potential E1. The blue sensitizing dye D-I was added from methanol solution to the emulsion at 40° C. after the chemical sensitization. The fragmentable two-electron donating compounds were then added to the emulsion and coatings prepared and tested as described in Example 3.

The data in Table IV show that all of the fragmentable two-electron donating compounds gave speed gains on this emulsion. Sensitivity increases range from about a factor 1.3 to 1.7. Some of the compounds, in particular S-9 and S-12, gave modest increases in fog. When compared at similar concentrations, the compounds with the larger value of $E_1$ were generally observed to have the smaller fog increases.

TABLE IV

Speed and Fog Results for Compounds on Emulsion T-2

| Type of Comp'd | $E_1$ (V) | Amount of Compound ($10^{-3}$ mole/mole Ag) | Type of Sensitizing Dye | Amount of Sensitizing Dye ($10^{-3}$ mole/mole Ag) | $S_{365}$ | Fog |
|---|---|---|---|---|---|---|
| None, "Control" | | 0 | I | 0.91 | 100 | 0.05 |
| S-9 | 0.43 | 0.22 | I | " | 129 | 0.21 |
| S-9 | " | 0.44 | I | " | 102 | 0.41 |
| S-9 | " | 0.88 | I | " | — | 0.63 |
| S-12 | 0.51 | 0.22 | I | " | 145 | 0.18 |
| S-12 | " | 0.44 | I | " | 141 | 0.21 |
| S-12 | " | 0.88 | I | " | 138 | 0.29 |
| S-13 | 0.53 | 0.22 | I | " | 151 | 0.10 |
| S-13 | " | 0.44 | I | " | 151 | 0.13 |
| S-13 | " | 0.88 | I | " | 166 | 0.14 |
| S-11 | 0.55 | 0.22 | I | " | 145 | 0.05 |
| S-11 | " | 0.44 | I | " | 145 | 0.06 |
| S-11 | " | 0.88 | I | " | 145 | 0.07 |

EXAMPLE 5

The chemically sensitized AgErI tabular emulsion T-2 as described in Example 3 was used to prepare the experimental coating variations listed in Table V, and compares various fragmentable one-electron donating compounds to structurally related one-electron donating compounds that do not fragment. The inventive and the comparison compounds were added to the emulsion, and coatings prepared and tested as described in Example 1, except that the additional gelatin used to prepare the coatings described in Table V was deionized gelatin and the coatings did not contain disulfocatechol. Where present, the sensitizing dye D-II was added from methanol solution to the emulsion at 40° C. after the chemical sensitization but before the addition of the one-electron donating compound. The coatings were tested for their response to a 365 nm exposure as described in Example 1. For this exposure, the relative sensitivity was set equal to 100 for the control coating with no one-electron donating compound added.

The data in Table V show that the one-electron donating compounds S-17 and S-18, which fragment by a decarboxylation process when oxidized, increased the 365 nm sensitivity of the undyed emulsion, and that this sensitivity gain generally increased with increasing concentration of the one-electron donating compounds. No fog increase, or only a very slight fog increase, was observed for these compounds used with the undyed T-2 emulsion. When the emulsion T-2 was dyed with the red sensitizing dye, a small decrease in 365 nm sensitivity was observed, indicating some dye desensitization. When the one-electron donating compounds were added to the dyed emulsions at optimum concentrations, the 365 nm sensitivity of the emulsions was significantly increased. These data indicate that, under optimum conditions, these one-electron donating compounds can enhance the inherent sensitivity of the emulsion and ameliorate dye desensitization.

In contrast, the comparison compounds Comp-6 and Comp-7, which are derivatives of S-17 and S-18 wherein the carboxylate functional group is replaced by an ethyl ester group, do not undergo a fragmentation reaction when oxidized and give very little or no sensitivity increase to the dyed or undyed emulsions.

The data of Table V also compare the fragmentable one-electron donating compounds S-17 and S-18 to a similar fragmentable one-electron donating compound Comp-8 that does not contain a silver halide adsorbable group. Comp-8 also gives a speed gain on this emulsion of a factor of about 1.3, but the data show that similar speed gains can be obtained at much lower concentrations for the compounds S-17 and S-18 that contain the silver halide adsorbing moiety.

Overall, these data show that one-electron donating compounds that undergo bond fragmentation when oxidized give significantly larger increases in emulsion sensitivity than simple one-electron donating compounds that do not fragment, and that one-electron donating compounds that contain a silver halide adsorbing moiety give sensitivity increases at much lower concentrations than analogous one-electron donating compounds that do not contain an adsorbing moiety.

TABLE V

Comparison of fragmenting vs non-fragmenting 1 electron donors on Emulsion T-2

| Type of Cp'd | $E_1$ (V) | Reactivity of $XY^{+\cdot}$ | Amount of Compound ($10^{-3}$ mole/mole Ag) | Type of Sensitizing Dye | Amount of Sensitizing Dye ($10^{-3}$ mole/mole Ag) | $S_{365}$ | Fog | Remarks |
|---|---|---|---|---|---|---|---|---|
| None | | | 0 | none | 0 | 100 | 0.05 | control |
| S-17 | 0.62 | fragments | 0.044 | none | 0 | 110 | 0.05 | invention |
| S-17 | 0.62 | " | 0.14 | none | 0 | 120 | 0.06 | invention |
| Comp-6 | 0.84 | does not fragment | 0.14 | none | 0 | 85 | 0.05 | comparison |
| S-18 | 0.68 | fragments | 0.044 | none | 0 | 135 | 0.05 | invention |
| S-18 | 0.68 | " | 0.14 | none | 0 | 148 | 0.06 | invention |
| Comp-7 | 0.78 | does not fragment | 0.14 | none | 0 | 110 | 0.09 | comparison |
| Comp-8 | 0.53 | fragments | 0.44 | none | 0 | 126 | 0.05 | comparison |
| None | | — | 0 | D-II | 0.86 | 69 | 0.11 | control |

TABLE V-continued

Comparison of fragmenting vs non-fragmenting 1 electron donors on Emulsion T-2

| Type of Cp'd | $E_1$ (V) | Reactivity of $XY^{+\cdot}$ | Amount of Compound ($10^{-3}$ mole/mole Ag) | Type of Sensitizing Dye | Amount of Sensitizing Dye ($10^{-3}$ mole/mole Ag) | $S_{365}$ | Fog | Remarks |
|---|---|---|---|---|---|---|---|---|
| S-17 | 0.62 | fragments | 0.044 | D-II | 0.86 | 80 | 0.11 | invention |
| S-17 | 0.62 | " | 0.14 | D-II | 0.86 | 89 | 0.11 | invention |
| Comp-6 | 0.89 | does not fragment | 0.14 | D-II | 0.86 | 59 | 0.10 | comparison |
| S-18 | 0.68 | fragments | 0.044 | D-II | 0.86 | 95 | 0.05 | invention |
| S-18 | 0.68 | " | 0.14 | D-II | 0.86 | 107 | 0.06 | invention |
| Comp-7 | 0.78 | does not fragment | 0.14 | D-II | 0.86 | 80 | 0.11 | comparison |

EXAMPLE 6

The chemically sensitized AgErI tabular emulsion T-2 as described in Example 3 was used to prepare the experimental coating variations listed in Table VI, comparing fragmentable electron donating compounds PMT-1 and PMT-2 that contain a phenylmercaptotetrazole as the silver halide adsorbing group. For some of the experimental variations listed in Table VI the red sensitizing dye D-II was added from methanol solution to the emulsion at 40° C. after the chemical sensitization. The fragmentable electron donating compounds were then added to the emulsion and coatings prepared and tested for sensitivity at 365 nm and for spectral sensitivity as described in Example 3.

The data in Table VI show that both of the fragmentable electron donating compounds gave speed gains on this emulsion. For the undyed emulsion sensitivity increases of about a factor of up to 1.9 are obtained for the 365 nm exposure relative to the control. These sensitivity increases are achieved with very low concentrations of PMT-1 or PMT-2, and they occur with a very slight increase in fog. When the emulsion was dyed with the red sensitizing dye D-II, some loss of sensitivity for a 365 nm exposure was observed, indicating dye desensitization. Addition of the fragmentable electron donor compounds PMT-1 or PMT-2 to the red dyed emulsion significantly improved the 365 nm speed to better than or equal to the undyed speed, indicating that the fragmentable electron donor compounds are effective in ameliorating dye desensitization. The data in Table VI for $S_\lambda$, the sensitivity at the wavelength of maximum spectral sensitivity, also indicate that the sensitivity increases obtained at 365 nm by use of the fragmentable electron donor compounds were paralleled by increases in spectral sensitivity. These sensitivity enhancements for the dyed emulsions were obtained with some increases in fog.

TABLE VI

Speed and Fog Results for Compounds on Emulsion T-2

| Type of Comp'd | Amount of Compound ($10^{-3}$ mole/mole Ag) | Type of Sensitizing Dye | Amount of Sensitizing Dye ($10^{-3}$ mole/mole Ag) | $S_{365}$ | $S_\lambda$ | Fog |
|---|---|---|---|---|---|---|
| None | "Control" | none | 0 | 100 | — | 0.06 |
| PMT-1 | 0.006 | none | 0 | 195 | — | 0.08 |
| PMT-1 | 0.017 | none | 0 | 191 | — | 0.13 |
| PMT-2 | 0.005 | none | 0 | 191 | — | 0.06 |
| PMT-2 | 0.016 | none | 0 | 186 | | 0.08 |

TABLE VI-continued

Speed and Fog Results for Compounds on Emulsion T-2

| Type of Comp'd | Amount of Compound ($10^{-3}$ mole/mole Ag) | Type of Sensitizing Dye | Amount of Sensitizing Dye ($10^{-3}$ mole/mole Ag) | $S_{365}$ | $S_\lambda$ | Fog |
|---|---|---|---|---|---|---|
| none | 0 | II | 0.86 | 73 | 100 | 0.11 |
| PMT-1 | 0.0006 | II | " | 97 | 115 | 0.14 |
| PMT-1 | 0.0017 | II | " | 115 | 145 | 0.27 |
| PMT-1 | 0.0055 | II | " | 102 | 126 | 0.53 |
| PMT-2 | 0.0005 | II | " | 102 | 123 | 0.13 |
| PMT-2 | 0.0016 | II | " | 118 | 145 | 0.23 |
| PMT-2 | 0.005 | II | " | 118 | 151 | 0.40 |

EXAMPLE 7

The chemically sensitized AgErI tabular emulsion T-2 as described in Example 3 was used to prepare the experimental coating variations listed in Table VII, except that the hydroxybenzene 2,4-disulfocatechol (HB3) was omitted from some of the coatings in order to demonstrate the beneficial antifoggant effects of HB3. Where present the blue sensitizing dye D-I or the red sensitizing dye D-II were added from methanol solution to the emulsion at 40° C. after the chemical sensitization and disulfocatechol addition. The fragmentable two-electron donating compounds were then added to the emulsion and coatings prepared as described in Example 1, except that the additional gelatin used to prepare the coatings described in Table VII was deionized gelatin. The coatings were tested for their response to a 365 nm exposure as described in Example 1.

The data in Table VII demonstrate that the fog increases that sometimes occur when certain fragmentable two-electron donating compounds are added to an emulsion can be significantly lowered with the use of a hydroxybenzene compound. For the undyed emulsion containing the fragmentable two-electron donating compound S-9 the level of fog can be reduced from 0.21 to 0.13, and for S-8 the fog is reduced from 0.16 to 0.13 using the HB3 compound at $13\times10^{-3}$ mole/mole Ag. Likewise, for the emulsions containing a red or blue spectral sensitizing dye, the level of fog can be lowered by the presence of HB3. Furthermore, the sensitivity $S_{365}$ of the emulsion is not reduced, or only very slightly reduced, by the presence of the hydroxybenzene compound. The coatings containing the combination of hydroxybenzene compound and two-electron donating com pound generally provide greater sensitivity and lower fog than the comparison coatings.

TABLE VII

Speed and Fog Results for Compounds on Emulsion T-2

| Type of Comp'd | Amount of Compound ($10^{-3}$ mole/mole Ag) | Amount of HB3 ($10^{-3}$ mole/mole Ag) | Type of Sens. Dye | Amount of Dye ($10^{-3}$ mole/mole Ag) | $S_{365}$ | Fog |
|---|---|---|---|---|---|---|
| None | 0 | 13 | none | 0 | 100 | 0.05 |
| S-8 | 0.07 | 0 | none | 0 | 159 | 0.16 |
| S-8 | 0.07 | 13 | none | 0 | 162 | 0.13 |
| S-9 | 0.07 | 0 | none | 0 | 170 | 0.21 |
| S-9 | 0.07 | 13 | none | 0 | 166 | 0.13 |
| None | 0 | 13 | I | 0.91 | 105 | 0.05 |
| S-8 | 0.07 | 0 | I | 0.91 | 155 | 0.12 |
| S-8 | 0.07 | 13 | I | 0.91 | 120 | 0.12 |
| S-9 | 0.07 | 0 | I | 0.91 | 159 | 0.19 |
| S-9 | 0.07 | 13 | I | 0.91 | 162 | 0.13 |
| None | 0 | 13 | II | 0.86 | 68 | 0.10 |
| S-8 | 0.007 | 0 | II | 0.86 | 110 | 0.21 |
| S-8 | 0.007 | 13 | II | 0.86 | 112 | 0.15 |
| S-9 | 0.007 | 0 | II | 0.86 | — | 0.77 |
| S-9 | 0.007 | 13 | II | 0.86 | 107 | 0.44 |
| S-9 | 0.0022 | 13 | II | 0.86 | 115 | 0.24 |

EXAMPLE 8

Two cubic emulsions with uniform halide composition were precipitated using deionized gelatin. Emulsion C-1 was a AgErI emulsion with a 3% I content and a cubic edge length of 0.47 μm and emulsion C-2 was an AgBr emulsion with a cubic edge length of 0.52 μm. The emulsions were sulfur sensitized by adding 1,3-dicarboxymethyl-1,3-dimethyl-2-thiourea at 40° C.; the temperature was then raised to 60° C. at a rate of 5° C./3 min and the emulsions held for 20 min before cooling to 40° C. The amounts of the sulfur sensitizing compound used were $1.0\times10^{-5}$ mole/mole Ag for emulsion C-1, and $6.0\times10^{-6}$ mole/mole Ag for emulsion C-2. These emulsions were then used to prepare the experimental coating variations listed in Table VIII. These experimental coating variations contained the hydroxybenzene, 2,4-disulfocatechcol (HB3) at a concentration of 13 mmole/mole Ag, added to the melt before the addition of any further compounds. Some of the variations were then dyed with the sensitizing dye D-II, added from methanol solution. The fragmentable electron donor compounds were then added to the emulsion melts at 40° C. and coatings were prepared and tested as described in Example 1 except that the additional gelatin used to prepare the coatings described in Table VIII was deionized gelatin. Also, the dyed coatings were tested for their response to a spectral exposure as described in Example 3.

The data in Table VIII show that the fragmentable electron donor compounds S-9 and S-11 gave sensitivity increases of approximately a factor of two with little or no increase in fog for both undyed cubic emulsions. When these emulsions were dyed with the red sensitizing dye D-II, the intrinsic sensitivity of the AgBrI emulsion was essentially unchanged while the AgBr emulsion lost a small amount of sensitivity, indicating a slight amount of dye desensitization. When the fragmentable electron donor compounds S-9 and S-11 were added to the dyed emulsions, sensitivity increases of close to a factor of two were again observed for intrinsic 365 nm exposures, eliminating any dye desensitization and increasing the intrinsic sensitivity of these dyed emulsions to a value greater than the sensitivity of the undyed emulsion with no fragmentable electron donor present. In addition, the sensitivity of the dyed coatings to a spectral exposure was increased by nearly a factor of 2. These sensitivity increases for the dyed emulsions were accompanied by very slight increases in fog. These data indicate that these fragmentable electron donor compounds attached to a silver halide adsorbing moiety provide useful sensitivity increases on these cubic emulsions.

TABLE VIII

Thioether substituted electron donors with AgBr and AgBrI Cubic Emulsions

| Emulsion Type | Type of Sensitizing Dye | Amt. of Dye ($10^{-3}$ mol/mol Ag) | Type of Comp'd | Amt. of Comp'd ($10^{-3}$ mol/mol Ag) | $S_{365}$ | $S_{\lambda}$ | Fog |
|---|---|---|---|---|---|---|---|
| C-1 | none | none | none | none | 100 | — | 0.06 |
| C-1 | none | none | S-9 | 0.05 | 229 | — | 0.07 |
| C-1 | none | none | S-9 | 0.16 | 234 | — | 0.07 |
| C-1 | none | none | S-11 | 0.16 | 219 | — | 0.07 |
| C-1 | none | none | S-11 | 0.50 | 234 | — | 0.07 |
| C-1 | II | 0.44 | none | none | 105 | 100 | 0.09 |
| C-1 | II | 0.44 | S-9 | 0.005 | 162 | 145 | 0.18 |
| C-1 | II | 0.44 | S-9 | 0.016 | 191 | 178 | 0.21 |
| C-1 | II | 0.44 | S-11 | 0.05 | 162 | 151 | 0.14 |
| C-1 | II | 0.44 | S-11 | 0.16 | 186 | 178 | 0.16 |
| C-2 | none | none | none | none | 100 | — | 0.06 |
| C-2 | none | none | S-9 | 0.05 | 204 | — | 0.06 |
| C-2 | none | none | S-9 | 0.16 | 209 | — | 0.06 |
| C-2 | none | none | S-11 | 0.16 | 200 | — | 0.06 |
| C-2 | none | none | S-11 | 0.50 | 209 | — | 0.06 |
| C-2 | II | 0.40 | none | none | 76 | 100 | 0.08 |
| C-2 | II | 0.40 | S-9 | 0.005 | 141 | 159 | 0.16 |
| C-2 | II | 0.40 | S-9 | 0.016 | 166 | 195 | 0.19 |
| C-2 | II | 0.40 | S-11 | 0.05 | 145 | 159 | 0.10 |
| C-2 | II | 0.40 | S-11 | 0.16 | 166 | 186 | 0.14 |

EXAMPLE 9

The sulfur sensitized AgBrI tabular emulsion T-2 as described in Example 3 was used to prepare coatings of the fragmentable two-electron donors S-15, S-14, S-13, and S-11, as described in Table IX. All of the experimental coating variations in Table IX contained the hydroxybenzene, 2,4-disulfocatechcol (HB3) at a concentration of 13 mmole/mole Ag, added to the melt before any further addenda. Where present, the red sensitizing dye D-II was added from methanol solution to the emulsion at 40° C. after the chemical sensitization and disulfocatechol addition. The fragmentable two-electron donor compounds were then added to the emulsion and coatings prepared and tested as described in Example I, except that the additional gelatin used to prepare the coatings described in Table IX was deionized gelatin.

The data in Table IX show that the emulsion T-2 suffered some loss in sensitivity to a 365 nm exposure when dyed with the red sensitizing dye D-II, indicating dye desensitization. When the fragmentable two-electron donor compounds S-15, S-14, S-13, or S-11 were added to the dyed emulsion, the 365 nm sensitivity was restored to that of the undyed emulsion, showing that these compounds are effective in ameliorating dye desensitization. These sensitivity increases were obtained with only very small increases in fog. The data for the fragmentable two-electron donor compounds in Table IX can be compared to the data for the fragmentable two-electron donor compounds in Table III of Example III. The compounds in Table IX have more positive first oxidation potentials $E_1$ and were able to eliminate dye desensitization with less fog increase than that caused by the compounds in Table III. This comparison illustrates that fragmentable two-electron donor compounds with more positive first oxidation potentials $E_1$ are preferred for use with red dyed emulsions.

TABLE IX

Thioether substituted compounds on emulsion T-2

| Type of Comp'd | $E_1$(V) | Amt. of Comp'd ($10^{-3}$ mol/mol Ag) | Type of Sensitizing Dye | Amt. of Dye ($10^{-3}$ mol/mol Ag) | $S_{365}$ | Fog |
|---|---|---|---|---|---|---|
| None | | none | none | none | 100 | 0.06 |
| None | | none | II | 0.86 | 62 | 0.11 |
| S-15 | | 0.007 | II | 0.86 | 95 | 0.13 |
| S-15 | | 0.022 | II | 0.86 | 105 | 0.23 |
| S-14 | 0.51 | 0.007 | II | 0.86 | 89 | 0.11 |
| S-14 | | 0.022 | II | 0.86 | 97 | 0.14 |
| S-13 | 0.53 | 0.007 | II | 0.86 | 95 | 0.13 |
| S-13 | | 0.022 | II | 0.86 | 102 | 0.20 |
| S-11 | 0.54 | 0.007 | II | 0.86 | 87 | 0.12 |
| S-11 | | 0.022 | II | 0.86 | 100 | 0.13 |

EXAMPLE 10

The AgBrI tabular silver halide emulsion T-2 from Example 3 was optimally chemically and spectrally sensitized by adding NaSCN, 1.07 mmole of the blue sensitizing dye D-I per mole of silver, $Na_3Au(S_2O_3)_2 \cdot 2H_2O$, $Na_2S_2O_3 \cdot 5H_2O$, and a benzothiazolium finish modifier and then subjecting the emulsion to a heat cycle to 65° C. The hydroxybenzene, 2,4-disulfocatechcol (HB3) at a concentration of $13 \times 10^{-3}$ mole/mole Ag was added to the emulsion melt before the start of the chemical sensitization procedure. This chemically sensitized emulsion was then used to prepare the experimental coating variations given in Table X. For all the variations in Table X, the antifoggant and stabilizer tetraazaindene (TAI) was added to the emulsion melt in an amount of 1.75 g/mole Ag before any further addenda. The fragmentable two-electron donors S-3, S-9, S-6, or S-8 were then added to the emulsion melt.

The melts were prepared for coating by adding additional water, deionized gelatin and coating surfactants. Coatings were prepared by combining the emulsion melts with a melt containing deionized gelatin and an aqueous dispersion of the cyan-forming color coupler CC-1 and coating the resulting mixture on acetate support. The final coatings contained Ag at 0.81 g/m$^2$, coupler at 1.61 g/m$^2$, and gelatin at 3.23 g/m$^2$. The coatings were overcoated with a protective layer containing gelatin at 1.08 g/m$^2$, coating surfactants, and a bisvinylsulfonylmethyl ether as a gelatin hardening agent. The structure of the color coupler CC-1 is given below:

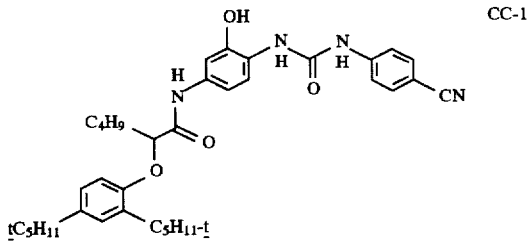

CC-1

For photographic evaluation, each of the coating strips was exposed for 0.01 sec to a 3000K color temperature tungsten lamp filtered to give an effective color temperature of 5500K and further filtered through a Kodak Wratten filter number 2B, and a step wedge ranging in density from 0 to 4 density units in 0.20 density steps. This exposure gives light absorbed mainly by the blue sensitizing dye. The exposed film strips were developed for 3¼ minutes in Kodak C-41 color developer. $S_{WR2B}$, relative sensitivity for this filtered exposure, was evaluated at a cyan density of 0.15 units above fog.

The data in Table X show that these fragmentable two-electron donor compounds give speed increases ranging from 1.1 to 1.8 X when added to this fully sensitized, blue dyed emulsion and coated in color format. These speed increases are obtained with only very small increases in fog.

TABLE X

Speed and fog results for combinations of thioether substituted electron donors with a blue sensitized AgBrI T-grain Emulsion T-2 COLOR FORMAT

| Test No. | Type of Compound | $E_1$(V) | Amount of comp'd added ($10^{-3}$ mol/mol Ag) | Photographic Sensitivity $S_{WR2B}$ | Fog | Remarks |
|---|---|---|---|---|---|---|
| 1 | | | none | 100 | 0.14 | comparison |
| 2 | S-3 | 0.38 | 0.022 | 97 | 0.14 | invention |
| 3 | S-3 | | 0.07 | 110 | 0.19 | invention |
| 4 | S-9 | 0.43 | 0.022 | 162 | 0.16 | invention |
| 5 | S-9 | | 0.07 | 182 | 0.19 | invention |
| 6 | S-6 | 0.45 | 0.022 | 120 | 0.14 | invention |

TABLE X-continued

Speed and fog results for combinations of thioether substituted electron donors with a blue sensitized AgBrI T-grain Emulsion T-2 COLOR FORMAT

| Test No. | Type of Compound | $E_1$(V) | Amount of comp'd added ($10^{-3}$ mol/mol Ag) | Photographic Sensitivity $S_{WR2B}$ | Fog | Remarks |
|---|---|---|---|---|---|---|
| 7 | S-6 | | 0.07 | 126 | 0.21 | invention |
| 8 | S-8 | 0.45 | 0.022 | 107 | 0.14 | invention |
| 9 | S-8 | | 0.07 | 110 | 0.23 | invention |

EXAMPLE 11

The AgBrI tabular emulsion T-2 as described in Example 3 was sensitized as described in Example 10 except that the hydroxybenzene HB3 was added at the completion of the chemical sensitization procedure. This chemically sensitized emulsion was then used to prepare the experimental coating variations given in Table XI. For all the variations in Table XI, the antifoggant and stabilizer tetraazaindene (TAI) was added to the emulsion melt in an amount of 1.75 g/mole Ag before any further addenda. The fragmentable two-electron donors S-12, S-14, S-13, or S-11 were then added to the emulsion melt. The melts were then coated and tested as described in Example 10.

The data in Table XI show that these fragmentable two-electron donor compounds give speed increases ranging from 1.7 to 2.1 X when added to this fully sensitized, blue dyed emulsion and coated in color format. These speed increases are obtained with only very small increases in fog. When compared to the fragmentable two-electron donors given in Table X, the fragmentable electron donors listed in Table XI have more positive first oxidation potentials $E_1$ and require larger amounts of compound to be added to the emulsion to obtain the optimum speed increase. In addition, these fragmentable two-electron donors with more positive values of $E_1$ give larger speed increases with smaller fog increases than the compounds with less positive values of $E_1$ listed in Table X.

TABLE XI

Speed and fog results for combinations of thioether substituted electron donors with a blue sensitized AgBrI T-grain Emulsion T-2 COLOR FORMAT

| Test No. | Type of Compound | $E_1$ (V) | Amount of comp'd added ($10^{-3}$ mol/molAg) | Photographic Sensitivity $S_{WR2B}$ | Fog | Remarks |
|---|---|---|---|---|---|---|
| 1 | | | none | 100 | 0.08 | comparison |
| 2 | S-12 | 0.51 | 0.22 | 191 | 0.11 | invention |
| 3 | S-12 | | 0.44 | 204 | 0.16 | invention |
| 4 | S-14 | 0.51 | 0.22 | 170 | 0.09 | invention |
| 5 | S-14 | | 0.44 | 178 | 0.09 | invention |
| 6 | S-13 | 0.53 | 0.22 | 204 | 0.10 | invention |
| 7 | S-13 | | 0.44 | 209 | 0.16 | invention |
| 8 | S-11 | 0.54 | 0.22 | 166 | 0.10 | invention |
| 9 | S-11 | | 0.44 | 178 | 0.09 | invention |

EXAMPLE 12

The AgBrI tabular emulsion T-2 as described in Example 3 was sensitized as described in Example 10 except that the hydroxybenzene HB3 was added at the completion of the chemical sensitization procedure. This chemically sensitized emulsion was then used to prepare the experimental coating variations given in Table XII. For all the variations in Table XII, the antifoggant and stabilizer tetraazaindene (TAI) was added to the emulsion melt in an amount of 1.75 g/mole Ag before any further addenda. The fragmentable electron donors PMT-1 or PMT-2 were then added to the emulsion melt. These compounds contain a phenylmercaptotetrazole as the silver halide adsorbing group. The melts were then coated and tested as described in Example 10.

The data in Table XII show that these fragmentable electron donor compounds give speed increases ranging from 1.4 to 1.9 X when added to this fully sensitized, blue dyed emulsion and coated in color format. These speed increases are obtained at very low concentrations of added compound and with only very small increases in fog.

TABLE XII

Speed and fog results for combinations of PMT substituted electron donors with a blue sensitized AgBrI T-grain Emulsion T-2 COLOR FORMAT

| Test No. | Type of Compound | Amount of comp'd added ($10^{-6}$ mol/mol Ag) | Photographic Sensitivity $S_{WR2B}$ | Fog | Remarks |
|---|---|---|---|---|---|
| 1 | | none | 100 | 0.08 | comparison |
| 2 | PMT-1 | 0.5 | 138 | 0.09 | invention |
| 3 | PMT-1 | 1.5 | 166 | 0.15 | invention |

TABLE XII-continued

Speed and fog results for combinations of PMT substituted electron donors with a blue sensitized AgBrI T-grain Emulsion T-2 COLOR FORMAT

| Test No. | Type of Compound | Amount of comp'd added ($10^{-6}$ mol/mol Ag) | Photographic Sensitivity $S_{WR2B}$ | Fog | Remarks |
|---|---|---|---|---|---|
| 4 | PMT-2 | 0.5 | 141 | 0.09 | invention |
| 5 | PMT-2 | 1.4 | 166 | 0.10 | invention |
| 6 | PMT-2 | 4.5 | 191 | 0.16 | invention |

EXAMPLE 13

A chloride containing cubic emulsion with uniform halide distribution was precipitated using deionized gelatin. Emulsion C-3 was an AgClI emulsion with a 1.5% I content and a cubic edge length of 0.36 μm. The emulsion was chemically sensitized by adding 15 mg of $Au_2S$/mole Ag using a gelatin dispersion. The chemical sensitizer was added to the emulsion at 40° C., the temperature was then raised to 60° C. and the emulsion held for 20 min before cooling back to 40° C. This chemically sensitized emulsion was then used to prepare the experimental coating variations listed in Table XIII. These experimental coating variations contained the hydroxybenzene, 2,4-disulfocatechcol (HB3) at a concentration of 13 mmole/mole Ag, added to the melt before the addition of any further compounds. Some of the variations were then dyed with the sensitizing dye D-I, added from methanol solution. The fragmentable electron donor compound S-9 was then added to the emulsion melts at 40° C. and coatings were prepared and tested as described in Example 1 except that the additional gelatin used to prepare the coatings described in Table XIII was deionized gelatin.

The data in Table XIII demonstrate that the fragmentable electron donor S-9 gave a speed increase of 1.2 X for the undyed, chemically sensitized AgClI cubic emulsion. When the emulsion was dyed with the blue sensitizing dye D-I, a small decrease in 365 nm sensitivity was noted, indicating dye desensitization. When the fragmentable electron donor S-9 was added to the dyed emulsion, the 365 nm sensitivity increased to be slightly greater than the 365 nm sensitivity of the undyed emulsion with the electron donor compound present. These speed increases are obtained with only small increases in fog. These results indicate that the fragmentable electron donor S-9 can not only ameliorate dye desensitization but also increase the intrinsic sensitivity of this AgClI emulsion in a manner similar to the sensitivity enhancement imparted to the undyed emulsion by this compound. These data indicate that fragmentable electron donor compounds attached to a silver halide adsorbing moiety provide useful sensitivity increases on this cubic AgClI emulsion.

TABLE XIII

Thioether substituted compound S-9 on emulsion C-3

| Type of Comp'd | Amt. of Comp'd ($10^{-3}$ mol/mol Ag) | Type of Sensitizing Dye | Amt. of Dye ($10^{-3}$ mol/mol Ag) | $S_{365}$ | Fog |
|---|---|---|---|---|---|
| None | none | none | none | 100 | 0.06 |
| S-9 | 0.02 | none | none | 118 | 0.15 |

TABLE XIII-continued

Thioether substituted compound S-9 on emulsion C-3

| Type of Comp'd | Amt. of Comp'd ($10^{-3}$ mol/mol Ag) | Type of Sensitizing Dye | Amt. of Dye ($10^{-3}$ mol/mol Ag) | $S_{365}$ | Fog |
|---|---|---|---|---|---|
| None | none | I | 0.61 | 74 | 0.08 |
| S-9 | 0.02 | I | 0.61 | 129 | 0.14 |

EXAMPLE 14

As described in Example 1, the chemically sensitized AgBrI emulsion T-1 was used to prepare a coating with no further addenda. Samples of the coating were exposed to a xenon flash of $10^{-3}$ sec duration filtered through a 2.0 neutral density filter, Kodak Wratten filters 35 and 38A, and a step wedge ranging in density from 0 to 3 density units in 0.15 density steps. These conditions allowed only blue light to expose the coatings. After exposure, one sample of the coating was subjected to each of the following treatments:

A. No post-exposure bath

B. Post-exposure bath for 15 min in a solution of $5.4\times10^{-4}$M NaBr and $3.0'10^{-6}$M S-3 at pH=6.0. (Bath 1)

C. Post-exposure bath for 15 min in a solution of $5.4\times10^{-4}$M NaBr and $1.5\times10^{-5}$M S-3 at pH=6.0. (Bath 2)

The coatings subjected to the post-exposure baths were then rinsed to remove excess solution and all coatings were developed together for 6 min in Kodak Rapid X-ray Developer (KRX). Relative sensitivity to blue light, $S_{blue}$, was evaluated at a density of 0.15 units above fog.

The data in Table XIV show that bathing the fragmentable two-electron donor S-3 into the coating after exposure resulted in sensitivity gains close to 2X relative to the coating that was not subjected to the bathing procedure. The speed gains increased as the concentration of the fragmentable electron donor in the bathing solution was increased. The speed gains were obtained with little or no increase in fog. These data demonstrate that the fragmentable two-electron donor compounds can give beneficial photographic speed effects when added to coatings after exposure.

TABLE XIV

Speed and Fog Results for S-9 Bathed into Coatings after Exposure

| Treatment | Concentration of S-9 in bath | $S_{blue}$ | Fog |
|---|---|---|---|
| A. No Bath | — | 100 | 0.03 |
| B. Bath 1 | $3\times10^{-6}$M | 151 | 0.04 |
| C. Bath 2 | $1.5\times10^{-5}$M | 195 | 0.07 |

EXAMPLE 15

The AgBrI tabular emulsion T-2 as described in Example 3 was sensitized as described in Example 10 except that the hydroxybenzene HB3 was added at the completion of the chemical sensitization procedure. This chemically sensitized emulsion was then used to prepare the experimental coating variations given in Table XV. For all the variations in Table XV the antifoggant and stabilizer tetraaazindene (TAI) was added to the emulsion melt in an amount of 1.75 g/mole Ag before any further addenda. The fragmentable electron donor compounds S-19, PMT-3, and PMT-4 were then added to the emulsion melt. The melts were then coated and tested as described in Example 10.

The data in Table XV show that these fragmentable electron donor compounds give speed increases with little or no fog increase when added to this fully sensitized blue dyed emulsion and coated in color format. The fragmentable electron donors PMT-3 and PMT-4, which contain a phenylmercaptotetrazole as the silver halide adsorptive group, give speed increases at lower concentrations than S-19, which contains a cyclic thioether moiety as the silver halide adsorptive group. PMT-3 and PMT-4 give speed increases ranging from 1.2 to 1.5x that of the comparison (test no. 1).

TABLE XV

Speed and fog results for combinations of thioether substituted electron donors with a blue sensitized AgBrI T-grain Emulsion T-2 in color format

| Test No | Type of compound | Amount of compound added ($10^{-6}$ mol/mol Ag) | Photographic Sensitivity $S_{WR2B}$ | Fog | Remarks |
|---|---|---|---|---|---|
| 1 | none | — | 100 | 0.07 | comparison |
| 2 | PMT-3 | 0.045 | 151 | 0.07 | invention |
| 3 | PMT-3 | 0.14 | 151 | 0.08 | invention |
| 4 | PMT-3 | 0.45 | 141 | 0.07 | invention |
| 5 | PMT-4 | 0.14 | 115 | 0.06 | invention |
| 6 | PMT-4 | 0.45 | 120 | 0.07 | invention |
| 7 | S-19 | 4.4 | 115 | 0.06 | invention |
| 8 | S-19 | 8.8 | 112 | 0.08 | invention |

EXAMPLE 16

The AgBrI tabular emulsion T-2 as described in Example 3 was sensitized as described in Example 10 except that the hydroxybenzene HB3 was added at the completion of the chemical sensitization procedure. This chemically sensitized, blue dyed emulsion was then used to prepare the experimental coating variations listed in Table XVI. For all the variations in Table XVI, the antifoggant and stabilizer tetraazaindene (TAI), was added to the emulsion melt in an amount of 1.75 g/mole Ag before any further addenda. The fragmentable two-electron donor compounds TU-2 and TU-3 were then added to the emulsion melt. The melts were then coated and tested as described in Example 10.

The data in Table XVI show that these fragmentable electron donor compounds with the donor moiety attached to a thiourea adsorbing group give useful speed increases of 1.2X to 1.7X with very little for increase in this fully sensitized emulsion. Because the compound TU-3 contains a fragmentable two-electron donor moiety with a more positive first oxidation potential El than the fragmentable two-electron donor moiety in the compound TU-2, the optimum concentration of TU-3 in the emulsion is higher than the optimum concentration of TU-2.

TABLE XVI

Speed and fog results for combinations of TU-2 and TU-3 with a blue sensitized AgBrI T-grain Emulsion T-2 COLOR FORMAT

| Test No. | Type of Compound | Amount of comp'd added ($10^{-6}$ mol/molAg) | Photographic Sensitivity $S_{WR3B}$ | Fog | Remarks |
|---|---|---|---|---|---|
| 1 | none | none | 100 | 0.07 | control |
| 2 | TU-2 | 0.45 | 118 | 0.08 | invention |
| 3 | TU-2 | 1.4 | 135 | 0.09 | invention |
| 4 | TU-2 | 4.5 | 159 | 0.11 | invention |
| 5 | TU-3 | 14 | 145 | 0.09 | invention |

TABLE XVI-continued

Speed and fog results for combinations of TU-2 and TU-3 with a blue sensitized AgBrI T-grain Emulsion T-2 COLOR FORMAT

| Test No. | Type of Compound | Amount of comp'd added ($10^{-6}$ mol/molAg) | Photographic Sensitivity $S_{WR3B}$ | Fog | Remarks |
|---|---|---|---|---|---|
| 6 | TU-3 | 45 | 155 | 0.09 | invention |
| 7 | TU-3 | 140 | 166 | 0.10 | invention |

The invention has been described in detail with particular reference to preferred embodiments, but it will be understood that variations and modifications can be effected within the spirit and scope of the invention.

What is claimed is:

1. A photographic element comprising at least one silver halide emulsion layer in which the silver halide is sensitized with a compound of the formula:

$$A-(L-XY)_k \quad \text{or} \quad (A-L)_k-XY$$

wherein A is a silver halide adsorptive group that contains at least one atom of N, P, S, Se, or Te that promotes adsorption to silver halide, and L represents a linking group containing at least one C, N, S or O atom, k is 1 or 2 and XY is an fragmentable electron donor moiety in which X is an electron donor group and Y is a leaving group other than hydrogen, and wherein:

1) XY has an oxidation potential between 0 and about 1.4 V; and 2) the oxidized form of XY undergoes a bond cleavage reaction to give the radical $X^{\cdot}$ and the leaving fragment Y.

2. A photographic element comprising at least one silver halide emulsion layer in which the silver halide is sensitized with a compound of the formula:

$$A-(L-XY)_k \quad \text{or} \quad (A-L)_k-XY$$

wherein A is a silver halide adsorptive group that contains at least one atom of N, S, Se, or Te that promotes adsorption to silver halide, and L represents a linking group containing at least one C, N, S or O atom and XY is a fragmentable electron donor moiety in which X is an electron donor group and Y is a leaving group other than hydrogen, and wherein:

1) XY has an oxidation potential between 0 and about 1.4 V;

2) the oxidized form of XY undergoes a bond cleavage reaction to give the radical $X^{\cdot}$ and the leaving fragment Y; and 3) the radical $X^{\cdot}$ has an oxidation potential $\leqq -0.7$ V.

3. A photographic element according to claim 1 or claim 2, wherein A is a silver-ion ligand moiety or a cationic surfactant moiety.

4. A photographic element according to claim 3, wherein A is a silver-ion ligand moiety.

5. A photographic element according to claim 3, wherein A is a cationic surfactant moiety.

6. A photographic element according to claim 5, wherein A is dimethyldodecylsulfonium, tetradecyltrimethylammonium, N-dodecylnicotinic acid betaine, or decamethylenepyridinium ion.

7. A photographic element according to claim 1 or claim 2, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

8. A photographic element according to claim 7, wherein A is selected from sulfur acids and their Se and Te analogs.

9. A photographic element according to claim 8, wherein A is of the formula:

R"—SH or R"'—SH wherein:

R" is an aliphatic, aromatic, or heterocyclic group, which may be substituted with functional groups comprising halogen, oxygen, sulfur or nitrogen atom, and R"' is an aliphatic, aromatic, or heterocyclic group substituted with a $SO_2$ functional group.

10. A photographic element according to claim 9, wherein A is a heterocyclic thiol of the formula:

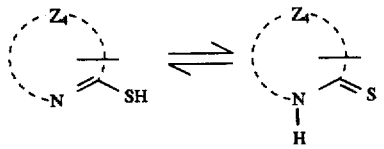

wherein:

$Z_4$ represents the remaining members for completing a 5- or 6-membered ring which may contain one or more additional heteroatoms.

11. A photographic element according to claim 10, wherein the heterocyclic thiol is selected from the group consisting of: mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, phenylmercaptotetrazole, 1,4,5-trimethyl-1,2,4-triazolium 3-thiolate, and 1-methy-4,5,-diphenyl-1,2,4-triazolium-3-thiolate.

12. A photographic element according to claim 7, wherein A is a nitrogen acid of the formula:

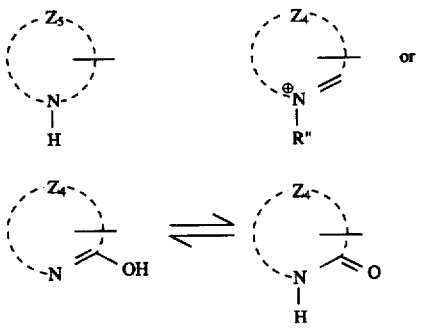

wherein:

$Z_4$ represents the remaining members for completing a 5- or 6-membered ring which may contain one or more additional heteroatoms, $Z_5$ represents the remaining members for completing a preferably 5- or 6-membered ring which contains at least one additional heteroatom such as nitrogen, oxygen, sulfur, selenium or tellurium and is optionally benzo or naptho-condensed, and R" is an aliphatic, aromatic, or heterocyclic group, and may be substituted with functional groups comprising a halogen, oxygen, sulfur or nitrogen atom.

13. A photographic element according to claim 12, wherein the nitrogen acid is selected from the group consisting of heterocyclic nitrogen acids.

14. A photographic element according to claim 12, wherein the nitrogen acid comprises a uracil, tetrazole, benzotriazole, benzothiazole, benzoxazole, adenine, rhodanine, or substituted 1,3,3a,7-tetraazaindene moiety.

15. A photographic element according to claim 7, wherein A is a cyclic and acyclic thioether or a Se or Te analog thereof.

16. A photographic element according to claim 15, wherein A is selected from the group consisting of:

$—(CH_2)_a—S—(CH_2)_b—CH_3$ $—(CH_2)_a—Se—(CH_2)_b—CH_3$ $—(CH_2)_a—Te—(CH_2)_b—CH_3$ $—(CH_2)_a—S—(CH_2)_b—S—(CH_2)_c—CH_3$

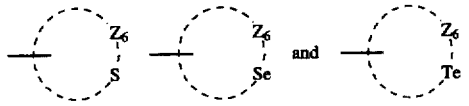

wherein:

a=1–30, b=1–30, c=1–30 with the proviso that a+b+c is ≦to 30, and $Z_6$ represents the remaining members for completing a 5- to 18- membered ring which optionally may contain an additional S, Se, or Te atom.

17. A photographic element according to claim 16, wherein A is $—CH_2CH_2SCH_2CH_3$, 1,10-dithia-4,7,13,16-tetraoxacyclooctadecane, $—CH_2CH_2TeCH_2CH_3$, $—CH_2CH_2SeCH_2CH_3$, $—CH_2CH_2SCH_2CH_2SCH_2CH_3$, or thiomorpholine.

18. A photographic element according to claim 7, wherein A is a phosphine.

19. A photographic element according to claim 18, wherein A is a compound of the formula:

$(R")_3—P$ wherein each R" is independently an aliphatic, aromatic, or heterocyclic group, and may be substituted with functional groups comprising halogen, oxygen, sulfur or nitrogen atoms.

20. A photographic element according to claim 18, wherein A is $P(CH_2CH_2CN)_3$, or m-sulfophenyldimethylphosphine.

21. A photographic element according to claim 7, wherein A is a thionamide, thiosemicarbazide, tellurourea or selenourea of the formula:

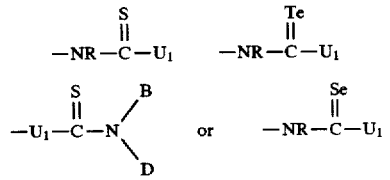

wherein:

$U_1$ represents —$NH_2$, —NHR", —$NR"_2$, —NH—NHR", —SR", OR";

B and D represent R" or, may be linked together to form, the remaining members of a 5- or 6- membered ring; and R" represents an aliphatic, aromatic or heterocyclic group, and R is hydrogen or alkyl or an aryl group.

22. A photographic element according to claim 21, wherein A is a thionamide selected from the group consisting of N,N'-tetraalkylthiourea, N-hydroxyethyl benzthiazoline-2-one, and phenyldimethyldithiocarbamate, and N-substituted thiazoline-2-one.

23. A photographic element according to claim 7, wherein A is a carbon acid of the formula:

$$R''-C\equiv C-H$$

or $$F''-\underset{|}{CH}-G''$$

wherein:

R" is an aliphatic, aromatic, or heterocyclic group, and may be substituted with functional groups based on halogen, oxygen, sulfur or nitrogen atoms and where F" and G" are independently selected from —$CO_2$R", —COR", CHO, CN, $SO_2$R", SOR", and $NO_2$, such that the pKa of the CH is between 5 and 14.

24. A photographic element according to claim 1 or claim 2, wherein A is selected from the group consisting of: an alkyl mercaptan, a cyclic thioether group, an acyclic thioether group, benzothiazole, tetraazaindene, benzotriazole, tetralkylthiourea, and mercapto-substituted hetero ring compounds.

25. A photographic element according to claim 1 or claim 2, wherein A has the structure:

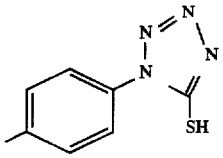

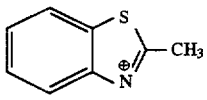

$-(CH_2)_2-S-CH_2CH_3$

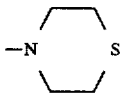

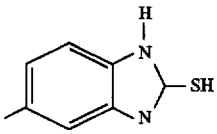

-continued

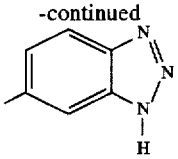

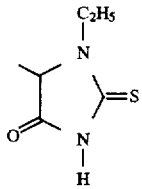

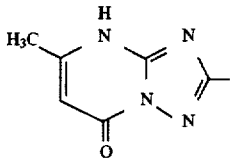

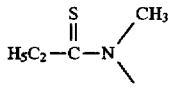

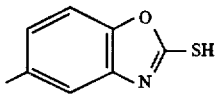

$-(CH_2)_3-Te-CH_2CH_3$
$-CH_2CH_2-SH$
$-CH_2-S-CH_2CH_2-S-CH_2CH_3$

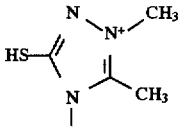

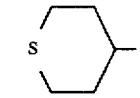

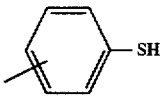

or

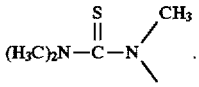

26. A photographic element according to claim 1 or claim 2, wherein L contains an alkylene group, an arylene group, —O—, —S—, —C=O, —$SO_2$—, —NH—, —P=O, or —N=.

27. A photographic element according to claim 26, wherein L comprises a group of the formula:

$$-\overset{O}{\overset{\|}{C}}-(CH_2)_c-,\ -\overset{O}{\overset{\|}{C}}-NH-,\ -SO_2NH-,\ -\overset{O}{\overset{\|}{O}}CNH-$$

$$-NHSO_2NH-,\ -NH\overset{O}{\overset{\|}{C}}NH-,\ -(CH_2)_c\overset{O}{\overset{\|}{C}}NH-,\ -\overset{O}{\overset{\|}{C}}-O-$$

$$-(\text{arylene})-NH\overset{O}{\overset{\|}{C}}ONH-,\ -(\text{arylene})-\overset{O}{\overset{\|}{C}}NH-,\ \text{or}\ -(OCH_2CH_2)_d-$$

where c=1–30, and d =1–10.

28. A photographic element according to claim 26, wherein L is of the formula:

$$-(CH_2)_e-\overset{CH_3}{\overset{|}{N}}-(CH_2)_f- \qquad -(CH_2)_e-SO_2-NH-(CH_2)_f-$$

$$-(CH_2)_e-O-(CH_2)_f- \qquad -(CH_2)_e-CO-NH-(CH_2)_f-$$

$$-(CH_2)_e-\overset{O}{\overset{\|}{C}}-O-(CH_2)_f- \quad \text{or} \quad -(CH_2)_e-$$

e and f=1–30, with the proviso that e+f≦30.

29. A photographic element according to claim 1 or claim 2, wherein X is of formula (I):

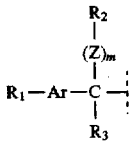

(I)

wherein:

m is 0 or 1;

Z is O, S, Se or Te;

Ar is an aryl group or a heterocyclic group;

$R_1$ is R, carboxyl, amide, sulfonamide, halogen, $NR_2$, $(OH)_n$, $(OR')_n$ or $(SR)_n$; where R' is alkyl or substituted alkyl;

n is 1–3;

$R_2$ is R or Ar';

$R_3$ is R or Ar';

$R_2$ and $R_3$ together can form 5- to 8- membered ring;

$R_2$ and Ar can be linked to form 5- to 8-membered ring;

$R_3$ and Ar can be linked to form 5- to 8-membered ring;

Ar' is an aryl group or a heterocyclic group; and

R is a hydrogen atom or an unsubstituted or substituted alkyl group.

30. A photographic element according to claim 29, wherein X is selected from the group consisting of:

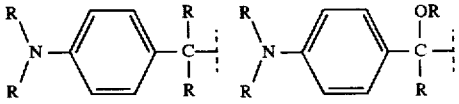

-continued

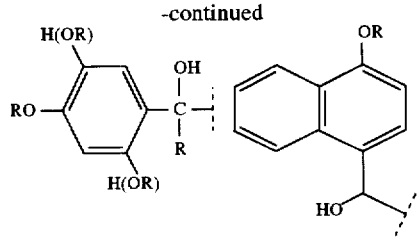

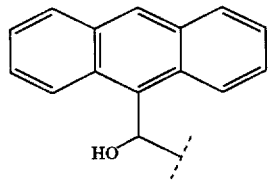

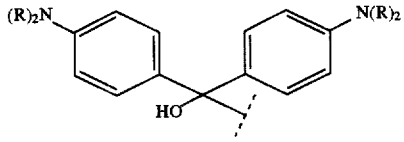

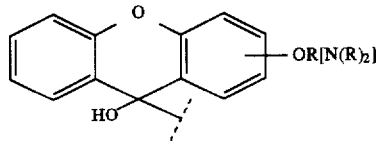

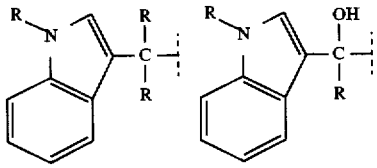

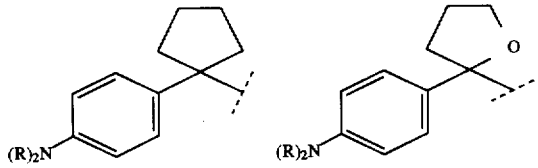

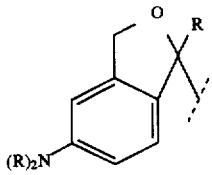

wherein R is a hydrogen atom or a substituted or unsubstituted alkyl group.

31. A photographic element according to claim 1 or claim 2, wherein X is of formula (II):

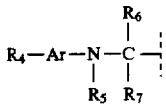

(II)

wherein:

Ar is an aryl group or a heterocyclic group;

$R_4$ is a substituent having a Hammett sigma value of −1 to +1;

$R_5$ is R or Ar';

$R_6$ is R or Ar';

$R_7$ is R or Ar';

$R_5$ and Ar can be linked to form 5- to 8-membered ring;

$R_6$ and Ar can be linked to form 5- to 8-membered ring, in which case $R_6$ can comprise a hetero atom;

$R_5$ and $R_6$ can be linked to form 5- to 8-membered ring;

$R_6$ and $R_7$ can be linked to form 5- to 8-membered ring;

Ar' is an aryl group or a heterocyclic group; and

R is a hydrogen atom or an unsubstituted or substituted alkyl group.

32. A photographic element according to claim 31, wherein X is selected from the group consisting of:

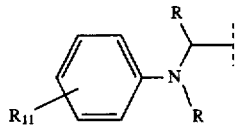

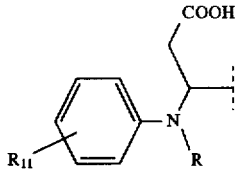

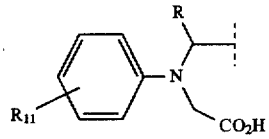

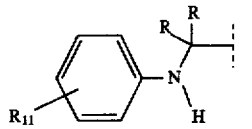

and

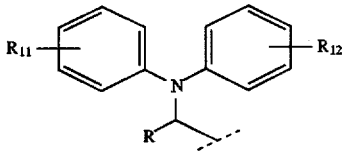

wherein $R_{11}$ and $R_{12}$ are independently H, alkyl, alkoxy, alkylthio, halo, carbamoyl, carboxyl, amido, formyl, sulfonyl, sulfonamido or nitrile and R is a hydrogen atom or an unsubstituted or substituted alkyl group.

33. A photographic element according to claim 31, wherein X is selected from the group consisting of:

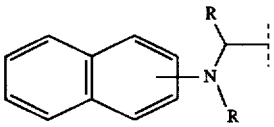

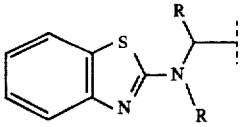

-continued

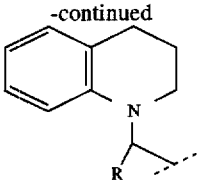

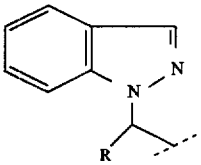

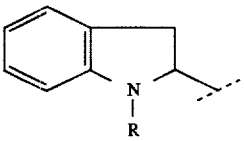

and

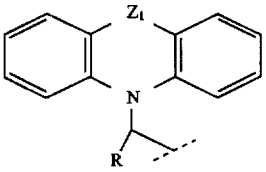

wherein $Z_1$ is covalent bond, S, O, Se, NR, $CR_2$, CR=CR or $CH_2CH_2$ and R is a hydrogen atom or a substituted or unsubstituted alkyl group.

34. A photographic element according to claim 31, wherein X has the structure:

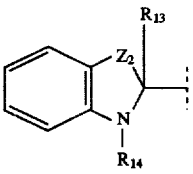

wherein $Z_2$ is S, O, Se, NR, $CR_2$ or CR=CR, and $R_{13}$ is an unsubstituted or substituted alkyl or aryl group, and $R_{14}$ is a hydrogen atom or an unsubstituted or substituted alkyl or aryl group and R is a hydrogen atom or a substituted or unsubstituted alkyl group.

35. A photographic element according to claim 1 or claim 2, wherein X is of formula (III):

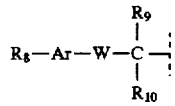

(III)

wherein:

W is O, S or Se;

Ar is an aryl group or a heterocyclic group;

$R_8$ is R, carboxyl, $N(R)_2$, $(OR)_n$, or $(SR)_n$;

n is 1–3;

$R_9$ and $R_{10}$ are independently R or Ar';

$R_9$ and Ar can be linked to form 5- to 8-membered ring;

Ar' is an aryl group or a heterocyclic group; and

R is a hydrogen atom or an unsubstituted or substituted alkyl group.

36. A photographic element according to claim 35, wherein X is selected from the group consisting of:

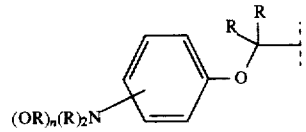

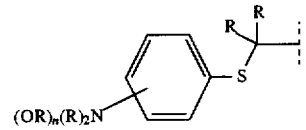

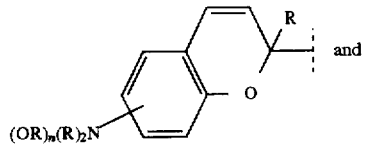

and

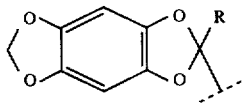

wherein n is 1–3, and R is a hydrogen atom or an unsubstituted or substituted alkyl group.

37. A photographic element according to claim 1 or claim 2, wherein X is of formula (IV):

(IV)

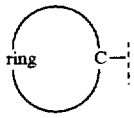

wherein "ring" represents a substituted or unsubstituted 5-, 6- or 7-membered unsaturated ring.

38. A photographic element according to claim 37, wherein X is selected from the group consisting of

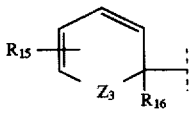

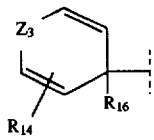

and

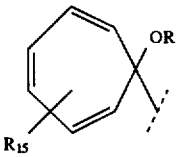

wherein $Z_3$ is O, S, Se or NR; $R_{15}$ is OR or $NR_2$; $R_{16}$ unsubstituted alkyl or substituted alkyl and R is a hydrogen atom or an unsubstituted or substituted alkyl group.

39. A photographic element according to claim 1 or claim 2, wherein Y is:

(1) X', where X' is an X group as defined in structures I–IV and may be the same as or different from the X group to which it is attached

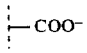

(2)

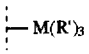

(3)

where M=Si, Sn or Ge; and R'=alkyl or substituted alkyl;

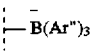

(4)

where Ar"=aryl or substituted aryl and wherein structures I–IV are:

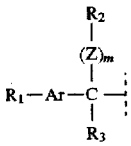

(I)

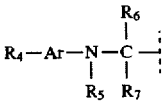

(II)

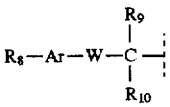

and (III)

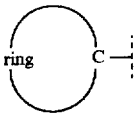

(IV)

wherein in Structure I:

m is 0 or 1;

Z is O, S, Se or Te;

Ar is an aryl group or a heterocyclic group;

$R_1$ is R, carboxyl, amide, sulfonamide, halogen, $NR_2$, $(OH)_n$, $(OR')_n$ or $(SR)_n$; where R' is alkyl or substituted alkyl;

n is 1–3;

$R_2$ is R or Ar';

$R_3$ is R or Ar';

$R_2$ and $R_3$ together can form 5- to 8- membered ring;

$R_2$ and Ar can be linked to form 5- to 8- membered ring;

$R_3$ and Ar can be linked to form 5- to 8- membered ring;

Ar' is an aryl group or a heterocyclic group; and

R is a hydrogen atom or an unsubstituted or substituted alkyl group; wherein in structure II:

Ar is an aryl group or a heterocyclic group;

$R_4$ is a substituent having a Hammett sigma value of −1 to +1;

$R_5$ is R or Ar';

$R_6$is R or Ar';

$R_7$is R or Ar';

$R_5$ and Ar can be linked to form 5- to 8- membered ring;

$R_6$ and Ar can be linked to form 5- to 8- membered ring, in which case $R_6$ can comprise a hetero atom;

$R_5$ and $R_6$ can be linked to form 5- to 8- membered ring;

$R_6$ and $R_7$ can be linked to form 5- to 8- membered ring;

Ar' is an aryl group or a heterocyclic group; and

R is a hydrogen atom or an unsubstituted or substituted alkyl group;

wherein in structure III:

W is O, S or Se;

Ar is an aryl group or a heterocyclic group;

$R_8$ is R, carboxyl, $NR_2$, $(OR)_n$, or $(SR)_n$;

n is 1–3;

$R_9$ and $R_{10}$ are independently R or Ar';

$R_9$ and Ar can be linked to form 5- to 8- membered ring; Ar' is an aryl group or a heterocyclic group; and R is a hydrogen atom or an unsubstituted or substituted alkyl group; and wherein in structure IV:

"ring" represents a substituted or unsubstituted 5-, 6- or 7-membered unsaturated ring.

40. A photographic element according to claim 39, wherein Y is $COO^-$, $Si(R')_3$ or X'.

41. A photographic element according to claim 40, wherein Y is $COO^-$ or $Si(R')_3$.

42. A photographic element according to claim 1 or claim 2, wherein k=1 and A-L-XY is a compound of the formula:

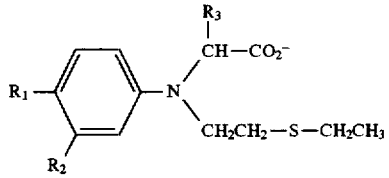

where $R_1$ and $R_2$ are each independently H, alkyl, alkoxy, alkylthio, halo, carbamoyl, carboxyl, amide, formyl, sulfonyl, sulfonamide or nitrile; $R_3$ is H, alkyl or $CH_2CO_2$—.

43. A photographic element according to claim 1 or claim 2, wherein the compound of the formula $A\text{-}(L\text{-}XY)_k$ or $(A\text{-}L)_k\text{-}XY$ is of the formula:

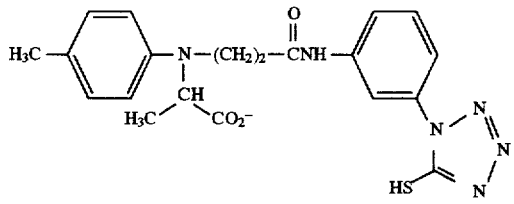

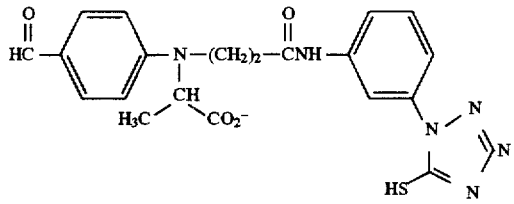

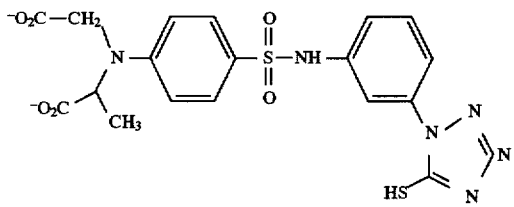

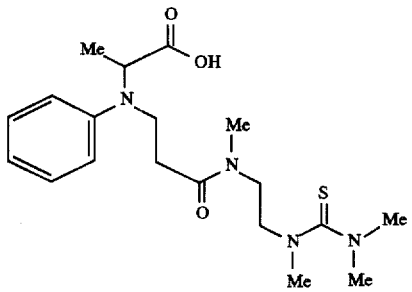

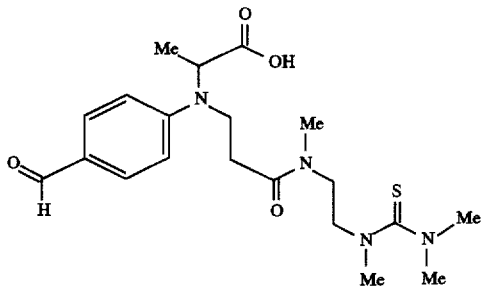

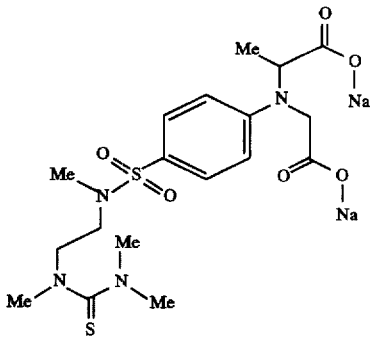

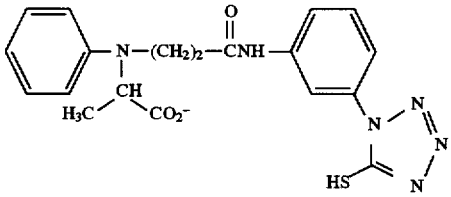

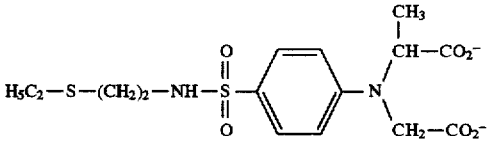

-continued
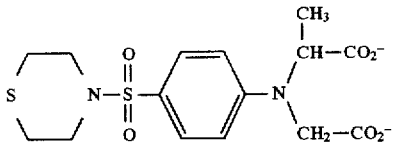
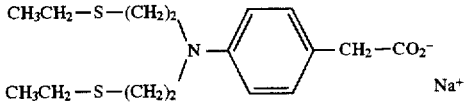
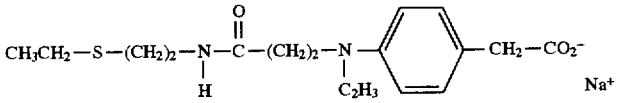
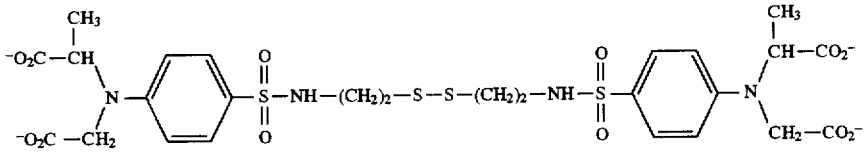
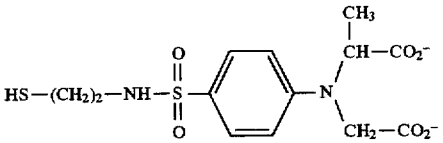
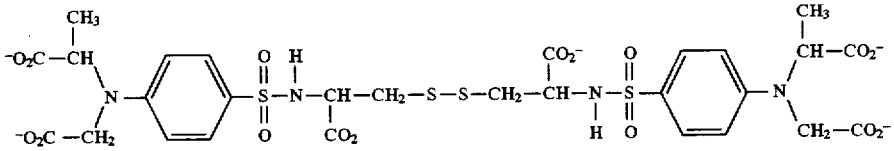
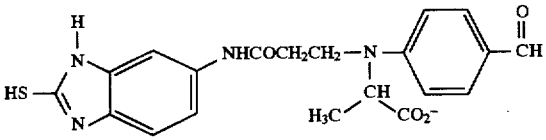
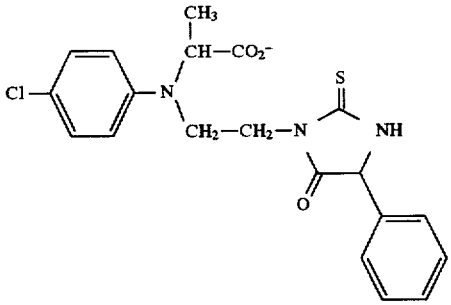
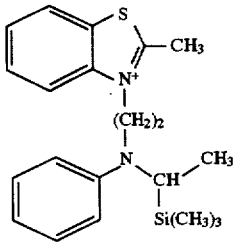
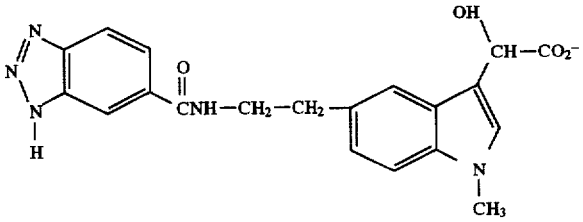

-continued
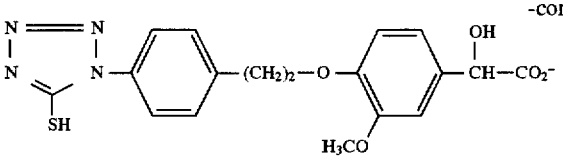
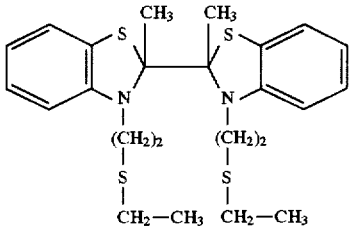
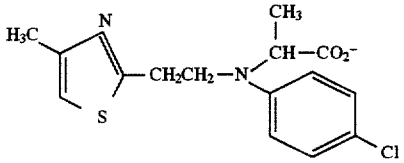
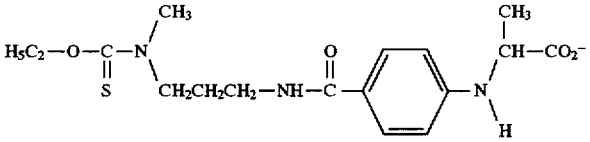
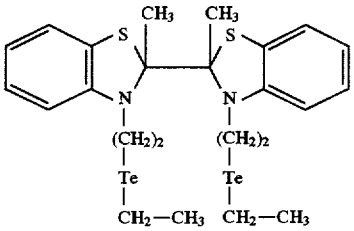
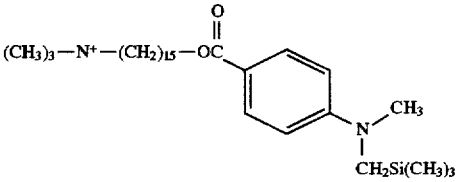
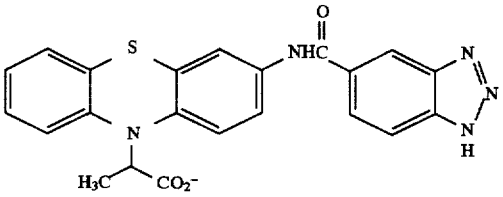
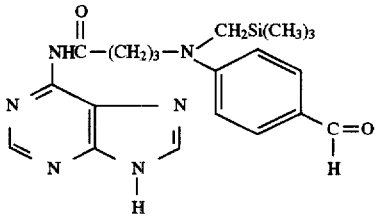
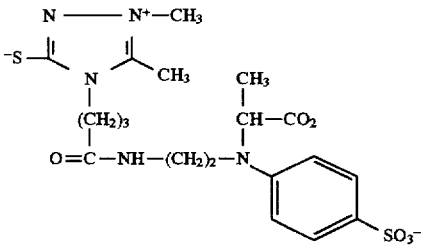
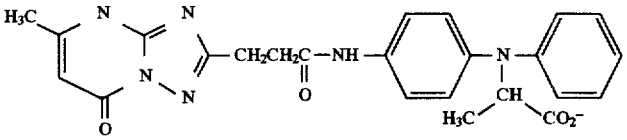
or
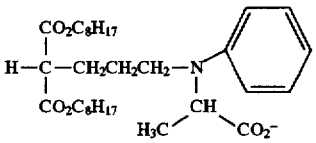

44. A photographic element according to claim 43, wherein the compound of the formula A-(L-XY)$_k$ or (A-L)$_k$—XY is of the formula:
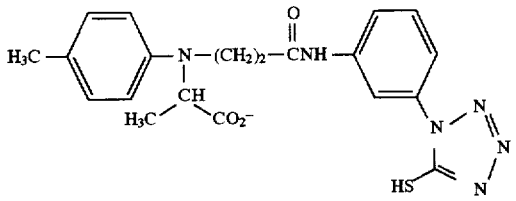
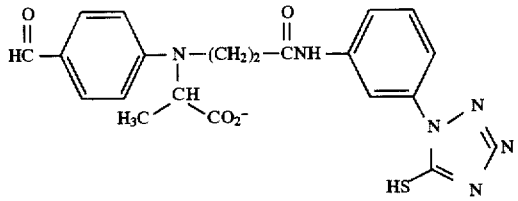
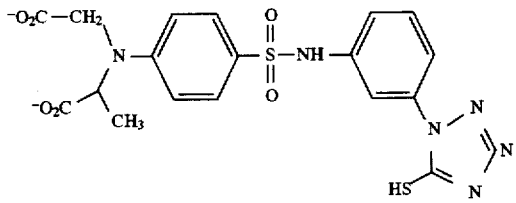
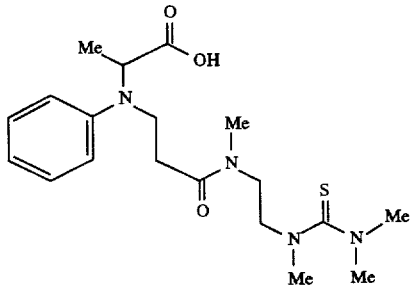
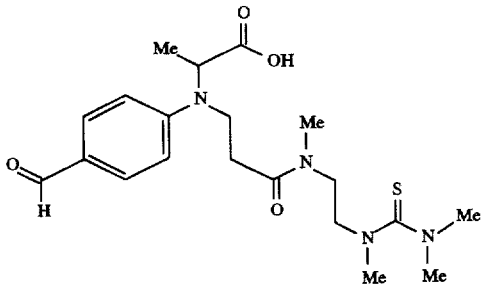
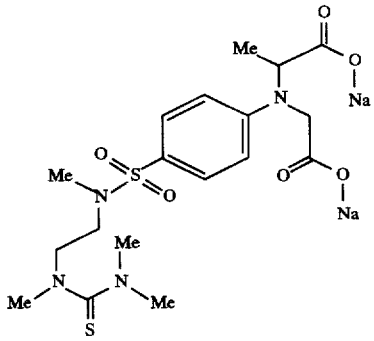
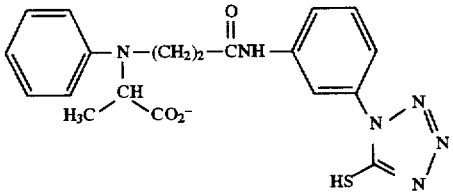
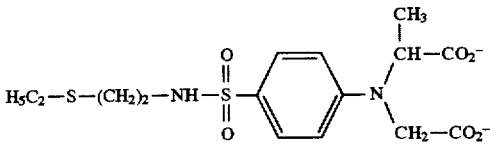
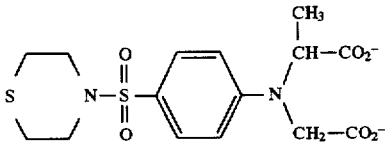
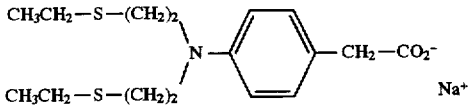
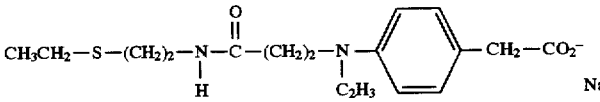
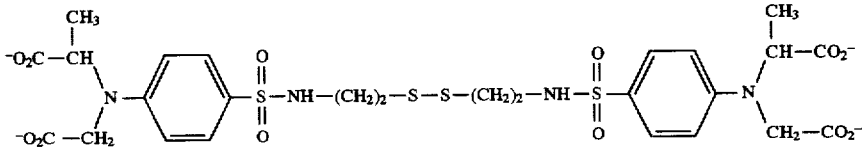
or -continued

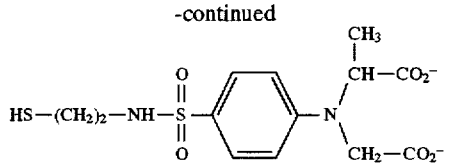

45. A photographic element according to claim 1 or claim 2, wherein the emulsion layer further contains a sensitizing dye.

46. A photographic element according to claim 45, wherein the sensitizing dye is selected from dyes of formula (VIII) through (XII):

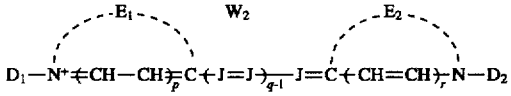

(VIII)

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

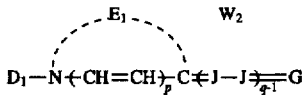

(IX)

wherein $E_1$, $D_1$, J, p, q and $W_2$ are as defined above for formula (VII) and G represents

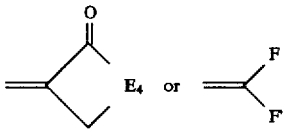

wherein $E_4$ represents the atoms necessary to complete a substituted or unsubstituted heterocyclic nucleus, and F and F' each independently represents a cyano radical, an ester radical, an acyl radical, a carbamoyl radical or an alkylsulfonyl radical;

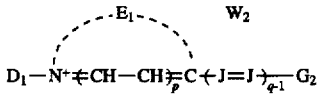

(X)

wherein $D_1$, $E_1$, J, p, q and $W_2$ are as defined above for formula (VII), and $G_2$ represents a substituted or unsubstituted amino radical or a substituted or unsubstituted aryl radical;

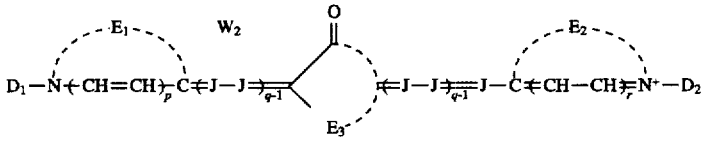

(XI)

wherein $D_1$, $E_1$, $D_2$, $E_1$, J, p, q, r and $W_2$ are as defined for formula (VII) above, and $E_3$ is defined the same as $E_4$ for formula (IX) above;

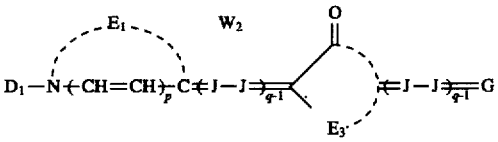

(XII)

wherein $D_1$, $E_1$, J, G, p, q, r and $W_2$ are as defined above for formula (VIII) above and $E_3$ is as defined for formula (XI) above.

47. A photographic element according to claim 1 or claim 2, comprising a plurality of layers wherein one or more of the layers of the element contains a hydroxybenzene compound.

48. A photographic element according to claim 47, wherein the hydroxybenzene compound has the formula:

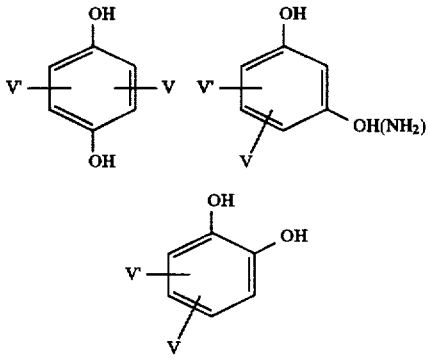

wherein V and V' each independently represent —H, —OH, a halogen atom, —OM (where M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

* * * * *